US007405744B2

(12) United States Patent
Denawa

(10) Patent No.: US 7,405,744 B2
(45) Date of Patent: Jul. 29, 2008

(54) THERMAL DEVELOPING APPARATUS

(75) Inventor: Tatsuyuki Denawa, Kanagawa (JP)

(73) Assignee: FUJFILM Corporation, Tokyo (JP)

( * ) Notice: Subject to any disclaimer, the term of this patent is extended or adjusted under 35 U.S.C. 154(b) by 221 days.

(21) Appl. No.: 11/070,220

(22) Filed: Mar. 3, 2005

(65) Prior Publication Data

US 2005/0195271 A1 Sep. 8, 2005

(30) Foreign Application Priority Data

Mar. 4, 2004 (JP) ..... P.2004-061246

(51) Int. Cl.
*B41J 2/315* (2006.01)

(52) U.S. Cl. ..... 347/171

(58) Field of Classification Search ..... 347/171, 347/222–223, 215, 217, 218; 399/301; 396/575; 400/88

See application file for complete search history.

(56) References Cited

U.S. PATENT DOCUMENTS 6,070,041 A * 5/2000 Nakayasu et al. ..... 399/301
6,200,043 B1 * 3/2001 Inoue et al. ..... 400/88
6,288,370 B1 9/2001 Ogawa et al.
6,312,170 B1 * 11/2001 Agano ..... 396/575
2004/0017467 A1 * 1/2004 Torisawa ..... 347/223

FOREIGN PATENT DOCUMENTS

DE 42 29 010 A1 * 3/1993

* cited by examiner

*Primary Examiner*—K. Feggins
(74) *Attorney, Agent, or Firm*—Sughrue Mion, PLLC

(57) ABSTRACT

A thermal developing apparatus for visualizing a latent image recorded on a photosensitive thermal developing recording material by heating the photosensitive thermal developing recording material with heating unit while conveying the photosensitive thermal developing recording material with conveying unit along a conveying path having the heating unit equipped therewith, the thermal developing apparatus containing a manual feeding tray for manually feeding the exposed photosensitive thermal developing recording material into the thermal developing apparatus.

5 Claims, 9 Drawing Sheets

THERMAL DEVELOPING APPARATUS

This application is based on Japanese Patent application JP 2004-061246, filed Mar. 4, 2004, the entire content of which is hereby incorporated by reference. This claim for priority benefit is being filed concurrently with the filing of this application.

BACKGROUND OF THE INVENTION

1. Field of the Invention

The present invention relates to a thermal developing apparatus for heating a photosensitive thermal developing recording material to visualize a latent image recorded on an image forming layer of the photosensitive thermal developing recording material.

2. Description of the Related Art

An image forming apparatus, referred to as a medical imager, for example, forms a print of a visible image from an image measured with a medical measuring instrument, such as CT and MRI. The image forming apparatus uses a photosensitive thermal developing recording material having a support, such as a PET film, having formed thereon an image forming layer having photosensitive and thermal developing property (hereinafter, sometimes simply referred to as a recording material), and the photosensitive thermal developing recording material is imagewise exposed with a light beam modulated according to image data supplied from an image data source, such as MRT, to form a latent image thereon. Thereafter, the photosensitive thermal developing recording material thus exposed is heated to form colors with a thermal developing part incorporated in the apparatus to output a hardcopy.

The image forming apparatus of this kind is basically constituted by a recording material feeding part, an image exposing part and a thermal developing part in the order of conveying the recording material. The recording material feeding part takes out the recording material from a magazine and feeds it downstream. The image exposing part imagewise exposes the recording material by light beam scanning exposure. The thermal developing part has heating unit, for example, a heating drum, and heats the recording material to effect thermal development to convert a latent image to a visible image. Specifically, the recording material brought into the thermal developing part is conveyed with holding between the heating drum and an endless belt and is thermally developed by heat of the heating drum, whereby a latent image recorded by exposure is converted to a visible image. Accordingly, the recording material is heated with the heating drum only from one side.

In another type of the thermal developing image forming apparatus, a photosensitive material having a latent image formed through imagewise exposure is conveyed with being overlapped with an image receiving material, and the materials are thermally adhered, whereby the latent image is developed and transferred to the image receiving material, followed by detaching the photosensitive material and the image receiving material from each other. In the thermal developing image forming apparatus, a photosensitive element coated on the photosensitive material is imagewise exposed to form a latent image. The photosensitive material is then overlapped with an image receiving material, and the materials are pressed under heat between a rotating drum and an endless belt pressed on the rotating drum, whereby diffusible dyes are released from the photosensitive material in an image part and transferred to the image receiving material. Thereafter, the materials are detached from each other to form a color image on the image receiving material.

In general, a recording material having an image forming layer on only one surface thereof (single sided photosensitive film) is used in the method of recording a latent image by imagewise exposing a recording material with a light beam modulated according to image data supplied from an image data source, such as MRI. Therefore, only one surface of the material having the image forming layer provided is heated as having been described for the aforementioned conventional technique. There are some cases where the recording material is heated from the side having no image forming layer even in a thermal developing part (thermal developing apparatus), in which a single sided photosensitive film is used (i.e., an auxiliary heat source is provided on a side where no image forming layer is provided). However, temperature control of the auxiliary heat source is only for supplementarily control the heating operation of the image forming layer provided on only one surface, and there is no necessity of heating from both surfaces of the material.

In the method, in which a subject is placed between an X-ray tube and a recording material, and a latent image is recorded on the recording material with an X-ray transmitted through the subject, a recording material having image forming layers on both sides of a support (double sided photosensitive film) is used. The double sided photosensitive film is housed, upon imaging, in a cassette with fluorescent intensifying screens disposed on both front and back surfaces thereof. The fluorescent intensifying screen emits fluorescent light upon irradiating with an X-ray. The double sided photosensitive film is exposed with the fluorescent light.

In the case where a recording material having image forming layers on both surfaces is applied to the conventional thermal developing apparatus for heating only one surface of a material, heat transmission to the image forming layer on the side not heated is delayed. Due to the delay in development, deviation occurs in color tone, for example, the color of the image forming layer is discolored in brown. Furthermore, in the case where heat is not sufficiently transmitted to the image forming layer on the side not heated, development thereof becomes insufficient to cause density fluctuation, in which the density thereof is reduced.

On the other hand, in a thermal developing transferring part in a thermal developing image forming apparatus, in which a recording material is also heated from the side having no image forming layer, i.e., a image forming layer formed only on one surface is auxiliary heated, the heating operation does not intend to heat image forming layers provided on both sides, and therefore, difference in development occurs between the image forming layers on front and back surfaces to cause deviation in color tone and fluctuation in density.

The inventors have developed such a thermal developing apparatus that solve the problems associated with the aforementioned conventional technique.

FIG. 1 is a constitutional diagram showing a first embodiment of a thermal developing apparatus of the invention, and FIG. 2 is a cross sectional view of a photosensitive thermal developing recording material used therein.

In FIG. 1, a thermal developing apparatus 100 heats a photosensitive thermal developing recording material (recording material) A to visualize a latent image recorded on an image forming layer. As shown in FIG. 2, the recording material A used in the thermal developing apparatus 100 has image forming layers A2 and A2 each containing a photosensitive material provided on both the first surface as one surface (for example, a front surface) of a support A1 and the second surface as the other surface (for example, a back surface) thereof.

In the thermal developing apparatus 100, such a recording material A can be used that is a double sided photosensitive film having fluorescent intensifying screens, which are not shown in the figure, disposed on both the first and second surfaces of the recording material A. The fluorescent intensifying screen emits fluorescent light through excitation upon irradiating with an X-ray. The image forming layers A2 and A2 provided on both first and second surfaces are exposed with fluorescent light from the fluorescent intensifying screens by a small amount of an X-ray. The recording material A will be described in detail later.

The recording material A having a latent image on the image forming layer A2 is generally housed in a cassette K one by one, and it is fed to the thermal developing apparatus 100 along with the cassette K. An openable lid K1 of the cassette K thus fed to the thermal developing apparatus 100 is opened and the recording material A housed therein is taken out with taking unit using a sucking disk 41 or the like.

The thermal developing apparatus 100 may have such a structure that is installed with a magazine housing plural sheets of the recording materials A. In this case, the recording materials A each having a latent image are taken out from cassettes K and housed by stacking in the magazine in a dark room or the like. The recording materials A stacked and housed in the magazine are taken out with the sucking disk 41 one by one. A pickup roller may be used instead of the sucking disk 41.

The recording material A thus taken out is then transported to a thermal developing part 47 positioned at a downstream side of the conveying direction through a conveying roller pair 43 and a conveying guide 45. A guiding part may be provided between the conveying roller pair 43 and the thermal developing part 47 for positioning the recording material A thus taken out in the direction perpendicular to the conveying direction, whereby the recording material A is positioned with respect to the thermal developing part 47 at the downstream side.

The thermal developing part 47 has first heating unit 49*a* for heating the first surface of the recording material A and second heating unit 49*b* for heating the second surface of the recording material A, which are disposed to face each other with a conveying path C of the recording material A intervening therebetween. In this embodiment, the first heating unit 49*a* is constituted by a cylindrical drum 51. The second heating unit 49*b* is constituted by plural press rollers 53, which rotate and press the recording material A to the peripheral surface of the drum 51. The drum 51 and the press rollers 53 contain heaters H as heating sources contained therein, respectively.

In this embodiment, the drum 51 having the heater H contained therein and the press rollers 53 having the heaters H contained therein are disposed to face each other with the conveying path C intervening therebetween, whereby both the first and second surfaces of the recording material A are simultaneously heated. That is, the recording material A is transported to the conveying path C formed by the gap between the drum 51 and the press rollers 53, and conveyed by being holded with the drum 51 and the press rollers 53, so as to be thermally developed by heat from the drum 51 and the press rollers 53.

The heater H used as a heating source of the drum 51 is not particularly limited, and may be one using known heating unit, such as a heating element, e.g., nichrome wire, a light source, e.g., a halogen lamp, and means for heating with hot air.

The press roller 53 may be a metallic roller, a resin roller, a rubber roller or the like, and is disposed over the entire length of the drum 51 in the axial direction thereof. The heater H used as a heating source of the press roller 53 is also not particularly limited, and may be one using known heating unit, such as a heating element, e.g., nichrome wire.

In the thermal developing part 47, upon transporting the recording material A to the conveying path C, the first surface is pressed with the press rollers 53 to press the second surface to the drum 51, whereby both the first and second surfaces of the recording material A are simultaneously heated. According to the operation, both the surfaces of the recording material A can be heated uniformly in a short period of time. In this constitution, the drum 51 and the press rollers 53 are rotated as being synchronized with the conveying speed of the recording material A, whereby there is no deviation in relative position of the heating unit and the recording material A, and the recording material A is not scraped.

The recording material A having been developed in the thermal developing part 47 is fed to an cooling part 61 disposed at a downstream side of the conveying direction. The cooling part 61 is constituted by plural cooling rollers 63 and has such a function that the recording material A having been thermally developed is gradually cooled, and therefore, the cooling part 61 is set at such a temperature that is higher than non-heated members but is lower than the thermal developing temperature. The recording material A thus slowly cooled in the cooling part 61 is transported in the downstream side of the conveying direction with a pair of delivering rollers 65 and 67 and delivered to a tray 69.

The thermal developing apparatus 100 has a controlling part 71 for controlling the first heating unit 49*a*, the second heating unit 49*b*, and the conveying speed of the recording material A. The controlling part 71 controls the first heating unit 49*a* through a first temperature setting part 73, and controls the second heating unit 49*b* through a second temperature setting part 75. It controls a conveyance driving part 79, such as a conveying motor, through a conveying speed setting part 77. The controlling part 71 controls the temperature and the conveying speed as parameters in such a manner that the total amount of heat applied to the first and second surfaces falls within the aforementioned prescribed range.

Therefore, according to the thermal developing apparatus 100, the first and second surfaces of the recording material A are simultaneously heated, and the total amount of heat applied to the second surface is controlled with respect to the total amount of heat applied to the first surface, whereby the total amounts of heat applied to both the surfaces of the photosensitive thermal developing recording material are substantially agree with each other, and thus uniform thermal development for both the surfaces can be carried out in a short period of time.

However, the thermal developing apparatus shown in FIG. 1 is of such a type that a cassette housing a double sided photosensitive film is inserted, and has a problem in increasing the size of the apparatus.

The thermal developing part 47 also has such a defect that the apparatus is increased in size due to the use of the cylindrical drum 51.

SUMMARY OF THE INVENTION

An object of the invention is to provide a thermal developing apparatus capable of being reduced in installation space by further miniaturizing the thermal developing apparatus capable of thermally developing both surfaces uniformly.

In order to attain the aforementioned object, the invention relates to, as a first aspect, a thermal developing apparatus for visualizing a latent image recorded on a photosensitive thermal developing recording material by heating the photosensitive thermal developing recording material with heating unit while conveying the photosensitive thermal developing recording material with conveying unit along a conveying path having the heating unit equipped therewith, the thermal developing apparatus containing a manual feeding tray for manually feeding the exposed photosensitive thermal developing recording material into the thermal developing apparatus.

In a preferred embodiment, the invention relates to, as a second aspect, the thermal developing apparatus of the first aspect, wherein the conveying path is formed in a circular arc shape, the heating unit heats both sides of the photosensitive thermal developing recording material, and the manual feeding tray is provided at such an angle that the photosensitive thermal developing recording material placed thereon steeply descends on a horizontal plane containing a feeding slot of the thermal developing apparatus.

In another preferred embodiment, the invention relates to, as a third aspect, the thermal developing apparatus of the second aspect, wherein the angle for steeply descending is 45° or more with respect to the horizontal plane containing a feeding slot of the thermal developing apparatus.

In still another preferred embodiment, the invention relates to, as a fourth aspect, the thermal developing apparatus, in which the apparatus of the first aspect is turned upward by 90° to arrange a feeding slot of the thermal developing apparatus, which is originally disposed horizontally, perpendicular to a floor, and the apparatus further contains a foot member on a surface thereof facing the floor.

In a further preferred embodiment, the invention relates to, as a fifth aspect, the thermal developing apparatus, in which the apparatus of the first aspect is turned upward by 90° to make a feeding slot of the thermal developing apparatus upward, and to make a discharge slot thereof downward, and the apparatus further contains a wall hanging member on a surface thereof facing a wall, or contains a foot member on a surface thereof facing a floor.

In a still further preferred embodiment, the invention relates to, as a sixth aspect, the thermal developing apparatus of one of the first to fifth aspects, wherein the apparatus contains a conveying path formed in a circular arc shape and heating unit disposed with the conveying path; the apparatus visualizes a latent image recorded on a photosensitive thermal developing recording material by heating the photosensitive thermal developing recording material with the heating unit while conveying the photosensitive thermal developing recording material with conveying unit along the conveying path; the conveying unit contains plural rollers disposed along the conveying path to constitute one of guide surfaces of the conveying path, driving pulleys disposed at ends of the conveying rollers, respectively, and a timing belt engaged with the driving pulleys; and the conveying rollers being rotated with the timing belt.

According to the invention, a cassette installing part of a thermal developing apparatus capable of attaining uniform thermal development on both surfaces is omitted but a manual feeding tray is used, and a large cylindrical drum in a thermal developing part is replaced by a compact heating and conveying unit arranged serially in the conveying direction, whereby the apparatus can be further miniaturized to reduce the installation space thereof.

It is also possible that the manual feeding tray can be made steeply slanted, and the apparatus is miniaturized and thus placed vertically or hung on a wall, whereby the installation space thereof can be further reduced.

In the compact heating and conveying unit, a timing belt is engaged with the driving pulleys of the respective conveying rollers to drive the plural conveying rollers constituting the guide surface of the conveying path, whereby the driving mechanism is simplified and miniaturized, and a recording material can be smoothly conveyed in the curved conveying path.

DETAILED DESCRIPTION OF THE INVENTION

Figure 3:
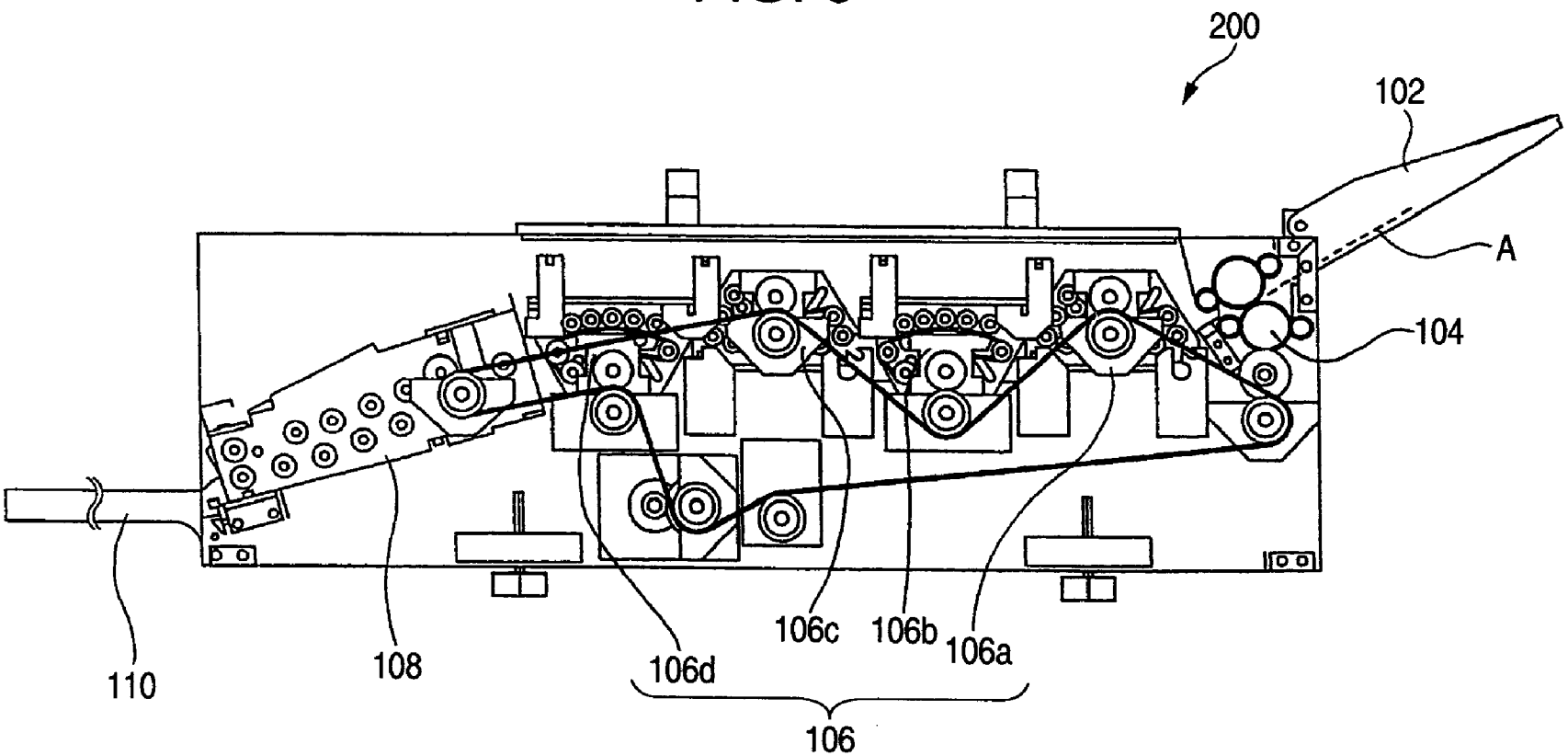
FIG. 3 is an overall constitutional view showing a first embodiment of a thermal developing apparatus of the invention.

FIG. 3 is an overall constitutional view showing a first embodiment of a thermal developing apparatus of the invention.

In FIG. 3, numeral 200 denotes a thermal developing apparatus of the first embodiment of the invention, 102 denotes a manual feeding tray, 104 denotes a nip roller pair, 106 denotes a thermal developing part, 108 denotes a cooling part, and 110 denotes a discharging tray.

A recording material A fed into the apparatus through the manual feeding tray 102 by an operator in a dark room is conveyed to the thermal developing part 106 at the downstream side of the conveying direction through the nip roller pair 104.

The thermal developing part 106 is constituted by four heating and conveying unit 106*a* to 106*d* arranged serially in the conveying direction, and the recording material A is heated by passing through them to visualize a latent image by thermal development.

The recording material A thus developed by heating in the thermal developing part 106 is cooled with a metallic roller pair of the cooling part 108 at the downstream side of the conveying direction and then delivered to the discharging tray 110.

Figure 1:
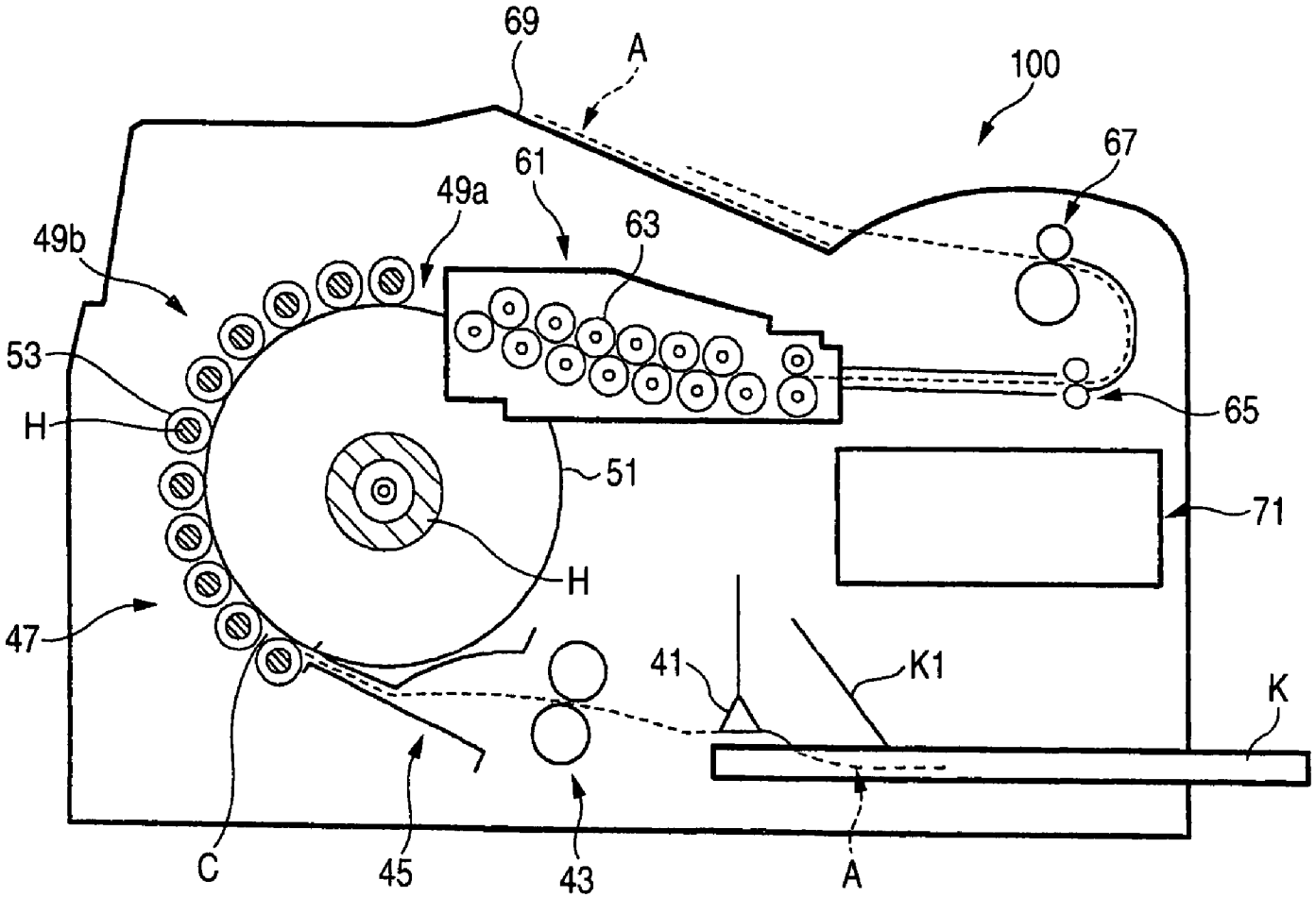
FIG. 1 is a constitutional diagram showing a first embodiment of a thermal developing apparatus of the invention.
Figure 2:
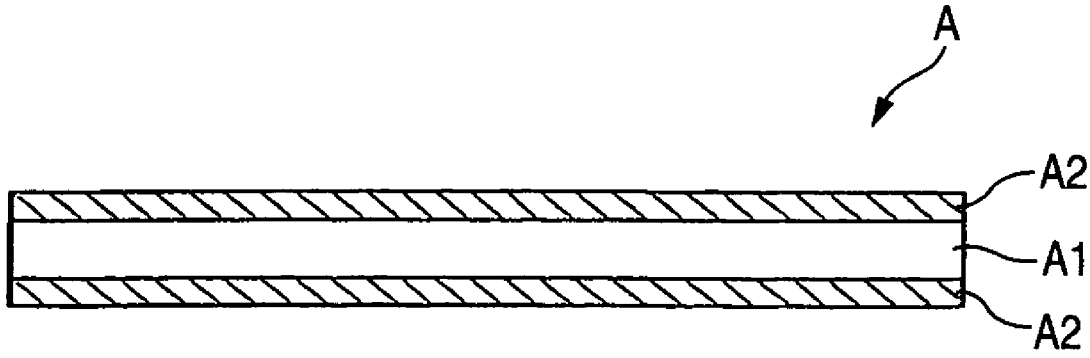
FIG. 2 is a cross sectional view of a photosensitive thermal developing recording material used in the invention.

As understood from the figure, some of the characteristic features of the invention reside in that (1) the cassette installing part in the embodiment shown in FIG. 1 is omitted to miniaturize the apparatus, and (2) the cylindrical drum 51 in the embodiment shown in FIG. 1 is replaced by the four heating and conveying unit 106*a* to 106*d* arranged serially in the conveying direction.

Figure 4:
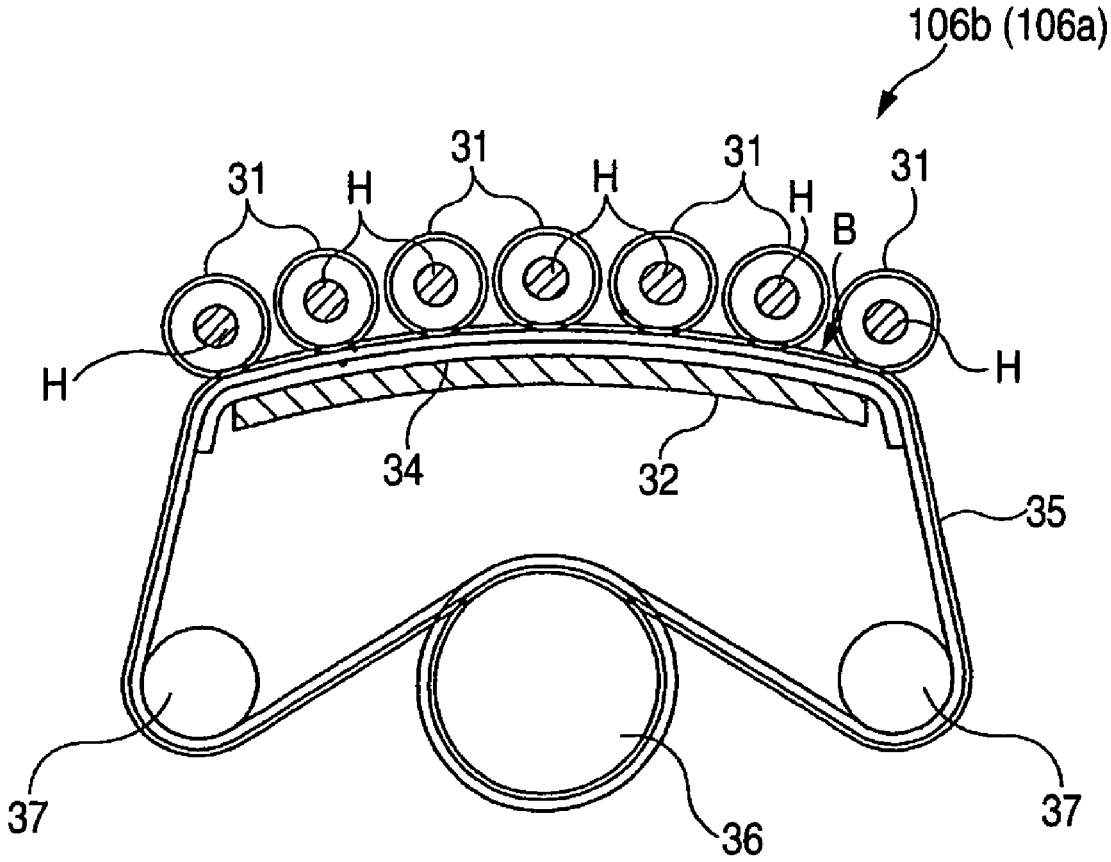
FIG. 4 is a constitutional view of heating and conveying unit.
Figure 5:
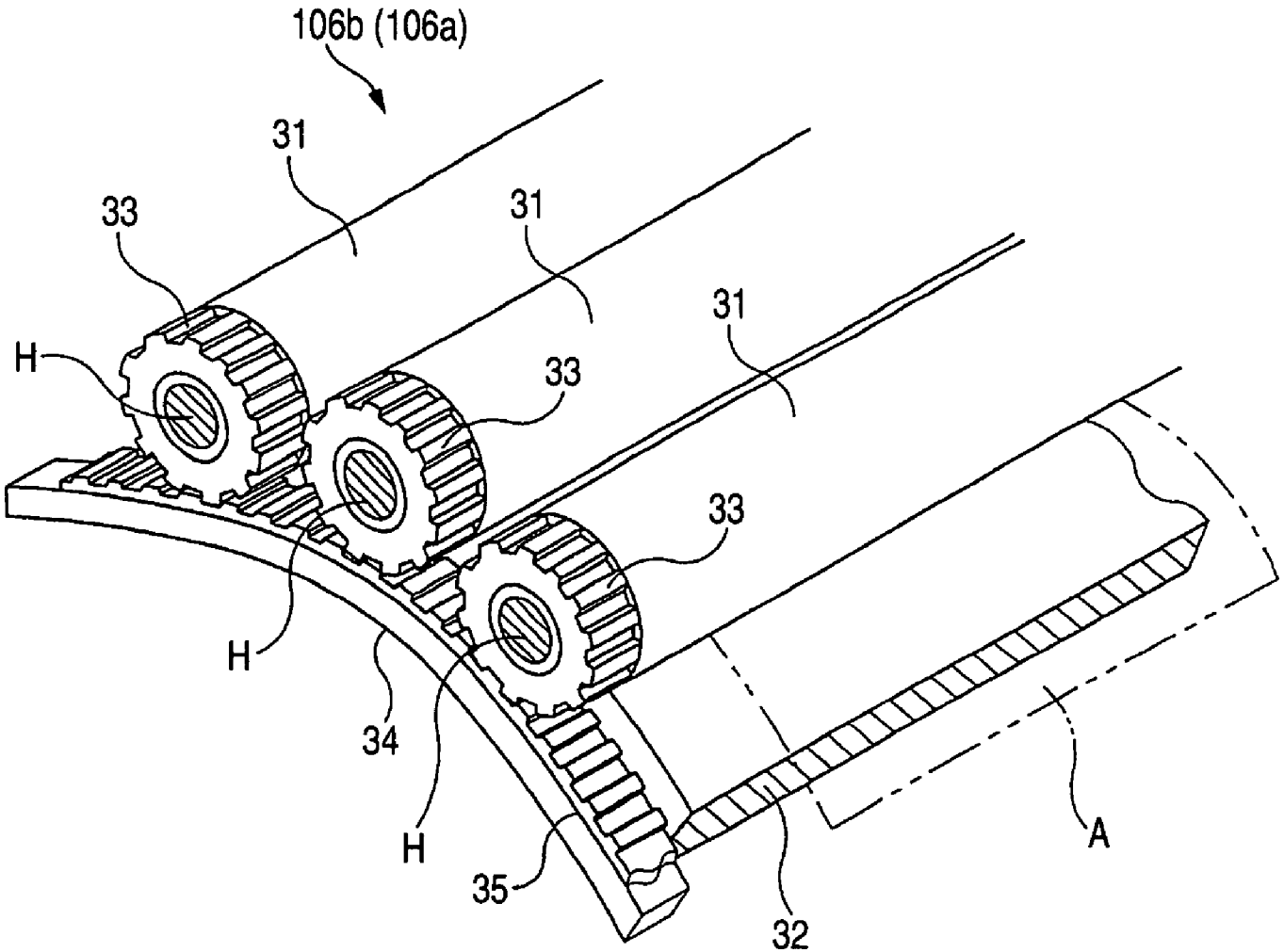
FIG. 5 is a perspective view partly showing an important part of the heating and conveying units shown in FIG. 4.

FIGS. 4 and 5 are illustrations for describing one of the heating and conveying unit 106*a* to 106*d*, in which FIG. 4 is a constitutional view thereof, and FIG. 5 is a perspective view partly showing an important part of the heating and conveying unit shown in FIG. 4. The heating and conveying unit 106*b* has a conveying path B in a circular arc shape as shown in FIG. 4. In the heating and conveying unit 106*b*, an outer guide surface of the conveying path B is constituted by plural conveying rollers (driving rollers) 31, which are arranged on a line in a circular arc shape having the same curvature center as the curvature center of the conveying path B and having a larger curvature radius than the curvature radius of the conveying path B.

In the heating and conveying unit 106*i* , an inner guide surface of the conveyingpath B is constituted by a plate heater 32 formed to have a circular arc shape having the same curvature center as the curvature center of the conveying path B and having a smaller curvature radius than the curvature radius of the conveying path B. The conveying rollers 31 and the plate heater 32 are arranged to be in contact with each other or to be close to each other.

As shown in FIG. 5, driving pulleys 33 are fixed at ends of the conveying rollers 31, respectively, and inside the driving pulleys in terms of the curvature radius thereof, a pressing plate 34 is disposed that has a circular arc shape having the same curvature center as the curvature center of the conveying path B and having a smaller curvature radius than the curvature radius of the conveying path B.

In the heating and conveying unit 106*b*, a timing belt 35 intervenes between the driving pulleys 33 of the conveying rollers 31 and the pressing plate 34, and teeth of the timing belt are engaged with the driving pulleys 33 with the engaged state being maintained by the pressing plate 34.

The timing belt 35 is laid on a driving pulley 36 connected to a driving source, such as a motor, and idle pulleys 37, and all the driving pulleys 33 are rotationally driven by rotation of the driving pulley 36. Therefore, all the conveying rollers 31 are forcedly rotated to convey the recording material A between the conveying rollers 31 and the plate heater 32, and one surface of the recording material A is heated with the plate heater 32 to attain thermal development. In the case of heating only one surface, another heating and conveying unit 106*a* having the same constitution is arranged in the reverse direction at the downstream side of the conveying direction to heat the surface having not been heated, and the driving pulleys thereof are driven with the common timing belt. In the case where heaters H are installed in the conveying rollers 31, respectively, both the surfaces of the recording material A are simultaneously heated, whereby the apparatus can be miniaturized.

The timing belt 35 is engaged with the conveying rollers 31 at a negative contact center angle, whereby the conveying rollers 31 are not pressed onto the plate heater 32 with the timing belt 35 at an unnecessarily large pressure, and therefore, the recording material A conveyed between the conveying rollers 31 and the plate heater 32 is not pressed at an unnecessarily large pressure to avoid a possibility of damaging the recording material A.

According to the first embodiment of the invention having been described, the cassette installing part of the thermal developing apparatus capable of attaining uniform thermal development on both surfaces is omitted but a manual feeding tray is used, and the large cylindrical drum of the thermal developing part is replaced by the four compact heating and conveying unit 106*a* to 106*d* arranged serially in the conveying direction, whereby the apparatus can be further miniaturized, and the installation space thereof can be reduced.

Figure 6:
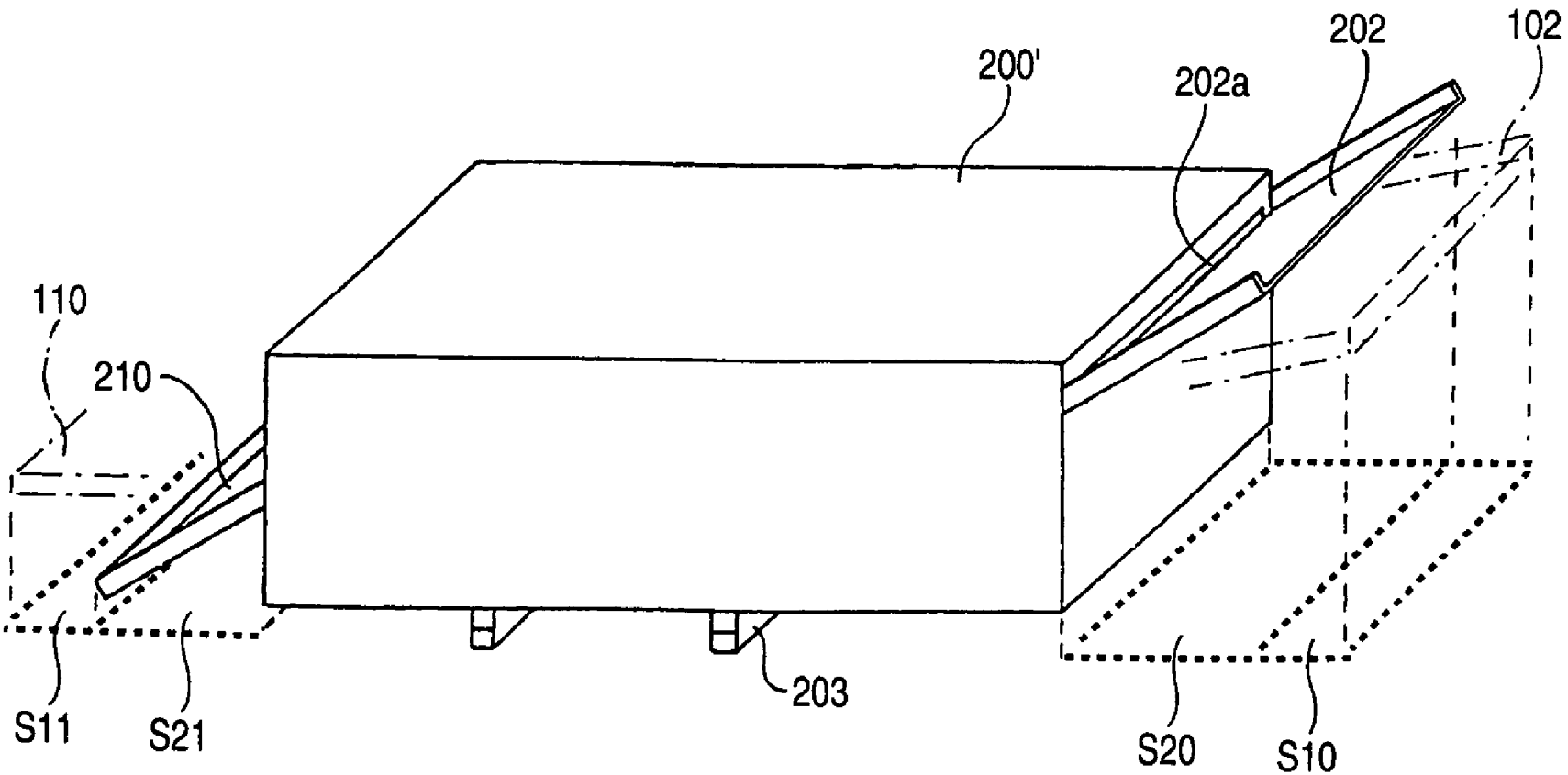
FIG. 6 is a perspective outline view showing a second embodiment of the invention.

FIG. 6 is a perspective outline view showing a second embodiment of the invention.

In FIG. 6, numeral 200' denotes a thermal developing apparatus of the second embodiment of the invention, 202 denotes a manual feeding tray, 202*a* denotes a feeding slot for a recording material, 203 denotes a foot member, and 210 denotes a discharging tray. The thermal developing apparatus 200' has the same internal structure as the thermal developing apparatus 200 shown in FIG. 3, and they are different from each other in that the manual feeding tray 202 and the discharging tray 210 are steeply slanted in the thermal developing apparatus 200'. The angle of slanting them is preferably 45° or more with respect to the horizontal plane including the feeding slot 202*a* of the thermal developing apparatus for reducing the installation area. According to the embodiment, the projected areas of the manual feeding tray 202 and the discharging tray 210 can be reduced to provide such an effect that the installation area of the apparatus can be reduced.

The projected area of the manual feeding tray 202 of the thermal developing apparatus 200' is as shown by S20 in FIG. 6, and the projected area of the manual feeding tray 102 of the thermal developing apparatus 200 in FIG. 3 is as shown by S20+S10 in FIG. 6. Accordingly, the installation area of the manual feeding tray can be reduced by S10 as the difference therebetween.

Similarly, the projected area of the discharging tray 210 of the thermal developing apparatus 200' is as shown by S21 in FIG. 6, and the projected area of the discharging tray 110 of the thermal developing apparatus 200 in FIG. 3 is as shown by S21+S11 in FIG. 6. Accordingly, the installation area of the discharging tray can be reduced by S11 as the difference therebetween.

Figure 7:
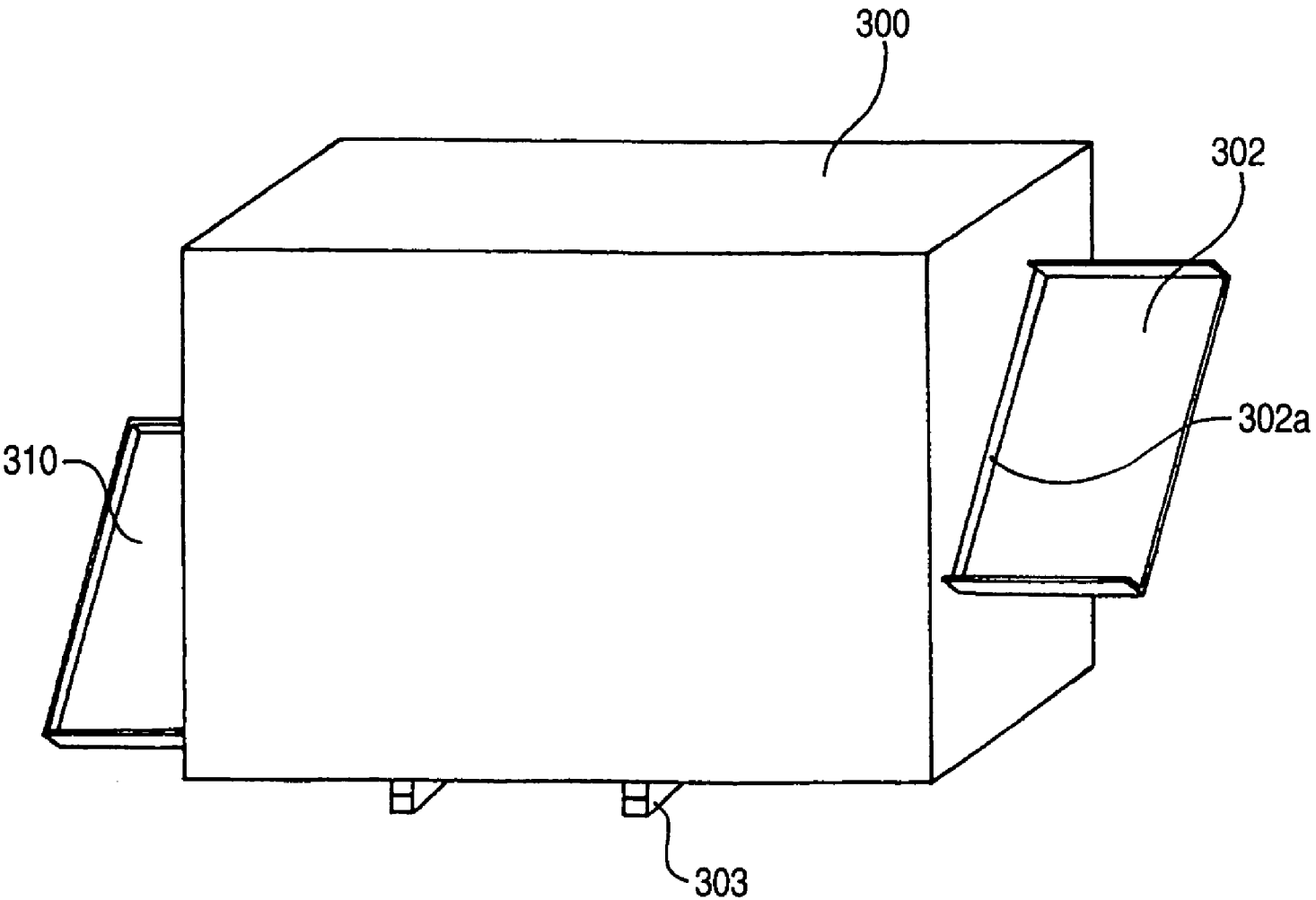
FIG. 7 is a perspective outline view showing a third embodiment of the invention.

FIG. 7 is a perspective outline view showing a third embodiment of the invention.

In FIG. 7, numeral 300 denotes a thermal developing apparatus of the third embodiment of the invention, 302 denotes a manual feeding tray, 302*a* denotes a feeding slot for a recording material, 303 denotes a foot member, and 310 denotes a discharging tray. The thermal developing apparatus 300 has the same internal structure as the thermal developing apparatus 200 shown in FIG. 3, and they are different from each other in that the manual feeding tray 302 and the discharging tray 310 are provided vertically or provided slightly obliquely with respect to a floor to prevent a recording material from dropping, and the apparatus is vertically disposed on a floor. More precisely, the thermal developing apparatus 300 is turned upward by 90° to arrange the feeding slot 302, which is originally disposed horizontally, perpendicular to the floor, and the foot member is provided on the surface of the apparatus facing the floor to stabilize the apparatus.

According to the embodiment, the projected areas of the manual feeding tray 302 and the discharging tray 310 can be reduced to reduce the installation area of the apparatus, and the installation area on the floor can be significantly reduced although the height of the apparatus is increased.

Figure 9:
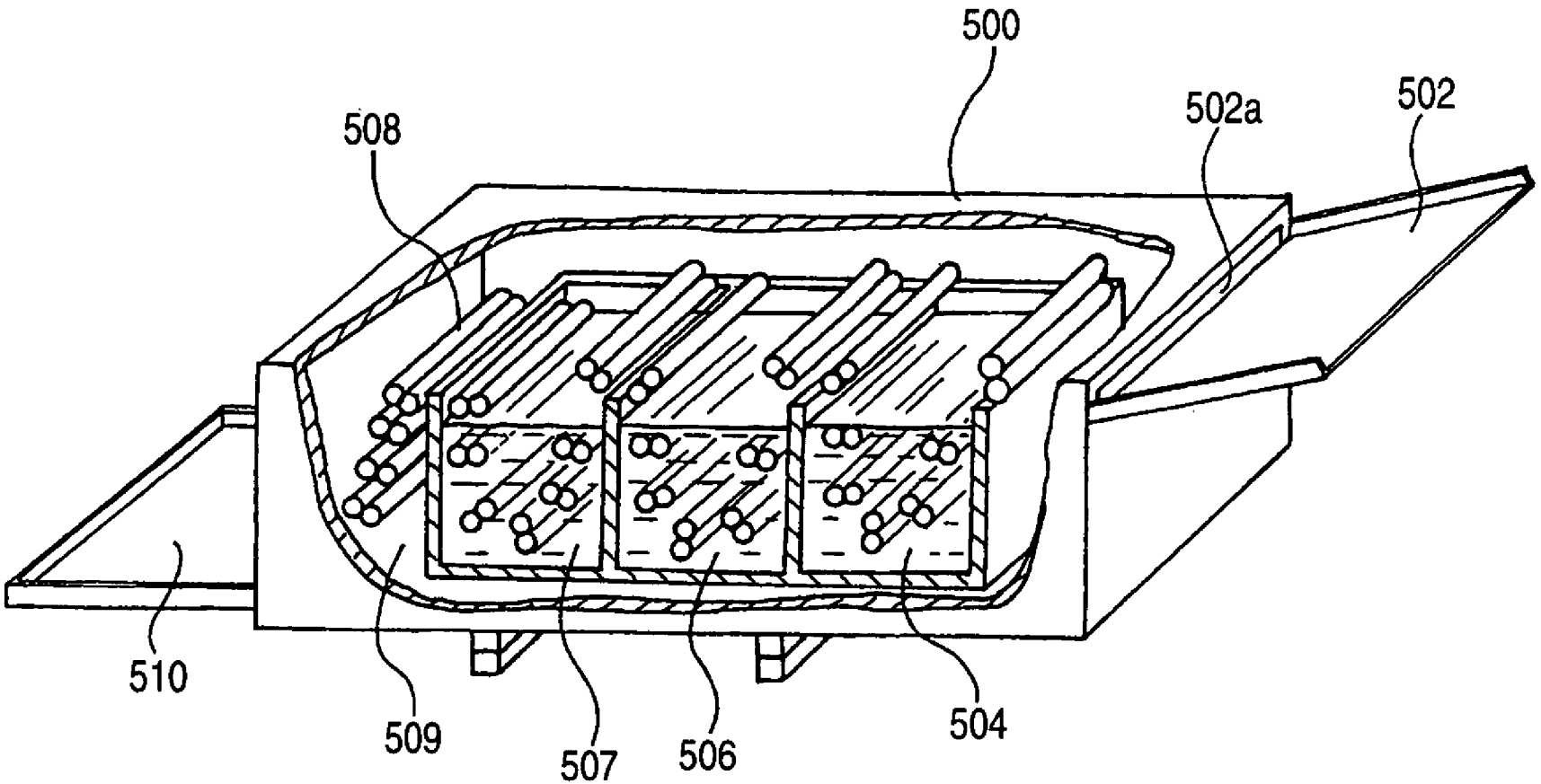
FIG. 9 is an overall constitutional view showing a conventional wet type developing apparatus.

There has been no thermal developing apparatus exploiting miniaturization by employing manual feeding, but only a wet type developing apparatus using manual feeding has been found as shown in FIG. 9. FIG. 9 is an overall constitutional view showing a conventional wet type developing apparatus.

In FIG. 9, upon feeding a film to be developed to a feeding slot 502 through a manual feeding tray 502, the film is brought into the interior of the apparatus with nip rollers and is firstly delivered to a developing bath 504. After developing the film in the developing bath 504, the film is then conveyed to a fixing bath 506 with conveying rollers. After fixing in the fixing bath 506, the developing solution on the film is removed in a water washing bath 507, and the film is squeezed in a squeezing bath 508, dried in a drying part 509, and then delivered to a discharging tray 510.

The respective baths of the wet type developing apparatus are filled with liquids, and thus the apparatus cannot be vertically disposed on a floor by turning the entire apparatus upward by 90° as shown in FIG. 7.

Therefore, no such an effect cannot be expected for a wet type developing apparatus that the installation area on a floor is significantly reduced, but in the third embodiment of the invention, the thermal developing apparatus using manual feeding for miniaturization (as shown in FIG. 3) is further disposed vertically, whereby the apparatus can be installed on a smaller area.

Figure 8:
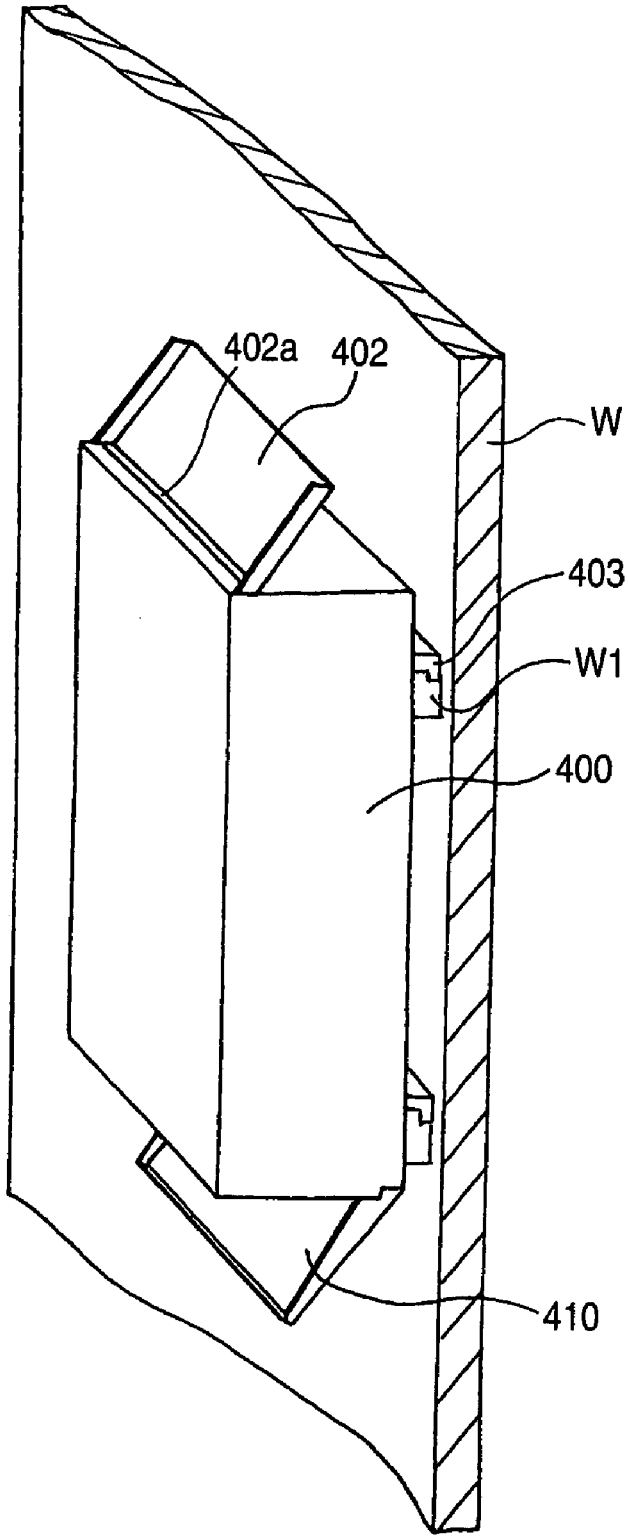
FIG. 8 is a perspective outline view showing a fourth embodiment of the invention.

FIG. 8 is a perspective outline view showing a fourth embodiment of the invention.

In FIG. 8, numeral 400 denotes a thermal developing apparatus of the fourth embodiment of the invention, 402 denotes a manual feeding tray, 402*a* denotes a feeding slot for a recording material, 403 denotes a wall hanging hook, 410 denotes a discharging tray, W denotes a wall, and W1 denotes a locking member provided on the wall W. The wall hanging hook 403 provided at the back part of the apparatus 400 can be engaged with the locking member W1 provided at the wall to maintain the thermal developing apparatus 400 being hung on the wall W.

The thermal developing apparatus 400 has the same internal structure as the thermal developing apparatus 200 shown in FIG. 3, and they are different from each other in that the apparatus is vertically disposed, and the wall hanging hook 403 is provided at the back thereof to make the apparatus capable of being hung on the wall W. According to the embodiment, the thermal developing apparatus 400 is not placed on a floor, and thus the floor face can be effectively utilized for other purposes.

The apparatus may be placed on a floor in case where no sufficient space can be obtained on a wall, and in this case, it is necessary to provide a foot member having a length larger than the length of the discharging tray. In the fourth embodiment of the invention, accordingly, the thermal developing apparatus using manual feeding for miniaturization (as shown in FIG. 3) is further disposed by hanging on a wall, whereby the floor face can be further effectively utilized for other purposes.

The use of the wall hanging configuration has not been considered for a thermal developing apparatus for heating both surfaces of a material using a cassette because the apparatus is too large, and the feeding slot for the cassette is necessarily maintained horizontally. It is impossible to apply the wall hanging configuration to the wet type developing apparatus (as shown in FIG. 9) because the baths are filled with liquids.

In the invention, the thermal developing apparatus can be vertically disposed or hung on a wall owing to such a configuration that a cassette installing part of a thermal developing apparatus capable of attaining uniform thermal development on both surfaces is omitted but a manual feeding tray is used, and a large cylindrical drum in a thermal developing part is replaced by a compact heating and conveying unit arranged serially in the conveying direction and driven with a timing belt.

In the aforementioned embodiments, a recording material is heated while conveying, but the following heating process may be employed. That is, after conveying a recording material to a first heating part, the conveyance of the recording material is terminated, and one surface of the recording material is heated in a resting state in the first heating part. After completing the heating in the first heating part, the recording material is then conveyed to a second heating part, and the opposite surface of the recording material is then heated in a resting state in the second heating part.

A thermal developing photosensitive material to be applied to the thermal developing apparatus of the invention will be described in detail.

The photosensitive material for imaging used in an embodiment of the invention is of such a type that an image is recorded by plane exposure, but is not such a type that image information is written by scanning exposure with laser light or the like.

In the field of wet developing type photosensitive material, a direct or indirect X-ray film, a mammography film and the like for medical use, and a prepress film, a film for industrial recording, an imaging film for an ordinary camera, and the like for general purposes have been known. For example, there have been disclosed a double side-coated X-ray thermal developing photosensitive material utilizing a blue fluorescent intensifying screen (as disclosed, for example, in Japanese Patent No. 3,339,344), a thermal developing photosensitive material using silver iodobromide tabular particles (as described, for example, in JP-A-59-142539), and a medical photosensitive material having tabular particles coated on both surfaces of a support, the tabular particles having a (100) major plane and having a high content of silver chloride (as described, for example, in JP-A-10-282606). A double side-coated thermal developing photosensitive material is also disclosed in other patent documents (for example, JP-A-2000-227642, JP-A-2001-22027, JP-A-2001-109101 and JP-A-2002-90941). However, these conventional materials have a low sensitivity although no haze deterioration occurs by using fine silver halide particles having a diameter of 0.1 μm or less, and cannot be used for practical imaging. In the case where silver halide particles having a diameter of 0.5 μm or more are used, the material suffers serious deterioration in image quality and print out due to deterioration in haze by remaining silver halide, and cannot be practically used.

A photosensitive material using silver iodide tabular particles as silver halide particles has been known in the field of wet development (disclosed, for example, in JP-A-59-119344 and JP-A-59-119350), but there has been no application thereof to a thermal developing photosensitive material. This is because of the low sensitivity as having been described and the lack of effective sensitizing unit, and also because higher technical obstacle is present in the field of thermal development.

Upon applying the filed of image of this kind, a thermal developing photosensitive material is demanded to have a higher sensitivity and to exert higher image quality, such as haze.

A thermal developing photosensitive material according to the following embodiment is useful for satisfying the aforementioned demands.

1. Thermal Developing Photosensitive Material

A thermal developing photosensitive material of this embodiment contains a support having at least one surface thereof an image forming layer containing a photosensitive silver halide, a non-photosensitive organic silver halide, a reducing agent and a binder. In a preferred embodiment, a surface protective layer may be provided on the image forming layer, and a back layer or a back protective layer may be provided on the surface opposite thereto.

The constitutions of the layers and preferred components thereof will be described in detail below.

(Compound Substantially Reducing Visible Light Absorption Ascribed To Photosensitive Silver Halide After Thermal Development)

In the embodiment, such a compound is preferably contained that substantially reduces, after thermal development, the visible light absorption ascribed to the photosensitive silver halide with respect to before thermal development.

In the embodiment, a silver iodide complexing agent is preferably used as the compound substantially reducing the visible light absorption ascribed to the photosensitive silver halide after thermal development.

Silver Iodide Complexing Agent

In the silver iodide complexing agent in the embodiment, at least one of a nitrogen atom and a sulfur atom in the compound can contribute as a coordinating atom (electron donor: Lewis base) to a Lewis acid-base reaction donating an electron to a silver ion. The stability of a complex, which is defined by the recursive stability constant or the total stability constant, depends on the combination of three components, i.e., a silver ion, an iodide ion and the silver complexing agent. As a general guideline, a large stability constant can be obtained by such measures as the chelating effect by intramolecular chelate ring formation and the increase in acid-base dissociation constant of the ligand.

Although the functioning mechanism of the silver iodide complexing agent in the embodiment is not clearly resolved, it is expected that a stable complex containing three component including an iodide ion and a silver ion is formed to solubilize silver iodide. The silver iodide complexing agent in the embodiment has poor capability of solubilizing silver bromide and silver chloride, but specifically acts on silver iodide.

Although the details of the mechanism of improving the image stability by the silver iodide complexing agent in the embodiment are not clearly resolved, it is considered that the silver iodide complexing agent in the embodiment reacts with at least a part of the photosensitive silver halide upon thermal development to form a complex, whereby the photosensitivity is lowered or lost, and in particular, the image stability under light irradiation is largely improved. Simultaneously, it is a significant characteristic feature that turbidity of the film due to the silver halide is reduced, and as a result, a clear image with high quality can be obtained. The turbidity of the film can be confirmed by reduction in ultraviolet and visible absorption in the spectroabsorption spectrum.

In the embodiment, the ultraviolet and visible absorption spectrum of the photosensitive silver halide can be measured by the transmission method or the reflection method. In the case where absorption ascribed to other compound added to the thermal developing photosensitive material overlaps the absorption of the photosensitive silver halide, the ultraviolet to visible absorption spectrum of the photosensitive silver halide can be observed by such means is solely used or combined as a differential spectrum or removal of the other compound with a solvent.

The silver iodide complexing agent in the embodiment is clearly different from the conventional silver ion complexing agent in such a point that an iodide ion is necessary for forming a stable complex. The conventional silver ion complexing agent exerts solubilizing function on a salt containing a silver ion, such as silver bromide, silver chloride and an organic silver salt, e.g., silver behenate, whereas the silver iodide complexing agent in the embodiment has such a significant feature that it does not function unless silver iodide is present.

Specific compounds of the silver iodide complexing agent in the embodiment may be the same as those compounds that are described in Japanese Patent Application Nos. 2002-367661, 2002-367662 and 2002-367663. The specific examples of the compound disclosed in the specifications of the patent applications are also included in specific examples of the compound of the embodiment.

In the embodiment, in order to improve largely the image stability, particularly the image stability under irradiation of light, the absorption intensity of the ultraviolet and visible absorption spectrum of the photosensitive silver halide after thermal development is 80% or less, more preferably 40% or less, particularly preferably 20% or less, and most preferably 10% or less, as compared to that before thermal development.

The silver iodide complexing agent in the embodiment may be contained in a coating composition in any method, such as a solution form, an emulsion dispersion form and a solid fine particle dispersion form, and the coating composition is contained in the photosensitive material.

Examples of the well known emulsion dispersion method include such a method for producing an emulsion dispersion that the complexing agent is dissolved in an.oil, such as dibutyl phthalate, tricresyl phosphate, glyceryl triacetate and diethyl phthalate, and an auxiliary solvent, such as ethyl acetate and cyclohexanone, and the solution is mechanically dispersed.

(Photosensitive Silver Halide)

(1) Halogen Composition

It is important that the photosensitive silver halide used in the embodiment has a high silver iodide content of from 40 to 100%. The balance is not particularly limited, and can be selected from a silver halide, such as silver chloride and silver bromide, and an organic silver salt, such as silver thiocyanate and silver phosphate, with silver bromide or silver chloride being preferred. By using the silver halide having a high silver iodide content, such a preferred thermal developing photosensitive material can be designed that is excellent in image stability after development, particularly significantly small in increase of fog under irradiation of light.

The silver iodide content is preferably from 70 to 100%, more preferably from 80 to 100%, and further preferably from 90 to 100%, from the standpoint of image stability under irradiation of light after development.

The halogen composition within the particle may be uniform, may be changed stepwise, or may be changed continuously. Silver halide particles having a core/shell structure can also be preferably used. Preferred examples of the structure include 2- to 5-layer structure, and more preferably core/shell particles having a 2- to 4-layer structure may be used. A high silver iodide core structure having a higher silver iodide content in the core and a high silver iodide shell structure having a higher silver iodide content in the shell may be preferably used. Such a technique may also be preferably used that silver chloride or silver bromide is epitaxially grown on the surface of the particles.

The silver iodide in the embodiment may have an arbitrary β phase and γ phase contents. The β phase designates a high silver iodide structure having the hexagonal Wurtzite structure, and the γ phase designates a high silver iodide structure having the cubic zincblende structure. The γ phase content referred herein is determined by the method proposed by C. R. Berry. In this method, the silver iodide β phases (100), (101) and (002) and the γ phase (111) are determined based on the peak ratios by powder X-ray diffraction method, and details thereof are described, for example, in *Physical Review*, vol. 161, No. 3, p. 848-851 (1967).

(2) Particle Size

The silver halide having a high silver iodide content used in the embodiment may have a sufficiently large particle size for attaining high sensitivity. In this embodiment, the average sphere equivalent particle diameter of the silver halide is preferably from 0.3 to 5.0 μm, and more preferably from 0.5 to 3.0 μm. The sphere equivalent particle diameter herein means a diameter of a sphere having the same volume as one particle of the silver halide. As the measuring method therefor, the particle volume is obtained from the projected area and the thickness of the respective particles observed with an electron microscope, and a diameter of a sphere having the same volume as the particle volume is calculated.

(3) Coated Amount

In the case of a thermal developing photosensitive material having a silver halide remaining after thermal development, it is not preferred to increase the coated amount of the silver halide from the standpoint of image quality since the transparency of the film is lowered, and thus the coated amount has been limited to a lower value even through the sensitivity has been demanded to be improved. In the embodiment, however, the haze of the film due to the silver halide can be reduced through the thermal development, and thus the silver halide can be coated in an increased amount. The coated amount in the embodiment is preferably from 0.5 to 100% by mole, and more preferably from 5 to 50% by mole, per 1 mole of the silver of the non-photosensitive organic silver halide.

(4) Method For Forming Particles

The method for forming a photosensitive silver halide has been well known in this field of art, and for example, the methods disclosed in *Research Disclosure*, No. 17029 (June of 1978) and U.S. Pat. No. 3,700,458 can be used. Specifically, such a method may be used that a silver supplying compound and a halogen supplying compound are added to a solution of gelatin or other polymers to prepare a photosensitive silver halide, and then an organic silver salt is then mixed therewith. The methods disclosed in paragraphs 0217 to 0224 of JP-A-11-119347, JP-A-11-352627 and Japanese Patent Application No. 2000-42336 are also preferred.

As the method for forming tabular particles of silver iodide, the methods disclosed in JP-A-59-119350 and JP-A-59-119344 having been described are preferably used.

(5) Particle Shape

Examples of the shape of the silver halide particles in the embodiment include cubic particles, octahedral particles, tetradecahedral particles, dodecahedral particles, tabular particles, spherical particles, virgulate particles and irregular particles. Preferred examples thereof include dodecahedral particles, tetradecahedral particles and tabular particles. The dodecahedral particle referred herein means a particle having the (001), {1(−1)0} and {101} planes, and the tetradecahedral particle referred herein means a particle having the (001), {100} and {101} planes. The {100} and {101} planes referred herein mean crystalline plane groups having plane indices equivalent to the (100) and (101) planes, respectively.

The dodecahedral particles, the tetradecahedral particles and the octahedral particles of a silver halide can be prepared by referring to Japanese Patent Application Nos. 2002-081020, 2002-87955 and 2002-91756.

The tabular particles may have an aspect ratio of 2 or more, and preferably from 2 to 50.

The silver halide having a high silver iodide content in the embodiment may have a complex conformation, and preferred examples of the conformation include joint particles shown in FIG. 1 in R. L. Jenkins, et al., *J. of Phot. Sci.*, vol. 28, p. 164 (1980). Silver halide particles having rounded corners may also be preferably used. The plane index (Miller's index) of the photosensitive silver halide particles is not particularly limited, it is preferred that the proportion of the [100] plane is high, which exhibits a high spectral sensitizing efficiency upon adsorbing a spectral sensitizing dye. The proportion thereof is preferably 50% or more, more preferably 65% or more, and further preferably 80% or more. The Miller's index and the proportion of the [100] plane can be obtained by the method disclosed in T. Tani, *J. Imaging Sci.*, vol. 29, p. 165 (1985) utilizing the adsorption dependency of the [100] plane and the [100] plane upon adsorbing a sensitizing dye.

(6) Heavy Metal

The photosensitive silver halide particles in the embodiment may contain a metal or a metallic complex of from Group 8 to Group 10 in the periodic table (including Groups 1 to 18). The metal or the central metal of the metallic complex of the Group 8 to Group 10 is preferably rhodium, ruthenium or iridium. The metallic complex may be used solely or may be used in combination of two or more complexes containing the same metal or different metals. The content thereof is preferably from $1\times10^{-9}$ to $1\times10^{-3}$ mole per 1 mole of the silver. The heavy metal, the metallic complex and the method of adding them are disclosed in JP-A-7-2254108, paragraphs 0018 to 0024 of JP-A-11-65021 and paragraphs 0227 to 0240 of JP-A-11-119374.

In the embodiment, silver halide particles having a hexacyano metallic complex present on the outermost surface of the particles. Examples of the hexacyano metallic complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the embodiment, a hexacyano Fe complex is preferred.

The hexacyano metallic complex may be added by mixing with water, a mixed solvent of water and a suitable organic solvent miscible with water (such as an alcohol compound, an ether compound, a glycol compound, a ketone compound, an ester compound and an amide compound), or gelatin.

The addition amount of the hexacyano metallic complex is preferably from $1\times10^{-5}$ to $1\times10^{-2}$ mole, and more preferably from $1\times10^{-4}$ to $1\times10^{-3}$ *mole, per* 1 mole of the silver.

In order to make the hexacyano metallic complex present on the outermost surface of the silver halide particles, the hexacyano metallic complex is directly added after completing the addition of the silver nitrate aqueous solution for forming particles but before the chemical sensitizing step for carrying out sulfur sensitization, chalcogen sensitization, such as selenium sensitization and tellurium sensitization, or noble metal sensitization, such as gold sensitization, i.e., before completing the charging step, during the water washing step and the dispersing step, or immediately before the chemical sensitizing step. In order that the silver halide fine particles are not grown, the hexacyano metallic complex is preferably added immediately after forming the particles, and is preferably added before completing the charging step.

The metallic atoms (such as $[Fe(CN)_6]^{4-}$) that may be contained in the silver halide particles of the embodiment and the desalting method and the chemical sensitizing method for the silver halide emulsion are disclosed in paragraphs 0046 to 0050 of JP-A-11-84574, paragraphs 0025 to 0031 of JP-A-11-65021 and paragraphs 0242 to 0250 of JP-A-11-119374.

(7) Gelatin

As the gelatin contained in the photosensitive silver halide emulsion used in the embodiment, various kinds of gelatin may be used. In order to maintain the dispersed state in the organic silver salt-containing coating composition of the photosensitive silver halide emulsion, gelatin having a low molecular weight of from 500 to 60,000 is preferably used. The low molecular weight gelatin may be used upon forming particles or upon dispersing after the desalting step, and is preferably used upon dispersing after the desalting step.

(8) Chemical Sensitization

In the sulfur sensitization, an unstable sulfur compound may be used, such as those disclosed in P. Grafkides, *Chimie et Physique Photographique* (5th edition, published by Paul Momtel (1987)) and *Research Disclosure*, vol. 307, No. 307105.

Specific examples the known sulfur compound that can be used include a thiosulfate salt (such as hypo), a thiourea compound (such as diphenyl thiourea, triethyl thiourea, N-ethyl-N'-(4-methyl-2-thiazolyl) thiourea and carboxymethyl trimethylthiourea), a thioamide compound (such as thioacetamide), a rhodanine compound (such as diethylrhodanine and 5-benzylidene-N-ethylrhodanine), a phosphinesulfide compound (such as trimethylphosphinesulfide), a thiohydantoin compound, a 4-oxo-oxazoline-2-thione compound, a disulfide compound or a polysulfide compound (such as dimorphline disulfide, cystine and lenthionine (1,2,3,5,6-pentathiepane)), a polythiophosphate salt and elemental sulfur, and active gelatin. In particular, a thiosulfate salt, a thiourea compound and a rhodanine compound are preferred.

In the selenium sensitization, an unstable selenium compound may be used, such as those disclosed in JP-B-43-13489, JP-B-44-15748, JP-A-4-25832, JP-A-4-109340, JP-A-4-271341, JP-A-5-40324, JP-A-5-11385, and Japanese Patent Application Nos. 4-202415, 4-3301085, 4-333030, 5-4203, 5-4204, 5-106977, 5-236538, 5-241642 and 5-286916.

Specific examples of the compound that can be used include colloidal metallic selenium, a selenourea compound (such as N,N-dimethylselenourea, trifluoromethylcarbonyltrimethylselenourea and acetyl-trimethylselenourea), a selenoamide compound (such as selenoamide and N,N-diethylphenylselenoamide), a phosphine selenide compound (such as triphenylphosphine selenide and pentafluorophenyltriphenylphosphine selenide), a selenophosphate compound (such as tri-p-tolyl selenophosphate and tri-n-butyl selenophosphate), a selenoketone compound (such as selenobenzophenone), an isoselenocyanate compound, a selenocarboxylic acid compound, a selenoester compound and a diacylselenide compound. An unstable selenium compound disclosed in JP-B-46-4553 and JP-B-52-341082, such as selenious acid, selenocyanic acid, a selenazole compound and a selenide compound, may be used. In particular, a phosphine selenide compound, a selenourea compound and a selenocyanic acid compound are preferred.

In the tellurium sensitization, an unstable tellurium compound may be used, such as those disclosed in JP-A-4-224595, JP-A-4-271341, JP-A-4-333043, JP-A-5-303157, JP-A-6-27573, JP-A-6-175258, JP-A-6-180478, JP-A-6-208186, JP-A-6-208184, JP-A-6-317867, JP-A-7-140579, JP-A-7-301879 and JP-A-7-301880.

Specific examples of the compound that can be used include a phosphine telluride compound (such as butyldiisopropylphosphine telluride, tributylphosphine telluride, tributoxyphosphine telluride and ethoxydiphenylphosphine telluride), a diacyl(di)tellluride compound (such as bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride and bis(ethoxycarbonyl)telluride), a tellurourea compound (such as N,N'-dimethylethylene tellurourea and N,N'-diphenylethylene tellurourea), and a telluroester compound. In particular, a diacyl(di)telluride compound and a phosphine telluride compound are preferred, and particularly the compounds disclosed in paragraph 0030 of JP-A-11-65021 and the compounds represented by the general formulae (II), (III) and (IV) in JP-A-5-313284 are more preferred.

In the chalcogen sensitization in the embodiment, selenium sensitization and tellurium sensitization are preferred, and tellurium sensitization is particularly preferred.

In the gold sensitization, the gold sensitizing agents disclosed in P. Grafkides, *Chimie et Physique Photographique* (5th edition, published by Paul Momtel (1987)) and *Research Disclosure*, vol. 307, No. 307105 may be used. Specific examples thereof include chlorauric acid, potassium chloroaurate, potassium auriothiocyanate, gold sulfide and gold selenide, and in addition, the gold compounds disclosed in U.S. Pat. Nos. 2,642,361, 50,108,484, 50,108,485, 5,169,751 and 5,252,455, and Belgian Patent No. 691,857 may also be used. Furthermore, noble metal salts of platinum, palladium and iridiu.m other than the gold compounds disclosed in P. Grafkides, *Chimie et Physique Photographique* (5th edition, published by Paul Momtel (1987)) and *Research Disclosure,* vol. 307, No. 307105 may also be used.

The gold sensitization may be used solely but is preferably used in combination with the aforementioned chalcogen sensitization. Specific examples thereof include gold-sulfur sensitization, gold-selenium sensitization, gold-tellurium sensitization, gold-sulfur-selenium sensitization, gold-sulfur-tellurium sensitization, gold-selenium-tellurium sensitization and gold-sulfur-selenium-tellurium sensitization.

In the embodiment, the chemical sensitization may be effected in any occasion that is after forming the particles and before coating, and examples thereof include (1) before the spectral sensitization, (2) simultaneous with the spectral sensitization, (3) after the spectral sensitization and (4) immediately before coating.

The using amount of the chalcogen sensitizing agent used in the embodiment varies depending on the silver halide particles used and the chemical aging conditions, and is generally from $10^{-8}$ to $10^{-1}$ mole, and preferably from $10^{-7}$ to $10^{-2}$ mole, per 1 mole of the silver halide.

Similarly, the addition amount of the gold sensitizing agent in the embodiment varies depending on various conditions, and is generally, as a standard, from $10^{-7}$ to $10^{-2}$ mole, and preferably from $10^{-6}$ to $5\times10^{-3}$ mole, per 1 mole of the silver halide. While the environmental conditions for chemically sensitizing the emulsion may be selected from any conditions, as approximate values, the pAg is generally 8 or less, preferably 7.0 or less, more preferably 6.5 or less, and particularly preferably 6.0 or less, and is generally 1.5 or more, preferably 2.0 or more, and particularly preferably 2.5 or more, the pH is generally from 3 to 10, and preferably from 4 to 9, and the temperature is generally from 20 to 95° C., and preferably from 25 to 80° C.

In the embodiment, reduction sensitization may be used in combination with the chalcogen sensitization and the gold sensitization, and preferably used in combination with the chalcogen sensitization. Preferred specific examples of a compound used in the reduction sensitization method include ascorbic acid, thiourea dioxide and dimethylamineborane, and in addition to these, stannous chloride, aminoiminomethanesulfonic acid, a hydrazine derivative, a borane compound, a silane compound and a polyamine compound may be preferably used. The reduction sensitizing agent may be added in any step in the preparation process from crystal growth to immediately before coating. The reduction sensitization is also preferably effected by aging the emulsion by maintaining the pH thereof at 8 or more, or maintaining the pAg thereof 4 or less. It is also preferred that the reduction sensitization is effected by introducing a single addition part of silver ion during the formation of particles.

The addition amount of the reduction sensitizing agent varies depending on the various conditions, and is generally from $10^{-7}$ to $10^{-1}$ mole, and preferably from $10^{-6}$ to $5\times10^{-2}$ mole, per 1 mole of the silver halide.

The silver halide emulsion used in the invention may contain a thiosulfonic acid compound by the method disclosed in EP-A 293,917.

The photosensitive silver halide particles in the embodiment is preferably chemically sensitized by at least one method of the gold sensitization and the chalcogen sensitization from the standpoint of obtaining a thermal developing photosensitive material having high sensitivity.

(9) Compound Forming One-electron Oxidant Formed Through One-electron Oxidation, the One-electron Oxidant Capable of Releasing One Or More Electrons The thermal developing photosensitive material in the embodiment preferably contains a compound, a one-electron oxidant of which formed through one-electron oxidation is capable of releasing one or more electrons. The compound is used solely or used in combination with the various kinds of chemical sensitizing agent described hereinabove to increase the sensitivity of the silver halide.

The compound forming a one-electron oxidant through one-electron oxidation, the one-electron oxidant being capable of releasing one or more electrons in the embodiment is a compound selected from the following compounds of types 1 to 5.

(Type 1)

A one-electron oxidant of a compound formed through one-electron oxidation is capable of two or more electrons associated with a subsequent bond cleavage reaction.

(Type 2)

A one-electron oxidant of a compound formed through one-electron oxidation is capable of releasing further one electron associated with a subsequent bond cleavage reaction, and the compound has two or more adsorbing groups to silver halide within one molecule.

(Type 3)

A one-electron oxidant of a compound formed through one-electron oxidation is capable of releasing one or more electrons after a subsequent bond forming step.

(Type 4)

A one-electron oxidant of a compound formed through one-electron oxidation is capable of one or more electrons after a subsequent intramolecular bond cleavage reaction.

(Type 5)

A compound represented by X-Y, wherein Y represents a releasing group, and X represents a reducing group, and a one-electron oxidant of the compound formed through one electron oxidation of the reducing group represented by X forms an X radical through release of Y associated with a cleavage reaction of the X-Y bond, and is then capable of releasing further one electron.

Among the compounds of the aforementioned Type 1 and Types 3 to 5, preferred compounds include the compound having adsorbing groups to silver halide in the molecule thereof and the compound having a partial structure of a spectral sensitizing dye in the molecule thereof, and more preferably the compound having adsorbing groups to silver halide in the molecule thereof. More preferred examples of the compounds of Types 1 to 4 include a compound having, as the absorbing group, a nitrogen-containing heterocyclic group substituted with two or more mercapto groups.

The compounds of Types 1 to 4 are the same compounds described in detail in JP-A-2003-114487, JP-A-2003-114486, JP-A-2003-140287, JP-A-2003-75950 and JP-A-2003-114488, respectively. The specific examples of the compounds disclosed in these publications are also included in specific examples of the compound of Types 1 to 4 of the embodiment. Synthesis examples of the compounds of Types 1 to 4 of the embodiment are the same as those disclosed in the publications.

Specific examples of the compounds of Type 5 of the embodiment further include compounds referred to as a one-photon and two-electron sensitizing agent or a deprotonating electron donating sensitizing agent disclosed in JP-A-9-211769 (Compounds PMT-1 to S-37 disclosed in Tables E and F on pages 28 to 32), JP-A-9-211774, JP-A-11-95355 (Compounds INV1 to 36), JP-A-2001-500996 (Compounds 1 to 74, 80 to 87 and 92 to 122), U.S. Pat. No. 5,774,235, U.S. Pat. No. 5,747,236, European Patent No. 786,692A1 (Compound INV1 to 35), European Patent No. 893,732A1, U.S. Pat. No. 6,054,260 and U.S. Pat. No. 5,994,051.

The compound of Types 1 to 5 in the embodiment may be used in any occasion during preparation of the photosensitive silver halide emulsion and production of the thermal developing photosensitive material. For example, the compound may be added in the step of forming the photosensitive silver halide particles, the desalting step, the chemical sensitizing step, and a step before coating. The compound may also be added by dividing into plural occasions in these steps. The occasion of addition is preferably after completing the formation of the photosensitive silver halide particles and before the desalting step, upon the chemical sensitization (immediately before starting the chemical sensitization and immediately after completing the same), and before coating, and is more preferably from upon the chemical sensitization until before mixing with the non-photosensitive organic silver salt.

The compound of Types 1 to 5 in the embodiment is preferably added after dissolving in water, a solvent miscible with water, such as methanol and ethanol, or a mixture thereof. In the case where the compound is dissolved in water, the pH thereof may be increased or decreased upon dissolving for such a compound that is increased in solubility upon increasing or decreasing the pH.

The compound of Types 1 to 5 in the embodiment is preferably added to an emulsion layer containing the photosensitive silver halide and the non-photosensitive organic silver salt, and it is possible the compound is added to a protective layer or an intermediate layer in addition to the emulsion layer containing the photosensitive silver halide and the non-photosensitive organic silver salt, and the compound is diffused upon coating. The occasion of adding the compound in the embodiment may be before or after the sensitizing dye, and the compound is preferably added to the silver halide emulsion layer in an amount of from $1\times10^{-9}$ to $5\times10^{-1}$ mole, and more preferably from $1\times10^{-8}$ to $5\times10^{-2}$ mole, per 1 mole of the silver halide.

(10) Adsorbing Redox Compound Having Adsorbing Group And Reducing Group

In the embodiment, an adsorbing redox compound having an adsorbing group to silver halide and a reducing group in the molecule thereof is preferably contained. The absorbing redox compound is preferably a compound represented by the following formula (I).

$$A-(W)_n-B \quad (I)$$

wherein A represents a group capable of being adsorbed to silver halide (hereinafter, referred to as an adsorbing group), W represents a divalent linking group, n represents 0 or 1, and B represents a reducing group.

In the formula (I), the adsorbing group represented by A may be a group directly adsorbed to silver halide or a group accelerating adsorption to silver halide, and specific examples thereof include a mercapto group (or a salt thereof), a thione group (—C(═S)—), a heterocyclic group containing at least one atom selected from a nitrogen atom, a sulfur atom, a selenium atom and tellurium atom, a sulfide group, a disulfide group, a cationic group and an ethynyl group.

The mercapto group (or a salt thereof) as the adsorbing group means a mercapto group (or a salt thereof) itself, and simultaneously it preferably means a heterocyclic group, an aryl group or an alkyl group substituted with at least one mercapto group (or a salt thereof). Examples of the heterocyclic herein group include a 5- to 7-membered, monocyclic or condensed ring, aromatic or non-aroniatic heterocyclic group, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group and a triazine ring group. The adsorbing group may be a heterocyclic group containing a quaternerized nitrogen atom, and in this case, the substituted mercapto group may be dissociated to form a mesoion. In the case where the mercapto group forms a salt, examples of the counter ion include a cation of an alkali metal, an alkaline earth metal, a heavy metal or the like (such as $Li^+$, $Na^+$, $K^+$, $Mg^{2+}$, $Ag^+$ and $Zn^{2+}$), an ammonium ion, a heterocyclic group containing a quaternarized nitrogen atom and a phosphonium ion.

The mercapto group as the adsorbing group may be a thione group through tautomerization.

The thione group as the adsorbing group includes a thioamide group, a thioureido group, a thiourethane group and a thiocarbamate ester group, which may have a linear or cyclic structure.

The heterocyclic group containing at least one atom selected from a nitrogen atom, a sulfur atom, a selenium atom and a tellurium atom as the adsorbing group is a nitrogen-containing heterocyclic group having an —NH— group capable of forming imino silver (>NAg) as a partial structure of the hetero ring, or a heterocyclic group having an —S— group, an —Se— group, a —Te— group or an ═N— group capable of coordinating to a silver ion as a partial structure of the hetero ring. Examples of the former heterocyclic group include a benzotriazole group, a triazole group, an indazole group, a pyrazole group, a tetrazole group, a benzoimidazole group, an imidazole group and purine group, and examples of the later heterocyclic group include a thiophene group, a thiazole group, an oxazole group, a benzothiophene group, a benzothiazole group, a benzoxazole group, a thiadizaole group, an oxadiazole group, a triazine group, a selenoazole group, a benzoselenoazole group, a tellurazole group and a benzotellurazole group.

The sulfide group and the disulfide group as the adsorbing group include all the groups having an —S— or —S—S— partial structure.

The cationic group as the adsorbing group means a group containing a quaternarized nitrogen atom, and specifically a group containing an ammonio group or a nitrogen-containing heterocyclic group containing a quaternarized nitrogen atom. Examples of the nitrogen-containing heterocyclic group containing a quaternarized nitrogen atom include a pyridinio group, a quinolinio group, an isoquinolinio group and an imidazolio group.

The ethynyl group as the adsorbing group means a —C≡CH group, and the hydrogen atom may be substituted.

The aforementioned adsorbing groups may have an arbitrary substituent.

Specific examples of the adsorbing group further include those disclosed in pages 4 to 7 of JP-A-11-95355.

Preferred examples of the adsorbing group represented by A in the formula (I) include a mercapto-substituted heterocyclic group (such as a 2-mercaptothiadizaole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptpyrimidine group, a 2,4-dimercaptotriazine group, a 3,5-dimercapto-1,2,4-triazole group and a 2,5-dimercapto-1,3-thiazole group), and a nitrogen-containing heterocyclic group having an —NH— group capable of forming imino silver (>NAg) as a partial structure of the hetero ring (such as a benzotriazole group, a benzimidazole group and an indazole group), and more preferred examples of the adsorbing group include a 2-mercaptobenzimidazole group and a 3,5-dimercapto-1,2,4-triazole group.

In the formula (I), W represents a divalent linking group. The linking group may be an arbitrary group as far as it does not adversely affect the photographic property. Examples thereof include divalent linking groups constituted by a carbon atom, a hydrogen atom, an oxygen atom, a nitrogen atom and a sulfur atom. Specific examples thereof include an alkylene group having from 1 to 20 carbon atoms (such as a methylene group, an ethylene group, a trimethylene group, a tetramethylene group and a hexamethylene group), an alkenylene group having from 2 to 20 carbon atoms, an alkynylene group having from 2 to 20 carbon atoms, an arylene group having from 6 to 20 carbon atoms (such as a phenylene group and a naphthylene group), —CO—, —$SO_2$—, —O—, —S—, —NR1—, and combinations of these linking groups, wherein R1 represents a hydrogen atom, an alkyl group, a heterocyclic group or an aryl group.

The linking group represented by W may have an arbitrary substituent.

The reducing group represented by B in the formula (I) means a group capable of reducing a silver ion, and examples thereof include a formyl group, an amino group, a triple bond group, such as an acetylene group and a propagyl group, a mercapto group, and a compound obtained by removing one hydrogen atom from such a compound as a hydroxylamine compound, a hydroxamic acid compound, a hydroxyurea compound, a hydroxyurethane compound, a hydroxysemicarbazide compound, a reductone compound (including a reductone derivative), an aniline compound, a phenol compound (including a chroman-6-ol compound, a 2,3-dihydrobenzofuran-5-ol compound, an aminophenol compound, a sulfonamidephenol compound, and a polyphenol compound, such as a hydroquinone compound, a catechol compound, a resorcinol compound, a benzenetriol compound and a bisphenol compound), an acylhydrazine compound, a carbamoylhydrazine compound and a 3-pyrazolidone compound. These groups may have an arbitrary substituent.

The oxidation potential of the reducing group represented by B in the formula (I) can be measured by the measuring method disclosed in A. Fujishima "Denki Kagaku Sokuteihou" (Electrochemical Measuring Methods), p. 150-208, published by Gihodo Shuppan Co., Ltd. and "Jikken Kagaku Kouza" (Lectures on Experimental Chemistry) 4th edition, edited by The Chemical Society of Japan, vol. 9, p. 282-344, published by Maruzen Co., Ltd. For example, the technique of rotation disk voltammetry may be used. Specifically, a sample is dissolved in a solution of methanol and Britton-Robinson buffer solution (pH 6.5) (10/90 by volume), and after passing nitrogen gas thereto for 10 minutes, the measurement is carried out by using a rotation disk electrode (RDE) formed of glassy carbon as a working electrode, a platinum wire as a counter electrode, and a saturated calomel electrode as a reference electrode, at 25° C. and 1,000 rpm and at a sweeping speed of 20 mV/sec. The half-wave potential (E½) can be obtained from the voltamograph thus obtained.

In the case of measuring the aforementioned measuring method, the reducing group represented by B in the embodiment preferably has an oxidation potential of about from −0.3 to 1.0 V, more preferably about from −0.1 to 0.8 V, and particularly preferably about from 0 to 0.7 V.

Preferred examples of the reducing group represented by B in the formula (I) include residual groups obtained removing one hydrogen atom from such compounds as a hydroxylamine compound, a hydroxamic acid compound, a hydroxyurea compound, a hydroxysemicarbazide compound, a reductone compound, a phenol compound, an acylhydrazine compound, a carbamoylhydrazine compound and a 3-pyrazolidone compound.

Specific examples of the reducing group represented by B will be described below, but the invention is not limited to them. The symbol * in the following indicates the position for connecting to A or W in the formula (I).

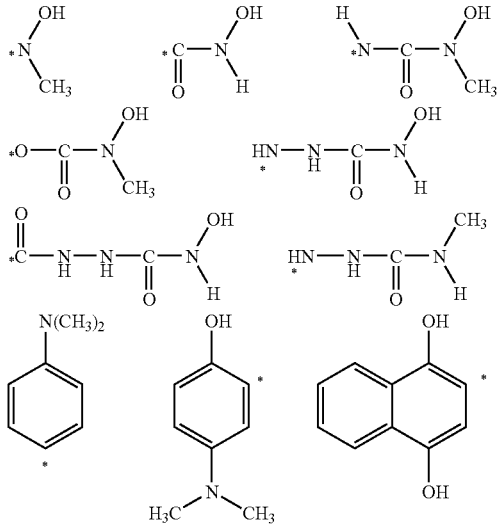

-continued

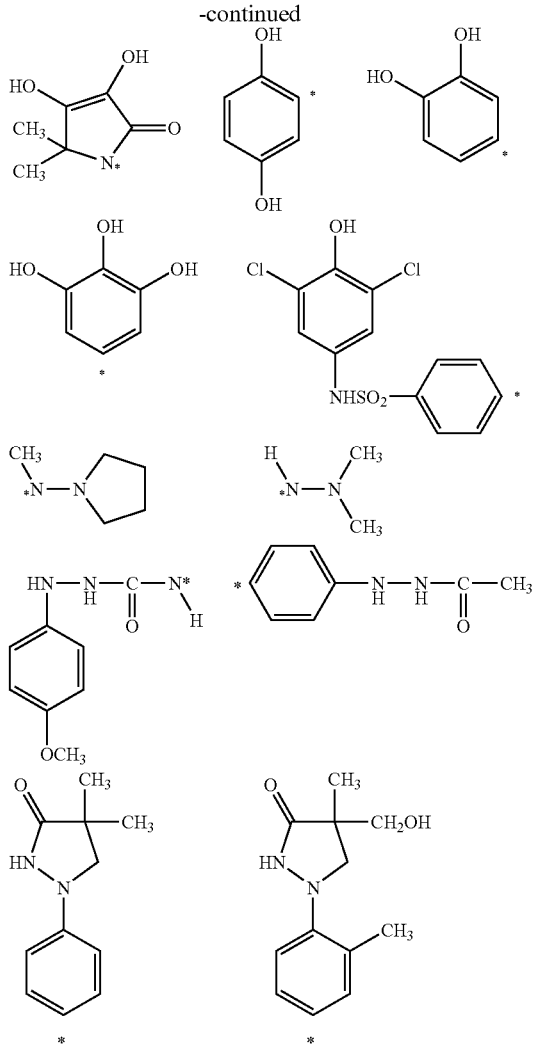

The compound represented by the formula (I) in the embodiment preferably contains a ballast group or a polymer chain that is generally used in an immobilized photographic additive, such as a coupler, incorporated therein. Examples of the polymer include those disclosed in JP-A-1-100530.

The compound represented by the formula (I) of the embodiment may be a bis body or a tris body. The compound represented by the formula (I) of the embodiment preferably has a molecular weight of from 100 to 10,000, more preferably from 120 to 1,000, and particularly preferably from 150 to 500.

The adsorbing redox compound having an adsorbing group to silver halide and a reducing group in the molecule thereof is the same as the compound described in detail in Japanese Patent Application Nos. 2002-328531 and 2002-379884. The examples of the adsorbing redox compound having an adsorbing group to silver halide and a reducing group in the molecule thereof disclosed in these publications are also included in the specific examples of the compound in the embodiment.

The compound represented by the formula (I) in the embodiment can be easily synthesized according to the known method.

The compound represented by the formula (I) in the embodiment may be used solely and is preferably in combination of two or more kinds thereof simultaneously. In the case where two or more kinds of the compounds are used, these compounds may be added to the same layer or to different layers, respectively, and they may be added by different methods, respectively.

The compound represented by the formula (I) in the embodiment is preferably added to a silver halide emulsion layer, and more preferably added upon preparing the emulsion. In the case of adding upon preparing the emulsion, the compound may be added in any occasion during the preparation process, and examples of the occasion include on the step of forming silver halide particles, before starting the desalting step, on the desalting step, before starting the chemical aging, on the chemical aging step, and before preparing the final emulsion. The compound may be added as divided into plural times in the steps. The compound is preferably added to the emulsion layer, and it is possible that the compound is added to a protective layer or an intermediate layer adjacent to the emulsion layer in addition to the emulsion layer, and the compound is diffused upon coating.

The preferred addition amount thereof largely depends on the addition method and the species of compound added, and in general the addition amount is from $1\times10^{-6}$ to 1 mole, preferably from $1\times10^{-5}$ to $5\times10^{-1}$ mole, and more preferably from $1\times10^{-4}$ to $1\times10^{-1}$ mole, per 1 mole of the silver halide.

The compound represented by the formula (I) in the embodiment may be added after dissolving in water, a solvent miscible with water, such as methanol and ethanol, or a mixture thereof. Upon dissolving, the pH may be properly adjusted with an acid or a base, and a surface active agent may be used in combination. The compound may also be added as emulsion dispersion after dissolving in a high boiling point solvent. The compound may also be added as a solid dispersion.

(11) Sensitizing Dye

The sensitizing dye that can be used in the embodiment can spectrally sensitizing silver halide in a desired wavelength range upon adsorbing on the silver halide particles, and such a sensitizing dye can be favorably selected that has a spectral sensitivity suitable for the spectral characteristics of the exposure light source. It is preferred that the thermal developing photosensitive material in the embodiment is spectrally sensitized to have a spectral sensitivity peak in a range of from 600 to 900 nm or a range of from 300 to 500 nm. The sensitizing dye and the addition method therefor are disclosed in paragraphs 0103 to 0109 of JP-A-11-65021, the compound represented .by the general formula (II) in JP-A-10-186572, the dye represented by the general formula (I) and paragraph 0106 in JP-A-11-110374, U.S. Pat. No. 5,510,236, the dyes disclosed in Example 5 of U.S. Pat. No. 3,871,887, JP-A-2-96131, the dyes disclosed in JP-A-59-48753, and Japanese Patent Application Nos. 2000-86865, 2000-102560 and 2000-205399. The sensitizing dye may be used solely or in combination of two or more thereof.

The addition amount of the sensitizing dye in the embodiment may be a desired amount corresponding to the performance in sensitivity and fogging, and is preferably from $10^{-6}$ to 1 mole, and more preferably from $10^{-4}$ to $10^{-1}$ mole, per 1 mole of the silver halide in the photosensitive layer.

In order to improve the spectral sensitization efficiency in the embodiment, a chromatic sensitizing agent may be used. Examples of the chromatic sensitizing agent used in the embodiment include the compounds disclosed in European Patent No. 587,338, U.S. Pat. Nos. 3,877,943 and 4,873,184, JP-A-5-341432, JP-A-11-109547 and JP-A-10-111543.

(12) Combination Use of Silver Halide

The photosensitive silver halide emulsion in the thermal developing photosensitive material used in the embodiment may be used solely or in combination of two or more kinds thereof (for example, those having different average particle sizes, those having different halogen compositions, those having different crystal habits, and those having been chemically sensitized under different conditions). The gradation can be adjusted by using plural kinds of photosensitive silver halides having different sensitivities. Examples of the technique therefor include those disclosed in JP-A-57-110341, JP-A-53-106125, JP-A-47-3929, JP-A-48-55730, JP-A-46-5187, JP-A-50-73627 and JP-A-57-150841. The difference in sensitivity between the emulsions is preferably 0.2logE or more.

(13) Mixing of Silver Halide And Organic Silver Salt

The photosensitive silver halide particles in the embodiment are particularly preferably formed in the absence of the non-photosensitive organic silver salt, and then chemically sensitized. This is because there are some case where the sufficient sensitivity cannot be obtained by such a method that the silver halide is formed by adding a halogenating agent to an organic silver salt.

Examples of the method of mixing the silver halide and the organic silver salt include a method of mixing the photosensitive silver halide and the organic silver salt, which have been separately prepared, in a high-speed stirrer, a ball mill, a sand mill, a colloid mill, a vibration mill, a homogenizer or the like, and a method of mixing the completed photosensitive silver halide at any occasion during the preparation of the organic silver salt, so as to prepare the organic silver salt. The effect of the embodiment can be favorably obtained by any of the methods.

(14) Mixing of Silver Halide To Coating Composition

The preferred occasion of adding the silver halide to the coating composition for forming the image forming layer is 180 minutes before coating to immediately before coating, and more preferably 60 minutes before coating to 10 seconds before coating. The mixing method and the mixing conditions are not particularly limited as far as the effect of the embodiment can be sufficiently exerted. Specific examples of the mixing method include a method of mixing in a tank in such a manner that the average retention time calculated from the addition flow amount and the feeding amount to the coater becomes a desired time, and a method of using a static mixer disclosed in N. Harnby, M. F. Edwards and A. W. Nienow, "Ekitai Kongo Gijutu" (Liquid Mixing Techniques), translated by K. Takahashi, Chapter 8, published by Nikkan Kogyo Shimbun, Ltd. (1989).

Organic Silver Salt

The non-photosensitive organic silver salt used in the embodiment is such a silver salt that is relatively stable to light but forms a silver image upon being heated to 80° C. or higher in the presence of an exposed photosensitive silver salt and a reducing agent. The organic silver salt may be an arbitrary organic substance containing a source capable of reducing a silver ion. The non-photosensitive organic silver salt is disclosed in paragraphs 0048 to 0108 of JP-A-10-62899, page 18, line 24 to page 19, line 37 of EP-A 0,803,764A1, EP-A 0,962,812A1, JP-A-11-3108591, JP-A-2000-7683 and JP-A-2000-72711. The organic silver salt is preferably a silver salt of an organic acid, and particularly preferably a silver salt of a long-chain aliphatic carboxylic acid (preferably having from 10 to 30 carbon atoms, and more preferably from 15 to 28 carbon atoms). Preferred examples of the organic silver salt include silver behenate, silver arachidinate, silver stearate, silver oleate, silver laurate, silver caproate, silver myristate, silver palmitate and mixtures thereof. In the embodiment, an organic silver salt having a content of silver behenate of from 50 to 100% by mole is preferably used. It is particularly preferred that the silver behenate content is from 75 to 98% by mole.

The shape of the organic silver salt that can be used in the embodiment is not particularly limited and may be acicular, virgulate, tabular or squamous.

In the embodiment, a squamous organic silver salt is preferred. The squamous organic silver salt referred herein can be defined as follows. The organic silver salt is observed with an electron microscope, and the shape of the organic silver salt particles is approximated by a rectangular parallelepiped. Assuming that edges of the rectangular parallelepiped are referred to as a, b and c in the order from the shorter one to the longer one (provided that c may have the same length as b), x is calculated from the shorter two values a and b according to the following equation.

$$x=b/a$$

The value x is thus obtained for about 200 particles, and assuming that the average value thereof is referred to as x(average), an organic silver salt satisfying the relationship x(average)≧1.5 is designated as being squamous. It is preferred that 30≧x(average)≧1.5, and more preferably 15≧x (average)≧1.5. In the acicular shape, 1≦x(average)<1.5.

In the squamous particles, the value a can be considered as the thickness of the tabular particle having a plane with edges b and c as the major plane. The average value of a is preferably from 0.01 to 0.3 μm, more preferably from 0.1 to 0.23 μm. The average value of c/b is preferably from 1 to 6, more preferably from 1 to 4, further preferably from 1 to 3, and particularly preferably from 1 to 2.

The particle size distribution of the organic silver salt is preferably monodisperse. The term monodisperse herein means that values obtained by dividing the standard deviations of the minor axis and the major axis by the minor axis and the major axis, respectively, in terms of percentage are preferably 100% or less, more preferably 80% or less, and further preferably 50% or less. The shape of the organic silver salt can be measured by observing a transmission electron micrograph of the organic silver salt dispersion. As another method of measuring the monodisperse nature, such a method may be used that the monodisperse nature is determined from the standard deviation of the volume weighted average diameter of the organic silver salt, in which the value obtained by dividing by the volume weighted average diameter in terms of percentage (variation coefficient) is preferably 100% or less, more preferably 80% or less, and further preferably 50% or less. As the measuring method therefor, the organic silver salt is irradiated with laser light, and an autocorrelation function of the fluctuation of the scattered light with respect to time change is obtained to provide the particle size (volume weighted average diameter).

The production process and the dispersion method of the organic silver salt used in the embodiment may be the known methods described, for example, in JP-A-10-62899, EP-A 0,803,764A1, EP-A 0,962,812A1, JP-A-11-3108591, JP-A-2000-7683, JP-A-2000-72711, JP-A-2001-163827, JP-A-2001-163889, JP-A-2001-163890, JP-A-11-203413, and Japanese Patent Application Nos. 2000-90093, 2000-195621, 2000-191226, 2000-213813, 2000-214155 and 2000-191226.

In the embodiment, the photosensitive material can be produced by mixing an aqueous dispersion liquid of the organic silver salt and an aqueous dispersion liquid of the photosensitive silver halide. It is preferred upon mixing that two or more kinds of the organic silver salt aqueous dispersion liquids and two or more kinds of the photosensitive silver halide aqueous dispersion liquids are mixed for adjusting the photographic characteristics.

The amount of the organic silver salt in the embodiment may be any desired amount and is preferably from 0.1 to 5 $g/m^2$, more preferably from 1 t 3 $g/m^2$, and particularly preferably from 1.2 to 2.5 $g/m^2$, in terms of silver amount.

Reducing Agent

The thermal developing photosensitive material of the embodiment contains a reducing agent for the organic silver salt. The reducing agent may be an arbitrary substance (preferably an organic substance) that can reduce a silver ion to metallic silver. Examples of the reducing agent are disclosed in paragraphs 0043 to 0045 of JP-A-11-65021, and page 7, line 34 to page 18, line 12 of European Patent No. 0,803,764.

Preferred examples of the reducing agent used in the embodiment include a hindered phenol reducing agent having a substituent at the ortho-position of the phenolic hydroxyl group and a bisphenol reducing agent. A compound represented by the following general formula (R) is preferred.

(R)

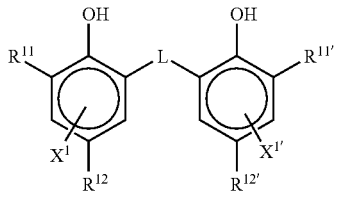

In the general formula (R), R11 and R11' each independently represents an alkyl group having from 1 to 20 carbon atoms. R12 and R12' each independently represents a hydrogen atom or a substituent capable of being substituted on the benzene ring. L represents an —S— group or a —CHR13— group. R13 represents a hydrogen atom or an alkyl group having from 1 to 20 carbon atoms. X1 and X1' each independently represents a hydrogen atom or a group capable of being substituted on the benzene ring.

The substituents will be described in detail below.

(1) R11 and R11'

R11 and R11' each independently represents a substituted or unsubstituted alkyl group having from 1 to 20 carbon atoms. The substituent on the alkyl group is not particularly limited, and preferred examples thereof include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group and a halogen atom.

(2) R12 and R12', and X1 and X1'

R12 and R12' each independently represents a hydrogen atom or a group capable of being substituted on the benzene ring.

X1 and X1' each independently represents a hydrogen atom or a group capable of being substituted on the benzene ring. Examples of the group capable of being substituted on the benzene ring include an alkyl group, an aryl group, a halogen atom, an alkoxy group and an acylamino group.

(3) L

L represents an —S— group or a —CHR13— group. R13 represents a hydrogen atom or an alkyl group having from 1 to 20 carbon atoms, and the alkyl group may have a substituent.

Specific examples of the unsubstituted alkyl group represented by R13 include a methyl group, an ethyl group, a propyl group, a butyl group, a heptyl group, an undecyl group, an isopropyl group, a 1-ethylpentyl group and a 2,4,4-trimethylpentyl group.

Examples of the substituent on the alkyl group may be the same as those of the substituent of R11 and include a halogen atom, an alkoxy group, an alkylthio group, an aryloxy group, an arylthio group, an acylamino group, a sulfonamide group, a sulfonyl group, a phosphoril group, an oxycarbonyl group, a carbamoyl group and a sulfamoyl group.

(4) Preferred Substituents

R11 and R11' each is preferably a secondary or tertiary alkyl group having from 3 to 15 carbon atoms, and examples thereof include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. R11 and R11' each is more preferably a tertiary alkyl group having from 4 to 12 carbon atoms, and among these, a t-butyl group, a t-amyl group and a 1-methylcyclohexyl group are preferred, with a t-butyl group being most preferred.

R12 and R12' each is preferably an alkyl group having from 1 to 20 carbon atoms, and example thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group, and more preferably a methyl group, an ethyl group, a propyl group, an isopropyl group and t-butyl group.

X1 and X1' each is preferably a hydrogen atom, a halogen atom or an alkyl group, and is more preferably a hydrogen atom.

L is preferably a —CHR13— group.

R13 is preferably a hydrogen atom or an alkyl group having from 1 to 15 carbon atoms, and preferred examples of the alkyl group include a methyl group, an ethyl group, a propyl group, an isopropyl group and a 2,4,4-trimethylpentyl group. R13 is particularly preferably a hydrogen atom, a methyl group, an ethyl group or an isopropyl group.

In the case where R13 is a hydrogen atom, R12 and R12' each is preferably an alkyl group having from 2 to 5 carbon atoms, preferably an ethyl group or a propyl group, and most preferably an ethyl group.

In the case where R13 is a primary or secondary alkyl group having from 1 to 8 carbon atoms, R12 and R12' each is preferably a methyl group. Preferred examples of the primary or secondary alkyl group having from 1 to 8 carbon atoms represented by R13 include a methyl group, an ethyl group, a propyl group and an isopropyl group, and more preferably a methyl group, an ethyl group and a propyl group.

In the case where all R11, R11', R12 and R12' are methyl groups, R13 is preferably a secondary alkyl group. In this case, preferred examples of the secondary alkyl group represented by R13 include an isopropyl group, an isobutyl group and a 1-ethylpentyl group, and more preferably an isopropyl group.

The reducing agent varies in thermal developing capability depending on combinations of R11, R11', R12, R12' and R13. Since the thermal developing capability can be adjusted by using two or more kinds of the reducing agents in combination with various mixing proportions, it is preferred to use two or more kinds of the reducing agent in combination depending on purposes.

Specific examples of the compound represented by the general formula (R) in the embodiment will be described below, but the embodiment is not limited to them.

(R-1)

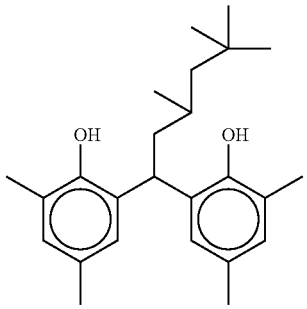

(R-2)

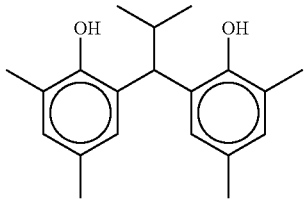

(R-3)

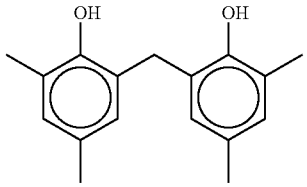

(R-4)

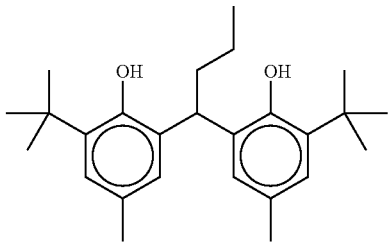

(R-5)

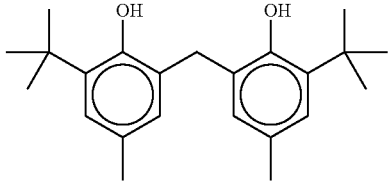

-continued
(R-6)
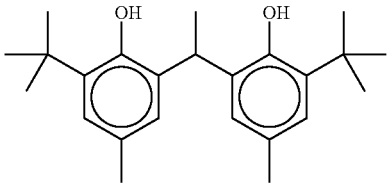
(R-7)
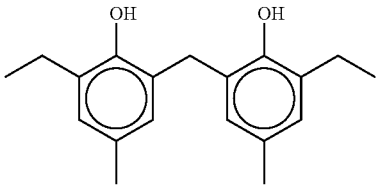
(R-8)
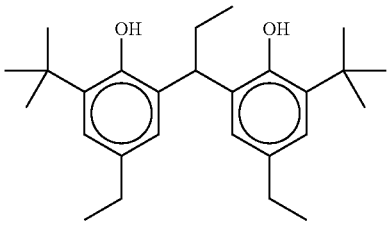
(R-9)
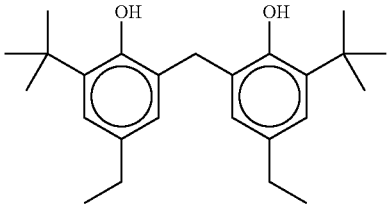
(R-10)
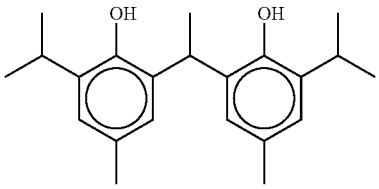
(R-11)
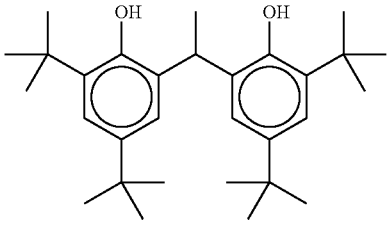
(R-12)
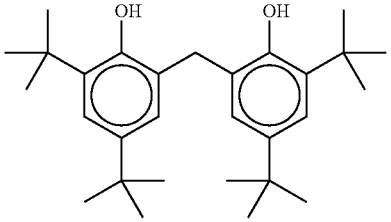
-continued
(R-13)
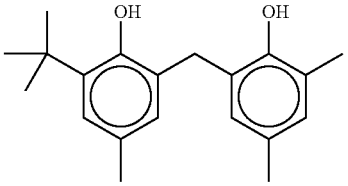
(R-14)
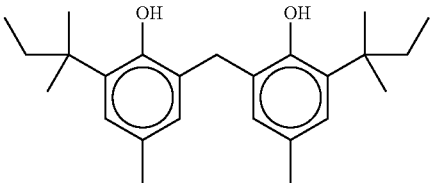
(R-15)
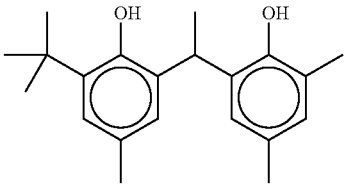
(R-16)
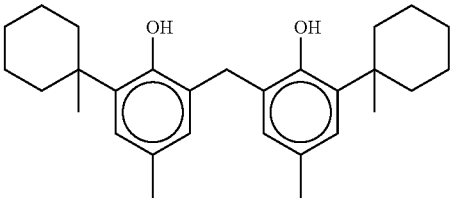
(R-17)
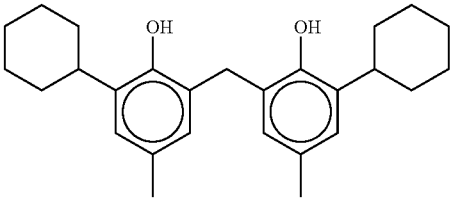
(R-18)
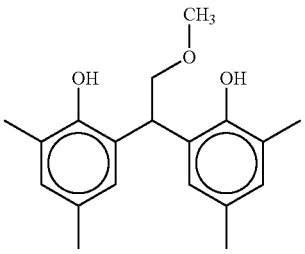

-continued
(R-19)
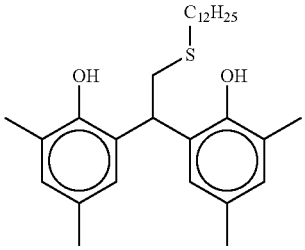
(R-20)
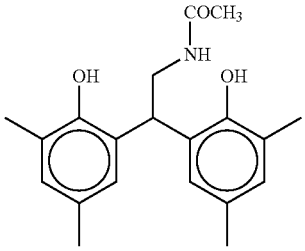
(R-21)
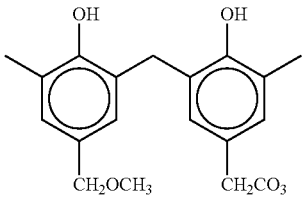
(R-22)
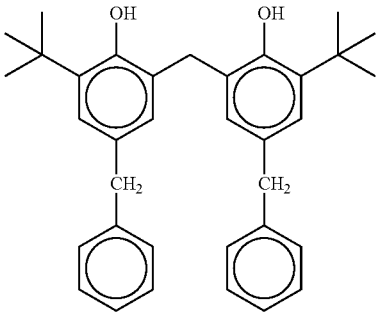
(R-23)
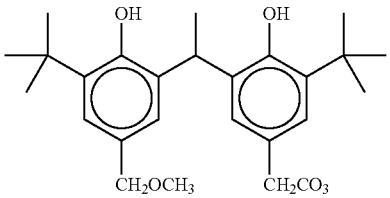
(R-24)
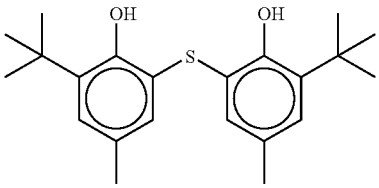
-continued
(R-25)
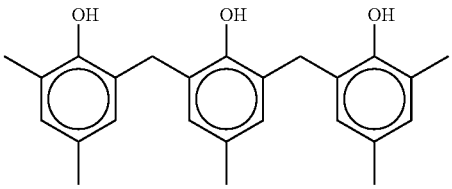
(R-26)
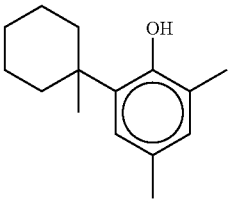
(R-27)
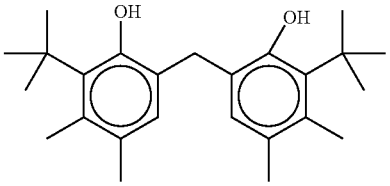
(R-28)
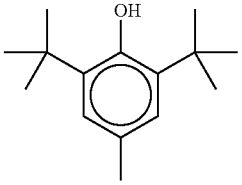
(R-29)
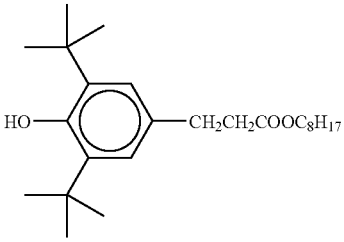
(R-30)
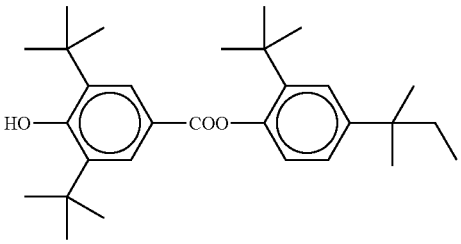

-continued (R-31)

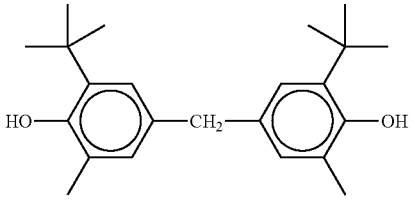

(R-32)

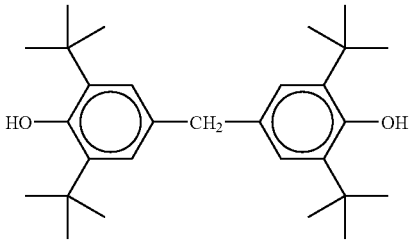

(R-33)

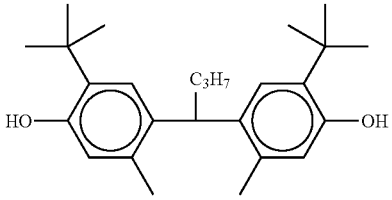

(R-34)

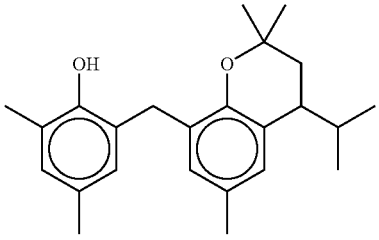

In particular, the compounds (R-1) to (R-20) are preferred.

The addition amount of the reducing agent in the embodiment is preferably from 0.01 to 5.0 g/m$^2$, and more preferably from 0.1 to 3.0 g/m$^2$, and is preferably from 1 t 50% by mole, and more preferably from 10 to 40% by mole, per 1 mole of the silver present on the surface having the image forming layer.

The reducing agent in the embodiment may be added to the image forming layer containing the organic silver salt and the photosensitive silver halide, and layers adjacent thereto, and it is preferably added to the image forming layer.

The reducing agent in the embodiment may be contained in a coating composition in any method, such as a solution form, an emulsion dispersion form and a solid fine particle dispersion form, and the coating composition is contained in the photosensitive material.

Examples of the well known emulsion dispersion method include such a method for producing an emulsion dispersion that the reducing agent is dissolved in an oil, such as dibutyl phthalate, tricresyl phosphate, glyceryl triacetate and diethyl phthalate, and an auxiliary solvent, such as ethyl acetate and cyclohexanone, and the solution is mechanically dispersed.

Examples of the solid fine particle dispersion method include such a method that the reducing agent is dispersed in a suitable solvent, such as water, with a ball mill, a colloid mill, a vibration ball mill, a sand mill, a jet mill, a roller mill or ultrasonic. vibration, so as to form a solid dispersion. A dispersion method using a sand mill is preferred. Protective colloid (such as polyvinyl alcohol) and a surface active agent (such as an anionic surface active agent, e.g., sodium triisopropylnaphthalenesulfonate (a mixture of three compounds having different substitution positions for an isopropyl group) may be used. The aqueous dispersion may contain an antiseptic (such as a benzoisothiazolinone sodium salt).

It is particularly preferred that the reducing agent is dispersed by the solid particle dispersion method, and is preferably added in the form of fine particles having an average particle size of from 0.01 to 10 μm, preferably from 0.05 to 5 μm, and more preferably from 0.1 to 1 μm. In the embodiment, the other solid dispersions are also preferably used after dispersing to a particle size in the aforementioned range.

(Development Accelerating Agent)

In the thermal developing photosensitive material of the embodiment, the sulfonamidephenol compound represented by the general formula (A) in JP-A-2000-267222 and JP-A-2000-330234, the hindered phenol compound represented by the general formula (II) in JP-A-2001-92075, the hydrazine compound represented by the general formula (I) in JP-A-10-62895 and JP-A-11-15116 and the general formula (1) in Japanese Patent Application No. 2001-074278, and the phenol or naphthol compound represented by the general formula (2) in Japanese Patent Application No. 2000-76240 are preferably used as a development accelerating agent. The development accelerating agent is generally used in an amount of from 0.1 to 20% by mole, preferably from 0.5 to 10% by mole, and more preferably from 1 to 5% by mole, based on the amount of the reducing agent. The method of incorporating the development accelerating agent into the photosensitive material may be the same as those for the reducing agent, and is preferably added in the form of a solid dispersion or an emulsion dispersion. In the case where the development accelerating agent is added as an emulsion dispersion, it is preferred that it is added as an emulsion dispersion dispersed by using a high boiling point solvent, which is in a solid state at ordinary temperature, and a low boiling point auxiliary solvent, or is added as an oilless emulsion dispersion using no high boiling point solvent.

Among the aforementioned compounds as the development accelerating agent in the embodiment, the hydrazine compound represented by the general formula (1) in Japanese Patent Application No. 2001-074278 and the phenol or naphthol compound represented by the general formula (2) in Japanese Patent Application No. 2000-76240 are particularly preferred.

Preferred examples of the development accelerating agent in the embodiment will be described below, but the invention is not limited to them.

(A-1)

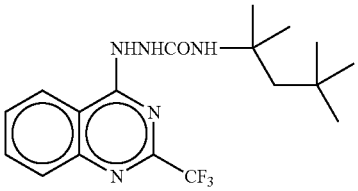

(A-2)

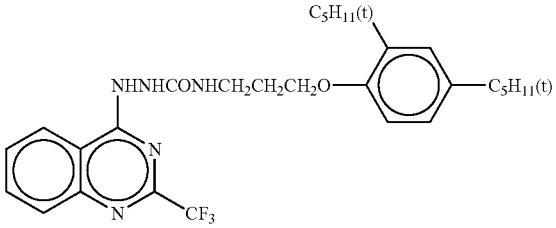

(A-3)

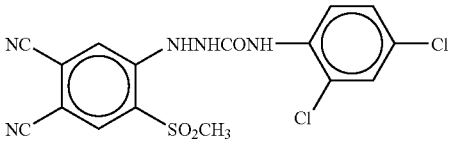

(A-4)

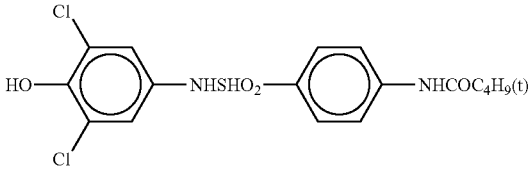

(A-5)

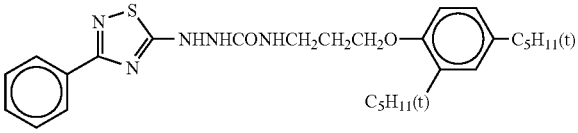

(A-6)

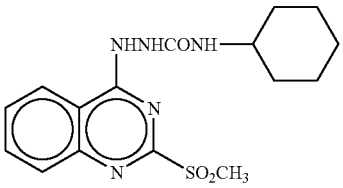

-continued (A-7)

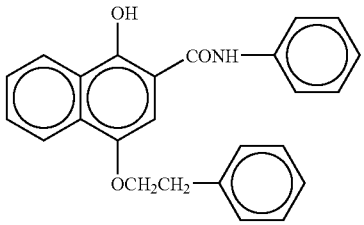

(A-8)

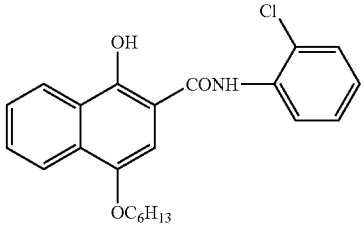

(A-9)

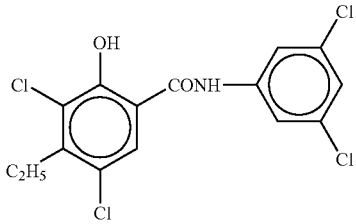

(A-10)

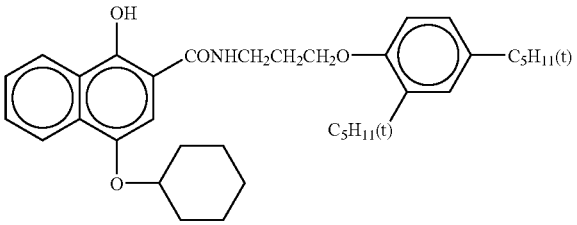

(Hydrogen Bonding Compound)

In the embodiment, in the case where the reducing agent has an aromatic hydroxyl group (—OH) or an amino group, it is preferred to use, in combination, a non-reducing compound having a group capable of forming a hydrogen bond with an amino group.

Examples of the group capable of forming a hydrogen bond include a phosphoryl group, a sulfoxide group, a sulfonyl group, a carbonyl group, an amide group, an ester group, a urethane group, an ureido group, a tertiary amino group and a nitrogen-containing aromatic group. Among these, preferred examples of the compound include compounds having a phosphoryl group, a sulfoxide group, an amide group (provided that it has no >N—H group but is blocked in the form of >N—Ra (wherein Ra represents a group other than hydrogen)), a urethane group (provided that it has no >N—H group but is blocked in the form of >N—Ra (wherein Ra represents a group other than hydrogen)), and an ureido group (provided that it has no >N—H group but is blocked in the form of >N—Ra (wherein Ra represents a group other than hydrogen)).

In the embodiment, the hydrogen bonding compound is particularly preferably a compound represented by the following general formula (D).

(D)

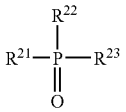

In the general formula (D), R21 to R23 each independently represents an alkyl group, an aryl group, an alkoxy group, an aryloxy group, an amino group or a heterocyclic group, which may be unsubstituted or may have a substituent.

In the case where R21 to R23 have a substituent, examples of the substituent include a halogen atom, an alkyl group, a aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group, and preferred examples of the substituent include an alkyl group and an aryl group, examples of which include a methyl group, an ethyl group, an isopropyl group, a t-butyl group, a t-octyl group, a phenyl group, a 4-alkoxyphenyl group and a 4-acyloxyphenyl group.

Specific examples of the alkyl group represented by R21 to R23 include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group.

Examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-t-butylphenoxy group, a naphthoxy group and a biphenyloxy group.

Examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

R21 to R23 each is preferably an alkyl group, an aryl group, an alkoxy group or an aryloxy group. It is preferred that at least one of R21 to R23 is an alkyl group or an aryl group, and it is more preferred that two or more thereof each is an alkyl group or an aryl group, from the standpoint of the effect of the embodiment. It is also preferred that R21 and R23 are the same groups since such a compound can be available at low cost.

Preferred examples of the hydrogen bonding compound represented by the general formula (D) in the embodiment will be described below, but the invention is not limited to them.

(D-1)

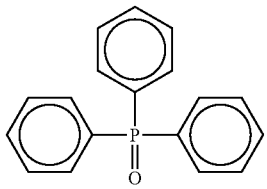

(D-2)

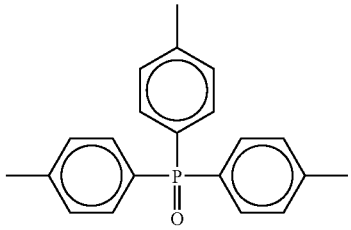

(D-3)

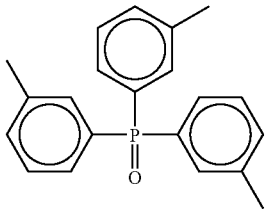

(D-4)

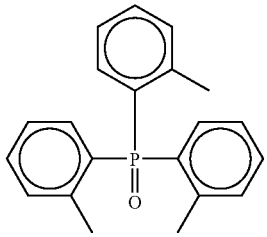

(D-5)

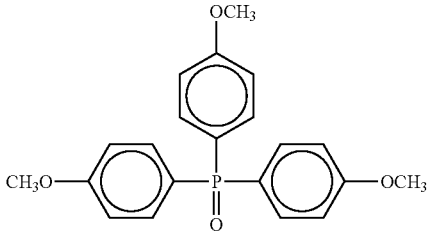

(D-6)

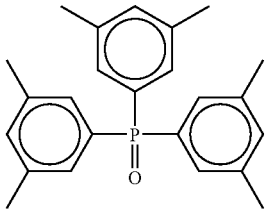

-continued
(D-7)
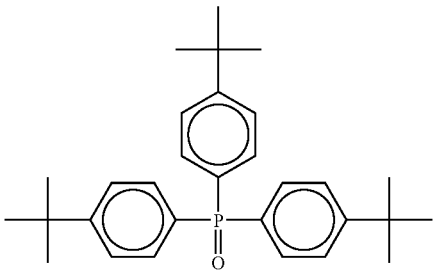
(D-8)
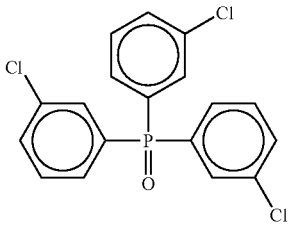
(D-9)
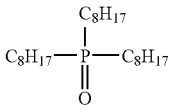
(D-10)
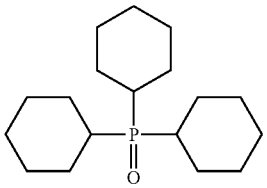
(D-11)
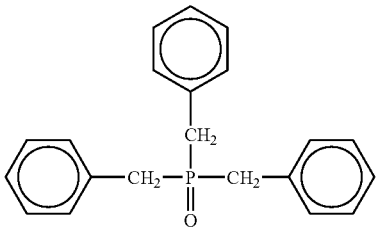
(D-12)
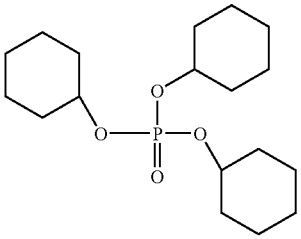
(D-13)
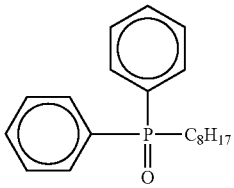
-continued
(D-14)
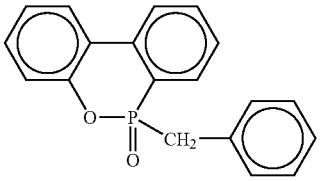
(D-15)
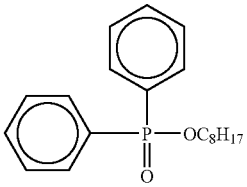
(D-16)
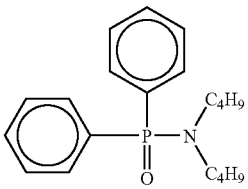
(D-17)
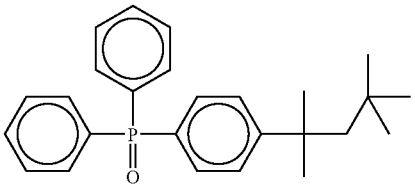
(D-18)
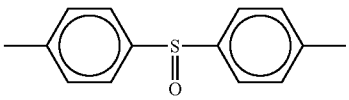
(D-19)
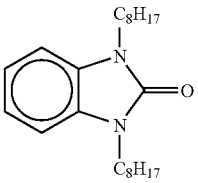
(D-20)
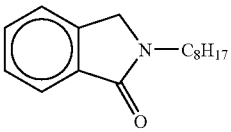
(D-21)
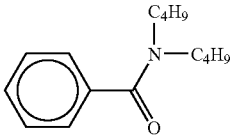
Specific examples of the hydrogen bonding compound also include those disclosed in Japanese Patent Application Nos. 2000-192191 and 2000-194811.
The hydrogen bonding compound in the embodiment may be contained in a coating composition in a solution form, an emulsion dispersion form and a solid fine particle dispersion form, and may be used in the photosensitive material, as similar to the reducing agent. The compound in the embodiment forms a complex through a hydrogen bond with a compound having a phenolic hydroxyl group in a solution state, and can be isolated as a complex in a crystalline state depending on the combination of the reducing agent and the compound represented by the general formula (A) in the embodiment.

It is particularly preferred for obtaining stable performance that the crystalline powder thus isolated is used as a solid-dispersed fine particle dispersion. It is also preferred that the reducing agent and the hydrogen bonding compound in the embodiment are mixed in the form of powder and subjected to complex formation upon dispersing by using a suitable dispersing agent with a sand grinder or the like.

The hydrogen bonding compound in the embodiment is preferably used in an amount of from 1 to 200% by mole, more preferably from 10 to 150% by mole, and further preferably from 30 to 100% by mole, based on the amount of the reducing agent.

Binder

The binder of the layer containing the organic silver salt in the embodiment may be any polymer, and the binder is preferably transparent or translucent and generally colorless. Examples of the binder include a natural resin, polymer or copolymer, a synthetic resin, polymer or copolymer, and other media that forms a film, and specific examples thereof include a gelatin compound, a rubber compound, a poly(vinyl alcohol) compound, a hydroxyethyl cellulose compound, a cellulose acetate compound, a cellulose acetate butyrate compound, a poly(vinylpyrrolidone) compound, casein, starch, a poly(acrylic acid) compound, a poly(methyl methacrylate) compound, a poly(vinyl chloride) compound, a poly(methacrylic acid) compound, a styrene-maleic anhydride copolymer, a styrene-acrylonitrile copolymer, a styrene-butadiene copolymer, a poly(vinyl acetal) compound (such as poly(vinyl formal) and poly(vinyl butyral)), a poly(ester) compound, a poly(urethane) compound, a phenoxy resin, a poly(vinylidene chloride) compound, a poly(epoxide) compound, a poly(carbonate) compound, a poly(vinyl acetate) compound, a poly(olefin) compound, a cellulose ester compound and a poly(amide) compound. The binder may be formed into a film from a solution of water or an organic solvent, or an emulsion.

The binder of the layer containing the organic silver salt in the embodiment preferably has a glass transition temperature of from 10 to 80° C., more preferably from 20 to 70° C., and further preferably from 23 to 65° C.

The glass transition temperature Tg herein can be calculated by the following equation.

$$1/Tg=\Sigma(Xi/Tgi)$$

wherein the polymer is formed by copolymerization of n monomer components of i=1 to n. Xi represents the weight fraction of the i-th monomer ($\Sigma Xi=1$), and Tgi represents the glass transition temperature (absolute temperature) of the homopolymer of the i-th monomer. $\Sigma$ means the sum of i=1 to n.

As the glass transition temperatures (Tgi) of the homopolymers of the respective monomers, those disclosed in J. Brandrup and E. H. Immergut, *Polymer Handbook* (*3rd edition*), published by Wiley-Interscience, Inc. (1989) are employed.

The polymer for the binder may be used solely or used in combination of two or more kinds thereof depending on necessity. A polymer having a glass transition temperature of 20° C. or more and that having a glass transition temperature of less than 20° C. may be used in combination. In the case where two or more kinds of polymers having different glass transition temperatures are used, the weight average glass transition temperature is preferably within the aforementioned range.

In the embodiment, an improved performance of the layer containing the organic silver salt can be obtained in the case where the layer is formed by coating a coating composition containing a solvent having a water content of 30% by weight or more, followed by drying, and in the case where the binder for the layer containing the organic silver salt can be dissolved or dispersed in an aqueous solvent, and particularly the binder contains a latex of a polymer having an equilibrium water content at 25° C. 60% RH of 2% by weight or less.

Most preferably, the binder is prepared to have an ionic conductivity of 2.5 mS/cm, and examples of the method for preparing the binder include such a method that a polymer is synthesized and then purified by using a separation functional membrane.

The aqueous solvent referred herein, in which the polymer can be dissolved or dispersed, is water or a mixture of water with 70% by weight or less of an organic solvent miscible with water.

Examples of the organic solvent miscible with water include an alcohol solvent, such as methyl alcohol, ethyl alcohol and propyl alcohol, a cellosolve solvent, such as methyl cellosolve, ethyl cellosolve and butyl cellosolve, ethyl acetate, and dimethylformamide.

The equilibrium water content at 25° C. 60% RH can be expressed by the following equation using the weight W1 of the polymer in humidity equilibrium condition under an atmosphere of 25° C. 60% RH and the weight WO of the polymer in absolute dry condition at 25° C.

$$\text{Equilibrium water content at 25° C. 60\% } RH=((W1-W0)/W0)\times 100 \text{ (\% by weight)}$$

As for the definition and the measuring method of the water content, for example, Kobunshi Kogaku Kouza 14 (Lectures on Polymer Engineering 14) "Kobunshi Zairyo Jikkenho (Experimental Techniques for Polymer Materials)", edited by The Society of Polymer Science, Japan, published by Chijin Shokan Co., Ltd. can be referred.

The binder polymer in the embodiment preferably has an equilibrium water content at 25° C. 60% RH of 2% by weight or less, more preferably from 0.01 to 1.5% by weight, and further preferably from 0.02 to 1% by weight.

The binder in the embodiment is particularly preferably a polymer capable of being dispersed in an aqueous solvent. Examples of the dispersed state include a latex having fine particles of a water insoluble hydrophobic polymer dispersed therein, and a dispersion having polymer molecules dispersed in a molecular state or as micelles, both of which are preferred. The average particle diameter of the dispersed particles is preferably from 1 to 50,000 nm, and more preferably from 5 to 1,000 nm. The particle diameter distribution of the dispersed particles is not particularly limited, and those having a wide particle diameter distribution and those having a monodisperse particle diameter may be used.

Preferred examples of the polymer capable of being dispersed in an aqueous solvent in the embodiment include hydrophobic polymers, such as an acrylic polymer, a poly(ester) compound, a rubber compound (e.g., an SBR resin), a poly(urethane) compound, a poly(vinyl chloride) compound, a poly(vinyl acetate) compound, a poly(vinylidene chloride) compound and a poly(olefin) compound. The polymer may be a linear polymer, a branched polymer or a crosslinked polymer, and may be a homopolymer obtained by polymerizing a single monomer, or a copolymer obtained by polymerizing two or more kinds of monomers. In the case of the copolymer, a random copolymer and a block copolymer may be used.

The polymer generally has a number average molecular weight of from 5,000 to 1,000,000, and preferably from 10,000 to 200,000. In the case where the molecular weight is too small, the emulsion layer becomes insufficient in strength, and in the case where the molecular weight is too large, the film forming property is deteriorated.

Preferred examples of the polymer latex include the following. In the following description, the compositions of the polymers are expressed by raw material monomers, the numerals in parentheses are proportions in terms of percent by weight, and Mn represents a number average molecular weight. In the case where a polyfunctional monomer is used, the concept of molecular weight cannot be applied thereto due to the crosslinked structure, and thus the polymer is indicated with the term "crosslinked" with the molecular weight being omitted. Tg represents a glass transition temperature.

P-1: latex of MMA(70)-EA(27)-MAA(3) (Mn: 37,000, Tg: 61° C.)
P-2: latex of MMA(70)-2EHA(20)-St(5)-AA(5) (Mn: 40,000, Tg: 59° C.)
P-3: latex of St(50)-Bu(47)-MAA(3) (crosslinked, Tg: −17° C.)
P-4: latex of St(68)-Bu(29)-AA(3) (crosslinked, Tg: 17° C.)
P-5: latex of St(71)-Bu(26)-AA(3) (crosslinked, Tg: 24° C.)
P-6: latex of St(70)-Bu(27)-IA(3) (crosslinked)
P-7: latex of St(75)-Bu(24)-AA(1) (crosslinked, Tg: 29° C.)
P-8: latex of St(60)-Bu(35)-DVB(3)-MAA(2) (crosslinked)
P-9: latex of St(70)-Bu(25)-DVB(2)-MAA(3) (crosslinked)
P-10: latex of VC(50)-MMA(20)-EA(20)-AN(5)-AA(5) (Mn: 80,000)
P-11: latex of VDC(85)-MMA(5)-EA(5)-MAA(5) (Mn: 67,000)
P-12: latex of Et(90)-MAA(10) (Mn: 12,000)
P-13: latex of St(70)-2EHA(27)-AA(3) (Mn: 130,000, Tg: 43° C.)
P-14: latex of MMA(63)-EA(35)-AA(2) (Mn: 33,000, Tg: 47° C.)
P-15: latex of St(70.5)-Bu(26.5)-AA(3) (crosslinked, Tg: 23° C.)
P-16: latex of ST(69.5)-Bu(27.5)-AA(3) (crosslinked, Tg: 20.5° C.)

The symbols indicating the monomers in the aforementioned structural description are as follows.

MMA: methyl methacrylate
EA: ethyl acrylate
MAA: methacrylic acid
2EAH: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The aforementioned polymer latexes are commercially available, and the following polymers can be used. Examples of the acrylic polymer include Cevian A-4635, 4718 and 4601 (produced by Daicel Chemical Industries, Ltd.), and Nipol Lx811, 814, 821, 820 and 857 (produced by Nippon Zeon Co., Ltd.). Examples of the poly(ester) compound include FINETEX ES650, 611, 675 and 850 (produced by Dainippon Ink And Chemicals, Inc.) and WD-size and WMS (produced by Eastman Chemical Co., Ltd.). Examples of the poly(urethane) compound include HYDRAN AP10, 20, 30 and 40 (produced by Dainippon Ink And Chemicals, Inc.). Examples of the rubber compound include LACSTAR 7310K, 3307B, 4700H and 7132C (produced by Dainippon Ink And Chemicals, Inc.), and Nipol Lx416, 410, 438C and 2507 (produced by Nippon Zeon Co., Ltd.). Examples of the poly(vinylidene chloride) compound include L502 and L513 (produced by Asahi Kasei Corp.). Examples of the poly(olefin) compound include Chemipearl S120 and SA100 (produced by Mitsui Petrochemical Industries, Ltd.).

These polymer latexes may be used solely or used by mixing two or more kinds of them.

The polymer latex used in the embodiment is particularly preferably a latex of a styrene-butadiene copolymer. The weight ratio of the monomer unit of styrene and the monomer unit of butadiene in the styrene-butadiene copolymer is preferably from 40/60 to 95/5. The proportion of the monomer unit of styrene and the monomer unit of butadiene occupied in the copolymer is preferably from 60 to 99% by weight. The preferred range of the molecular weight thereof is the same as those having described hereinabove.

Preferred examples of the styrene-butadiene copolymer latex used in the embodiment include P-3 to P-8, P-14 and P-15 mentioned above, and as commercial products, LACSTAR 3307B and 7132C, and Nipol Lx416.

The layer containing the organic silver salt in the photosensitive material in the embodiment may contain a hydrophilic polymer depending on necessity, such as gelatin, polyvinyl alcohol, methyl cellulose, hydroxypropyl cellulose and carboxymethyl cellulose.

The addition amount of the hydrophilic polymer is preferably 30% by weight or less, and more preferably 20% by weight or less, based on the total binder in the layer containing the organic silver salt.

The layer containing the organic silver salt (i.e., the image forming layer) in the embodiment is preferably formed by using a polymer latex as a binder. The amount of the binder in the layer containing the organic silver salt is preferably from 1/10 to 10/1, and more preferably from 1/5 to 4/1, in terms of a weight ratio of (total binder)/(organic silver salt).

The layer containing the organic silver salt is generally such a photosensitive layer (emulsion layer) containing a photosensitive silver halide, which is a photosensitive silver salt, and in this case, the weight ratio of (total binder)/(silver halide) is preferably from 400 to 5, and more preferably from 200 to 10.

The total amount of the binder in the image forming layer in the embodiment is preferably from 0.2 to 30 g/m$^2$, and more preferably from 1 to 15 g/m$^2$. The image forming layer in the embodiment may contain a crosslinking agent for crosslinking and a surface active agent for improving the coating property.

The solvent for the coating composition for forming the layer containing the organic silver salt of the photosensitive material in the embodiment (a solvent and a dispersion medium are inclusively referred to as a term "solvent" herein for simplicity) is preferably an aqueous solvent containing 30% by weight or more of water. As the component other than water, an arbitrary organic solvent miscible with water may be used, such as methyl alcohol, ethyl alcohol, isopropyl alcohol, methyl cellosolve, ethyl cellosolve, dimethylformamide and ethyl acetate. The water content of the solvent is more preferably 50% by weight or more, and further preferably 70% by weight or more.

Preferred specific examples of the solvent composition include 100% by weight of water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5 (wherein the numerals are percentages by weight).

Antifoggant

In the embodiment, a compound represented by the following general formula (H) is preferably contained as an antifoggant.

$$Q-(Y)n-C(Z1)(Z2)X \quad (H)$$

wherein Q represents an alkyl group, an aryl group or a heterocyclic group, Y represents a divalent linking group, n represents 0 or 1, Z1 and Z2 each represents a halogen atom, and X represents a hydrogen atom or an electron withdrawing group.

Q preferably represents a phenyl group substituted with an electron withdrawing group having a positive value of the Hammett's substituent constant σp. With respect to the Hammett's substituent constant, *Journal of Medicinal Chemistry*, vol. 16, No. 11, p. 1207-1216 (1973) can be referred.

Examples of the electron withdrawing group include a halogen atom (such as a fluorine atom (σp value: 0.06, a chlorine atom (σp value: 0.23), a bromine atom (σp value: 0.23) and an iodine atom (σp value: 0.18)), a trihalomethyl group (such as a tribromomethyl group (σp value: 0.29), a trichloromethyl group (σp value: 0.33) and a trifluoromethyl group (σp value: 0.54)), a cyano group (σp value: 0.66), a nitro group (σp value: 0.78), an aliphatic, aryl or heterocyclic acyl group (such as an acetyl group (σp value: 0.50) and a benzoyl group (σp value: 0.43)), an alkynyl group (such as a C≡CH group (σp value: 0.23)), an aliphatic, aryl or heterocyclic oxycarbonyl group (such as a methoxycarbonyl group (σp value: 0.45) and a phenoxycarbonyl group (σp value: 0.44)), a carbamoyl group (σp value: 0.36), a sulfamoyl group (σp value: 0.57), a sulfoxide group, a heterocyclic group and a phosphoryl group.

The σs value is preferably from 0.2 to 2.0, and more preferably from 0.4 to 1.0.

Preferred examples of the electron withdrawing group include a carbamoyl group, an alkoxycarbonyl group, an alkylsulfonyl group, an alkylphosphoryl group, a carboxyl group, an alkyl or arylcarbonyl group and an arylsulfonyl group, and a carbamoyl group, an alkoxycarbonyl group, an alkylsulfonyl group and an alkylphosphryl group are particularly preferred, with a carbamoyl group being most preferred.

X preferably represents an electron withdrawing group, more preferably represents a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably represents a halogen atom.

As the halogen atom, a chlorine atom, a bromine atom and an iodine atom are preferred, and a chlorine atom and a bromine atom are more preferred, with a bromine atom being particularly preferred.

Y preferably represents —C(=O)—, —SO— or —$SO_2$—, more preferably represents —C(=O)— or —$SO_2$—, and particularly preferably represents —$SO_2$—. n represents 0 or 1, and is preferably 1.

Specific examples of the compound represented by the general formula (H) in the embodiment will be described below, but the embodiment is not limited to them.

(H-1)

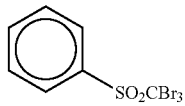

(H-2)

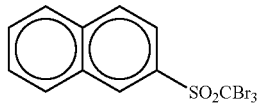

(H-3)

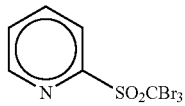

(H-5)

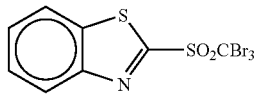

(H-6)

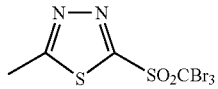

(H-7)

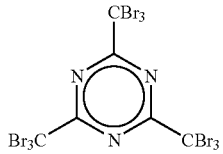

(H-8)

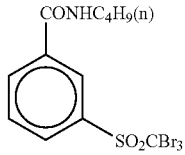

(H-9)

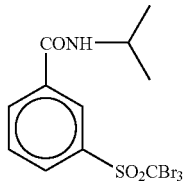

(H-10)

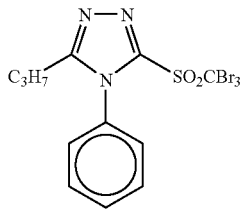

-continued (H-11)

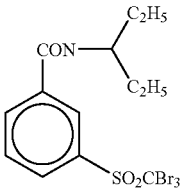

(H-12)

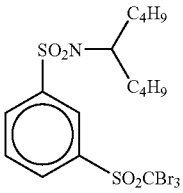

(H-13)

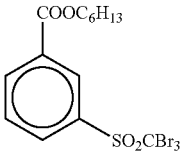

(H-14)

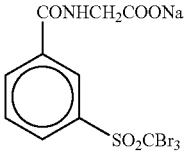

(H-15)

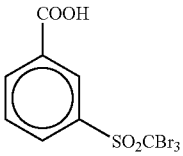

(H-16)

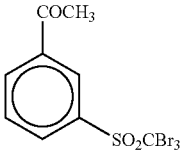

(H-17)

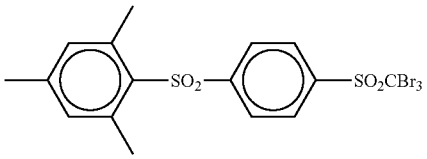

(H-18)

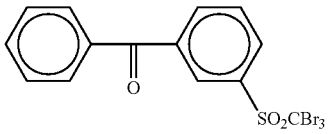

(H-19)

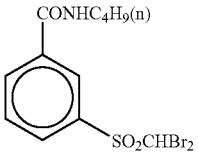

-continued (H-20)

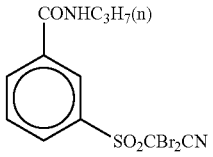

(H-21)

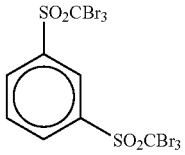

(H-22)

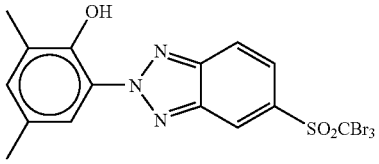

(H-23)

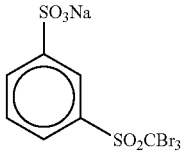

(H-24)

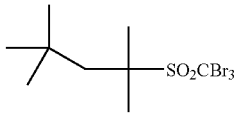

The compound represented by the general formula (H) is preferably used in an amount of from $10^{-4}$ to 0.8 mole, more preferably from $10^{-3}$ to 0.1 mole, and further preferably from $5\times10_{-3}$ to 0.05 mole, per 1 mole of the non-photosensitive silver salt in the image forming layer.

In the case where the silver halide having a high silver iodide content is used, in particular, the addition amount of the compound represented by the general formula (H) is important for obtaining a sufficient antifogging effect, and it is most preferred that the compound is used in an amount of from $5\times10^{-3}$ to 0.03 mole per 1 mole of the non-photosensitive silver salt in the image forming layer.

In the embodiment, examples of the method for adding the compound represented by the general formula (H) include those for the method for adding the reducing agent.

The compound represented by the general formula (H) preferably has a melting point of 200° C. or less, and more preferably 170° C. or less.

Examples of other organic polyhalide compound used in the embodiment include the compound disclosed in paragraphs 0111 to 0112 of JP-A-11-65021. In particular, the organic halogen compound represented by the formula (P) in Japanese Patent Application No. 11-87297, the organic polyhalide compound represented by the general formula (II) in JP-A-10-339934, and the organic polyhalide compound disclosed in Japanese Patent Application No. 11-205330 are preferred.

Other Antifoggants

Examples of other antifoggants include the mercury(II) salt disclosed in paragraph 0113 of JP-A-11-65021, the benzoic acid compound disclosed in paragraph 0114 of the same publication, the salicylic acid derivative disclosed in JP-A-2000-206642, the formalin scavenger compound represented by the formula (S) disclosed in JP-A-2000-221634, the triazine compound relating to the claim 9 of JP-A-11-352624, the compound represented by the general formula (III) disclosed in JP-A-6-11791, and 4-hydroxy-6-methyl-1,3,3a,7-tetrazaindene.

Examples of an antifoggant, a stabilizer and a stabilizer precursor that can be used in the embodiment include the compounds disclosed in paragraph 0070 of JP-A-10$^{-62899}$, page 20, line 57 to page 21, line 7 of European Patent 0,803,764A1, JP-A-9-281637 and JP-A-9-329864.

The thermal developing photosensitive material in the embodiment may contain an azolium salt for preventing fog. Examples of the azolium salt include the compound represented by the general formula (XI) disclosed in JP-A-59-193447, the compound disclosed in JP-B-55-12581, and the compound represented by the general formula (II) disclosed in JP-A-60-153039. The azolium salt may be added any part of the photosensitive material, and it is preferably added to the layer on the side where the photosensitive layer is provided, and more preferably added to the layer containing the organic silver salt.

The occasion of the addition of the azolium salt may be any step in the preparation of the coating composition. In the case where the azolium salt is added to the layer containing the organic silver salt, it may be added in any step from the preparation of the organic silver salt to the preparation of the coating composition, and is preferably added after preparing the organic silver salt and immediately before coating. The method for adding the azolium salt may be effected in any form, such as powder, a solution and a fine particle dispersion. the azolium salt may be added as a solution formed by mixing with other additives, such as a sensitizing dye, a reducing agent and a color toning agent.

The addition amount of the azolium salt in the embodiment is not limited, and is preferably from $1\times10^{-6}$ to 2 mole, and more preferably from $1\times10^{-3}$ to 0.5 mole, per 1 mole of silver.

Other Additives (1) Mercapto, Disulfide And Thione Compounds

In the embodiment, a mercapto compound, a disulfide compound and a thione compound may be contained for such purposes as control of the development by suppressing or accelerating the development, improvement of the spectral sensitization efficiency, and improvement of the storage stability before and after the development. These compounds are disclosed, for example, in paragraphs 0067 to 0069 of JP-A-10-62899, the compound represented by the general formula (I) disclosed in JP-A-10-186572, the specific examples of the compound disclosed in paragraphs 0033 to 0052 of the same publication, page 20, lines 36 to 56 of EP-A No. 0.803,764A1, and Japanese Patent Application No. 11-273670. Among these, a mercapto-substituted heterocyclic aromatic compound is preferred.

(2) Color Toning Agent

A color toning agent is preferably added to the thermal developing photosensitive material in the embodiment, and the color toning agent is disclosed in paragraphs 0054 to 0055 of JP-A-10-62899, page 21, lines 23 to 48 of European Patent No. 0.8037641 A1, JP-A-2000-356317 and Japanese Patent Application No. 2000-187298. Preferred examples thereof include a phthalazinone compound (such as phthalazinone, a phthalazinone derivative and a metallic salt thereof, e.g., 4-(1-naphthyl)phthalazinone, 6-chlorophthalazinone, 5,7-dimethoxyphthalazinone and 2,3-dihydro-1,4-phthalazin-dione); a combination of a phthalazinone compound and a phthalic acid compound (such as phthalic acid, 4-methylphthalic acid, 4-nitrophthalic acid, diammonium phthalate, sodium phthalate, potassium phthalate and tetrachlorophthalic anhydride); a phthalazine compound (such as phthalazine, a phthalazine derivative and a metallic salt thereof, e.g., 4-(1-naphthyl)phthalazine, 6-isopropylphthalazine, 6-t-butylphthalazine, 6-chlorophthalazine, 5,7-dimethyoxyphthalazine and 2,3-dihydrophthalazine), and in the case of a combination with a silver halide having a high silver iodide content, a combination of a phthalazine compound and a phthalic acid compound is preferred.

The addition amount of the phthalazine compound is generally from 0.01 to 0.3 mole, more preferably from 0.02 to 0.2 mole, and particularly preferably from 0.02 to 0.1 mole, per 1 mole of the organic silver salt. The addition amount is an important factor on acceleration of development, which is a problem of the silver halide emulsion having a high silver iodide content in the embodiment, and thus the selection of a suitable addition amount attains both sufficient developing property and low fog.

(3) Plasticizer And Lubricant

A plasticizer and a lubricant that can be used in the photosensitive layer in the embodiment are disclosed in paragraph 0117 of JP-A-11-65021. A lubricant is also disclosed in paragraphs 0061 to 0064 of JP-A-11-84573 and paragraphs 00108 to 0062 of Japanese Patent Application No. 11-106881.

(4) Dye And Pigment

Various kinds of dyes and pigments (such as C.I. Pigment Blue 60, C.I. Pigment Blue 64 and C.I. Pigment Blue 15:6) may be used in the photosensitive layer in the embodiment for such purposes as improvement of color tone, prevention of formation of interference fringes upon exposure with laser light, and prevention of irradiation. These dyes and pigments are disclosed in detail, for example, in WO98/36322, JP-A-10-268465 and JP-A-11-338098.

(5) Super High Contrast Agent

In order to form a super high contrast image suitable for prepress purposes, a super high contrast agent is preferably added to the image forming layer. The super high contrast agent and the addition method and amount therefor are disclosed in paragraphs 0136 to 0193 of JP-A-11-223898, the compounds represented by the formula (H), the formulae (1) to (3) and the formulae (A) and (B) in Japanese Patent Application No. 11-87297, and the compounds represented by the general formulae (III) to (V) (example compounds kagaku 21 to kagaku 24) of Japanese Patent Application No. 11-91652. A super high contrast accelerator is disclosed in paragraph 0102 of JP-A-11-65021 and paragraphs 0194 to 0195 of JP-A-11-223898.

Upon using forming acid or a formate salt is used as a strong fogging substance, it is preferably contained on the side where the image forming layer containing the photosensitive silver halide is provided in an amount of 5 mmole or less, and more preferably 1 mmole or less, per 1 mole of silver.

In the case where a super high contrast agent is used in the thermal developing photosensitive material in the embodiment, an acid obtained by hydrating diphosphorous pentoxide or a salt thereof is preferably used in combination. Examples of the acid obtained by hydrating diphosphorous pentoxide or a salt thereof include metaphosphoric acid (or a salt thereof), pyrophosphoric acid (or a salt thereof), orthophosphoric acid (or a salt thereof), triphosphoric acid (or a salt thereof), tetraphosphoric acid (or a salt thereof) and hexametaphosphoric acid (or a salt thereof). Preferred examples of the acid obtained by hydrating diphosphorous pentoxide or a salt thereof include orthophosphoric acid (or a salt thereof) and hexametaphosphoric acid (or a salt thereof). Specific examples of the salt include sodium orthophosphate, sodium dihydrogenorthophosphate, sodium hexametaphosphate and ammonium hexametaphosphate.

The using amount of the acid obtained by hydrating diphosphorous pentoxide or a salt thereof may be such an amount that is desired corresponding to the performance, such as sensitivity and fog, and is preferably from 0.1 to 500 $mg/m^2$, and more preferably from 0.5 to 100 $mg/m^2$, in terms of coated amount per 1 $m^2$ of the photosensitive material.

(Preparation And Coating of Coating Composition)

The temperature, at which the coating composition for forming the image forming layer in the embodiment is prepared, is preferably from 30 to 65° C., more preferably 35° C. or more and less than 60° C., and further preferably from 35 to 55° C. The temperature of the coating composition for forming the image forming layer immediately after the addition of the polymer latex is preferably maintained at from 30 to 65° C.

2. Layer Constitution And Other Constitutional Components

The thermal developing photosensitive material in the embodiment may have non-photosensitive layers in addition to the image forming layer. The non-photosensitive layers can be classified into the following categories depending on the positions thereof, i.e., (a) a surface protective layer provided on or above the image forming layer (far from the support), (b) an intermediate layer provided between the plural image forming layers or between the image forming layer and the protective layer, (c) an undercoating layer provided between the image forming layer and the support, and (d) a back layer provided on the side opposite to the image forming layer.

A layer functioning as an optical filter may also be provided, which is formed as the layer (a) or (b). An antihalation layer may be provided as the layer (c) or (d).

(1) Surface Protective Layer

A surface protective layer may be provided in the thermal developing photosensitive material in the. embodiment for preventing the image forming layer from being adhered. The surface protective layer may be a single layer or may be formed of plural layers. The surface protective layer is disclosed in paragraphs 0119 to 0120 of JP-A-11-65021 and Japanese Patent Application No. 2000-171936.

A binder for the surface protective layer in the embodiment is preferably gelatin, and polyvinyl alcohol (PVA) may be used solely or used in combination therewith. Examples of the gelatin include inert gelatin (such as Nitta Gelatin 750) and phthalated gelatin (Nitta Gelatin 801).

Examples of the PVA include those disclosed in paragraphs 0009 to 0020 of JP-A-2000-171936, and preferred examples thereof include PVA-105 as a completely saponified product, PVA-205 and PVA-335 as partially saponified products, and MP-203 as modified polyvinyl alcohol (trade names, produced by Kuraray Co., Ltd.).

The coated amount of polyvinyl alcohol in the protective layer (per one layer) is preferably from 0.3 to 4.0 $g/m^2$, and more preferably from 0.3 to 2.0 $g/m^2$, per 1 $m^2$ of the support.

The coated amount of the total binder (including a water soluble polymer and a latex polymer) of the surface protective layer (per one layer) is preferably from 0.3 to 5.0 $g/m^2$, and more preferably from 0.3 to 2.0 $g/m^2$, per 1 $m^2$ of the support.

(2) Antihalation Layer

In the thermal developing photosensitive material in the embodiment, an antihalation layer may be provided on the far side from an exposure light source with respect to the photosensitive layer. The antihalation layer is disclosed in paragraphs 0123 to 0124 of JP-A-11-65021, JP-A-11-223898, JP-A-9-230531, JP-A-10-36695, JP-A-10-104779, JP-A-11-231457, JP-A-11-352625 and JP-A-11-352626.

The antilialation layer contains. an antihalation dye having absorption in an exposure wavelength. In the case where the exposure wavelength in the infrared region, an infrared absorbing dye may be used, and in this case, the dye preferably does not have absorption in the visible region.

In the case where halation is prevented by using a dye having absorption in the visible region, it is preferred that the color of the dye substantially does not remain after forming an image, and such means is preferably used that decolorization occurs by heat of the thermal development. In particular, it is preferred that a thermal decolorization dye and a base precursor are added to a non-photosensitive layer to function as an antihalation layer. The techniques are disclosed in JP-A-11-231457.

The addition amount of the decolorization dye can be determined by the purpose of the dye. In general, it is used in such an amount that provides an optical density (absorbance) exceeding 0.1 as measured at the target wavelength. The optical density herein is preferably from 0.2 to 2. The using amount of the dye for obtaining an optical density in the range is generally about from 0.001 to 1 $g/m^2$.

Upon decolorization of the dye, the optical density after the thermal development can be decreased to 0.1 or less. Two or more kinds of decolorization dyes may be used in combination in a thermally decolorizable recording material or the thermal developing photosensitive material. Similarly, two or more kinds of base precursors may be used in combination.

In the thermal decolorization system using the decolorization dye and the base precursor, it is preferred to use such a substance that lowers the melting point by 3° C. or more upon mixing with the base precursor (such as diphenylsulfone and 4-chlorophenyl(phenyl)sulfone) disclosed in JP-A-11-352626 from the standpoint of thermal decolorization property.

(3) Back Layer

A back layer that can be applied to the embodiment is disclosed in paragraphs 0128 to 0130 of JP-A-11-65021.

In the embodiment, a coloring agent having an absorption maximum in a wavelength range of from 300 to 450 nm is preferably added for improving the silver color tone and the time-lapse stability of the image. The coloring agent is disclosed, for example, in JP-A-62-210458, JP-A-63-104046, JP-A-63-103235, JP-A-63-208846, JP-A-63-306436, JP-A-63-314535, JP-A-1-61745 and Japanese Patent Application No. 11-276751. The colorant is generally added in an amount of from 0.1 $mg/m^2$ to 1 $g/m^2$ and is preferably added to a back layer provided on the side opposite to the photosensitive layer.

(4) Matting Agent

In the embodiment, a matting agent is preferably added to the surface protective layer and the back layer for improving delivering property. The matting agent is disclosed in paragraphs 0126 to 0127 of JP-A-11-65021.

The coated amount of the matting agent is preferably from 1 to 400 $mg/m^2$, and more preferably from 5 to 300 $mg/m^2$, per 1 $m^2$ of the photosensitive material.

The matte degree of the emulsion surface is not limited as far as so-called stardust defects, in which small white dropouts are formed in an image part to cause leakage of light, do not occur, and the Beck smoothness is preferably from 30 to 2,000 seconds, and particularly preferably from 40 to 1,500 seconds. The Beck smoothness can be easily obtained by JIS P8119 (Smoothness Test Method of Paper and Paper Board with Beck Tester) and the TAPPI Standard Test Method T479.

In the embodiment, as the matte degree of the back layer, the Beck smoothness is preferably from 10 to 1,200 seconds, more preferably from 20 to 800 seconds, and further preferably from 40 to 500 seconds.

In the embodiment, the matting agent is preferably added to the outermost layer or a layer functioning as the outermost layer of the photosensitive material, or a layer close to the outermost surface of the photosensitive material, and is also preferably added to a layer functioning as a protective layer.

(5) Polymer Latex

A polymer latex may be added to the surface protective layer and the back layer in the embodiment.

The polymer latex is disclosed, for example, in "Gosei Jushi Emulsion" (Synthetic Resin Emulsion), edited by T. Okuda and H. Inagaki, published by Kobunshi Kankokai Co., Ltd. (1978), "Gosei Latex no Oyo" (Application of Synthetic Latex), edited by T. Suzuki, Y. Kataoka, S. Suzuki and K. Kasahara, published by Kobunshi Kankokai Co., Ltd. (1993), and "Gosei Latex no Kagaku" (Chemistry of Synthetic Latex), by S. Muroi, published by Kobunshi Kankokai Co., Ltd. (1970), and specific examples thereof include a latex of a copolymer of methyl methacrylate (33.5% by weight)/ethyl acrylate (50% by weight)/methacrylic acid (16.5% by weight), a latex of a copolymer of methyl methacrylate (47.5% by weight)/butadiene (47.5% by weight)/itaconic acid (5% by weight), a latex of a copolymer of ethyl acrylate/methacrylic acid, a latex of a copolymer of methyl methacrylate (58.2% by weight)/2-ethylhexyl acrylate (25.4% by weight)/styrene (8.6% by weight)/2-hydroxyethyl methacrylate (5.1% by weight)/acrylic acid (2.0% by weight), and a latex of a copolymer of methyl methacrylate (64.0% by weight)/styrene (9.0% by weight)/butyl acrylate (20.0% by weight)/2-hydroxyethyl methacrylate (5.0% by weight)/acrylic acid (2.0% by weight).

The polymer latex is preferably used in an amount of from 10 to 90% by weight, and particularly preferably from 20 to 80% by weight, based on the total binder (including a water soluble polymer and a latex polymer) in the surface protective layer or the back layer.

(6) Film Surface pH

The thermal developing photosensitive material in the embodiment preferably has a film surface pH before thermal development of 7.0 or less, and more preferably 6.6 or less. The lower limit of the film surface pH is not particularly limited, and is about 3. The most preferred range of the film surface pH is from 4 to 6.2.

The film surface pH is adjusted preferably by using an organic acid, such as a phthalic acid derivative, a nonvolatile acid, such as sulfuric acid, or a volatile base, such as ammonia, from the standpoint of reducing the film surface pH. In particular, ammonia is preferably used for reducing the film surface pH since it can be removed before the coating step or the thermal development. Furthermore, a nonvolatile base, such as sodium hydroxide, potassium hydroxide and lithium hydroxide, is preferably used in combination with ammonia. The measuring method of the film surface pH is disclosed in paragraph 0123 of Japanese Patent Application No. 11-87297.

(7) Film Hardener

A film hardener may be used in the layers in the embodiment, such as the photosensitive layer, the protective layer and the back layer.

Examples of the film hardener include the methods disclosed in T. H. James "The Theory of the Photographic Process, fourth edition", published by Macmillan Publishing Co., Inc. (1977), p. 77 to 87, and preferred examples thereof include chromium alum, 2,4-dichloro-6-hydroxy-s-triazine sodium salt, N,N-ethylene-bis(vinylsulfonacetamide), N,N-propylene-bis(cinylsulfonacetamide), the polyvalent metallic ions disclosed in the aforementioned publication, p. 78, the polyisocyanate compounds disclosed in U.S. Pat. No. 4,281,060 and JP-A-6-208193, the epoxy compound disclosed in U.S. Pat. No. 4,791,042, and the vinylsulfone compound disclosed in JP-A-62-89048.

The film hardener is added in the form of a solution. The occasion of adding the solution to the coating composition for forming the protective layer is generally from 180 minutes before coating to immediately before coating, and preferably from 60 minutes before coating to 10 seconds before coating, but is not particularly limited as far as the effect of the embodiment is sufficiently exerted.

Specific examples of the mixing method include a method of mixing in a tank in such a manner that the average retention time calculated from the addition flow amount and the feeding amount to the coater becomes a desired time, and a method of using a static mixer disclosed in N. Harnby, M. F. Edwards and A. W. Nienow, "Ekitai Kongo Gijutu" (Liquid Mixing Techniques), translated by K. Takahashi, Chapter 8, published by Nikkan Kogyo Shimbun, Ltd. (1989).

(8) Surface Active Agent

A surface active agent that can be used in the embodiment is disclosed in paragraph 0132 of JP-A-11-65021.

In the embodiment, a fluorine surface active agent is preferably used. Preferred examples of the fluorine surface active agent include the compounds disclosed in JP-A-10-197985, JP-A-2000-19680 and JP-A-2000-214554. The polymer fluorine surface active agent disclosed in JP-A-9-281636 is also preferably used. In the embodiment, the fluorine surface active agent disclosed in Japanese Patent Application No. 2000-206560 is particularly preferably used.

(9) Antistatic Agent

In the embodiment, an antistatic layer containing various kinds of known metallic oxides and electroconductive polymers may be used. The antistatic layer may also function as the undercoating layer, the back layer or the surface protective layer, or may be separately provided. The antistatic layer may be provided by applying the techniques disclosed in paragraph 0135 of JP-A-11-65021, JP-A-56-143430, JP-A-56-143431, JP-A-58-62646, JP-A-56-120519, paragraphs 0040 to 0051 of JP-A-11-84573, U.S. Pat. No. 5,575,957, and paragraphs 0078 to 0084 of JP-A-11-223898.

(10) Support

As the transparent support, such a polyester film, particularly a polyethylene terephthalate film, is preferably used that has been subjected to a heat treatment at a temperature of from 130 to 185° C. for relaxing internal strain due to biaxial stretching remaining in the film to prevent thermal contraction from occurring on thermal development.

As a support of the thermal developing photosensitive material used in combination with an ultraviolet luminescent screen, polyethylene naphthalate (PEN) is preferably used. The PEN is preferably polyethylene-2,6-naphthalate. In the polyethylene-2,6-naphthalate referred in the embodiment, the constitutional units thereof are substantially constituted by ethylen-2,6-naphthalene dicarboxylate units, and may be not only a homopolymer of polyethylene-2,6-naphthalate, but also a copolymer containing 10% or less, preferably 5% or less, of the structural units are modified with other component, and a mixture and a composition with other polymers.

Polyethyelene-2,6-naphthalate is generally synthesized by reacting naphthalene-2,6-dicarboxylic acid or a functional derivative thereof and ethylene glycol or a functional derivative thereof in the presence of a catalyst under suitable reaction conditions, and the polyethylene-2,6-naphthalate referred in the embodiment may be a copolymer polyester or a mixed polyester obtained by adding one or more of the third component (modifier) before completing the polymerization of polyethylene-2,6-naphthalate. Examples of the suitable third component include a compound having a divalent ester-forming functional group, such as a dicarboxylic acid, e.g., oxalic acid, adipic acid, phthalic acid, isophthalic acid, terephthalic acid, naphthalene-2,7-dicarboxylic acid, succinic acid and diphenyl ether dicarboxylic acid, a lower alkyl ester of the dicarboxylic acid, an oxycarboxylic acid, e.g., p-oxybenzoic acid and p-oxyethoxybenzoic acid, a lower alkyl ester of an oxycarboxylic acid, and a divalent alcohol, e.g., propylene glycol and trimethylene glycol. The polyethylene-2,6-naphthalate or a modified polymer thereof may have an end hydroxyl group and/or carboxyl group that is hidden with a monofunctional compound, such as benzoic acid, benzoylbenzoic acid, benzyloxybenzoic acid and methoxypolyalkylene glycol, or may be modified with a trifunctional or tetrafunctional ester-forming compound, such as glycerin and pentaerythritol, in such an extremely small amount that provides a substantially linear copolymer.

In case of a medical thermal developing photosensitive material, the transparent support may be colored with a blue dye (such as Dye-1 disclosed in the example of JP-A-8-240877) or may not be colored.

Specific examples of the support are disclosed in paragraph 0134 of JP-A-11-65021.

The support is preferably applied with an undercoating technique, such as the water soluble polyester disclosed in JP-A-11-84574, the styrene-butadiene copolymer disclosed in JP-A-10-186565, and the vinylidene chloride copolymers disclosed in JP-A-2000-39684 and paragraphs 0063 to 0080 of Japanese Patent Application No. 11-106881.

(11) Other Additives

The thermal developing photosensitive material may further contain an antioxidant, a stabilizer, a plasticizer, an ultraviolet absorbent and a coating assistant. The solvent disclosed in paragraph 0133 of JP-A-11-65021 may also be added. The various kinds of additives are added either the photosensitive layer or the non-photosensitive layer. With respect to the additives, WO98/36322, EP 803,764A1, JP-A-10-186567 and JP-A-10-18568 may be refereed.

(12) Coating Method

The thermal developing photosensitive material in the embodiment may be coated by any method. Specifically, various kinds of coating operations may be employed, such as extrusion coating, slide coating, curtain coating, dip coating, knife coating, flow coating and extrusion coating using a hopper of the kind disclosed in U.S. Pat. No. 2,681,294. The extrusion coating or slide coating disclosed in Stephen F. Kistler and Petert M. Schweizer, "Liquid Film Coating", pp. 399-536, published by Chapman & Hall, Inc. (1997) is preferably employed, and the slide coating is particularly preferably employed.

Examples of a slide coater used for the slide coating are disclosed in FIG. 11*b*.1 of the aforementioned publication at page 427. Two or more layers may be simultaneously coated by the method disclosed in the aforementioned publication, pp. 399-536 and the methods disclosed in U.S. Pat. No. 2,761,791 and British Patent No. 837,095.

The coating composition for forming the layer containing the organic silver salt in the embodiment is preferably a so-called thixotropy fluid. As for the technique relating thereto, JP-A-11-52509 may be referred.

The coating composition for forming the layer containing the organic silver salt in the embodiment preferably has a viscosity at a shearing speed of 0.1 $S^{-1}$ of from 400 to 100,000 mPa•s, and more preferably from 500 to 20,000 mPa•s.

The viscosity of the coating composition at a shearing speed of 1,000 $S^{-1}$ is preferably from 1 to 200 mPa•s, and more preferably from 5 to 80 mPa•s.

(13) Packing Material

The thermal developing photosensitive material in the embodiment is preferably packed with a packing material having a low oxygen permeability and/or a low moisture permeability, whereby the photographic performance is prevented from being deteriorated upon storing before use, and in the case of a rolled product, curling or core set of the material is prevented from occurring. The oxygen permeability is preferably 50 mL/atm/$m^2$•day or less, more preferably 10 mL/atm/$m^2$•day or less, and further preferably 0.1 mL/atm/$m^2$•day or less, at 25° C. The moisture permeability is preferably 10 g/atm/$m^2$•day or less, more preferably 5 g/atm/$m^2$•day or less, and further preferably 1 g/atm/$m^2$•day or less. Specific examples of a material having a low oxygen permeability and/or a low moisture permeability that can be utilized in the embodiment include those disclosed in JP-A-8-254793 and JP-A-2000-206653.

(14) Other Usable Techniques

Examples of other techniques that can be used in the thermal developing photosensitive material in the embodiment include those disclosed in EP 803,764A1, EP 883,022A1, WO98/36322, JP-A-56-62648, JP-A-58-62644, JP-A-9-43766, JP-A-9-281637, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-1865732, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096,JP-A-11-338098, JP-A-11-338099, JP-A-11-343420, JP-A-2000-187293, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936.

(15) Formation of Color Image

A constitution of a multicolor thermal developing photosensitive material may contain a combination of the aforementioned two layers for the colors, respectively, or may contain all the components therefor in a single layer as disclosed in U.S. Pat. No. 4,708,928.

In the case of the multicolor thermal developing photosensitive material, the emulsion layers are generally retained as being separated from each other by using a functional or non-functional barrier layer intervening between the photosensitive layers as disclosed in U.S. Pat. No. 4,460,681.

3. Process For Forming Image 3-1. Exposure

The thermal developing photosensitive material in the embodiment may be either the single sided type having an image forming layer only on one surface of a support, or the double sided type having image forming layers on both surfaces of a support.

(Double Sided Thermal Developing Photosensitive Material)

The thermal developing photosensitive material in the embodiment can be preferably used in a process for forming an image, in which an X-ray image is recorded by using an X-ray intensifying screen.

The steps of the process for forming an image by using the thermal developing photosensitive material may include:

(a) a step of providing the thermal developing photosensitive material between a pair of X-ray intensifying screens to fabricate an image forming assembly, (b) a step of disposing a subject between the assembly and an X-ray source, (c) a step of irradiating the subject with an X-ray having an energy level of from 25 to 125 kVp, (d) a step of taking out the thermal developing photosensitive material from the assembly, and (e) a step of heating the thermal developing photosensitive material thus taken out, at a temperature of from 90 to 180° C.

The thermal developing photosensitive material used in the assembly in the embodiment is preferably prepared to provide such an image through stepwise irradiation with an X-ray and thermal development that in the characteristic curve on an orthogonal coordinate system with the optical density (D) and the exposure amount (logE) are the same as each other in coordinate axis unit length, the average gamma (γ) formed by the point of the minimum density (Dmin)+0.1 in density and the point of the minimum density (Dmin)+0.5 in density is from 0.5 to 0.9, and the average gamma (γ) formed by the point of the minimum density (Dmin)+1.2 in density and the point of the minimum density (Dmin)+1.6 in density is from 3.2 to 4.0. In the case where a thermal developing photosensitive material having the aforementioned characteristic curve in the X-ray exposure system in the embodiment, an X-ray image having such an excellent photographic characteristics that the foot member is significantly stretched with a high gamma value in the medium density part. Owing to the photographic characteristics, such advantages are obtained that the descriptiveness of a low density region with a small X-ray penetration amount, such as a mediastinal part and a cardiac shadow, is improved, an easily viewable density is obtained in an image of a lung field part with a large X-ray penetration amount, and the contrast is improved.

A thermal developing photosensitive material having the aforementioned preferred characteristic curve can be easily produced, for example, by such a method that the image forming layers on both sides are respectively constituted by two or more silver halide emulsion layers having different sensitivities. In particular, it is preferred that the image forming layer is formed by using an emulsion having a high sensitivity in the upper layer and a high contrast emulsion having a low sensitivity in a lower layer. In the case where the image forming layer having two layers is used, the difference in sensitivity of the silver halide emulsions between the layers is generally from 1.5 to 20 times, and preferably from 2 to 15 times. The amount ratio of the emulsions used in the layers varies depending on the difference in sensitivity and the covering power of the emulsions. In general, the using amount of the emulsion having a high sensitivity is decreased when the difference in sensitivity is larger. For example, in the case where the difference in sensitivity is twice, with assuming the same covering power for the emulsions, the amount ratio of the emulsion having a high sensitivity to the emulsion having a low sensitivity is adjusted to be from 1/20 to 1/50 in terms of silver.

As the crossover cut technique (for a double sided photosensitive material) and the antihalation technique (for a single sided photosensitive material), the dyes disclosed in page 13, left lower column, line 1 to page 14, left lower column, line 9 of JP-A-2-68539 and a combination of the dye and a mordant can be used.

A fluorescent intensifying screen (radiation intensifying screen) used in the embodiment will be described. The radiation intensifying screen has, as the basic structure, a support and a fluorescent material layer formed on one surface thereof. The fluorescent material layer contains a fluorescent material dispersed in a binder. A transparent protective film is generally provided on the surface of the fluorescent material layer opposite to the support (i.e., the surface that is not in contact with the support), whereby the fluorescent material layer is protected from chemical degradation and physical impact.

Preferred examples of the fluorescent material in the embodiment include a tungsten salt fluorescent material (such as $CaWO_4$, $MgWO_4$ and $CaWO_4$:Pb), a terbium-activated rare earth acid sulfide fluorescent material (such as $Y_2O_2S$:Tb, $Gd_2O_2$:Tb, $La_2O_2S$:Tb, $(Y,Gd)_2O_2S$:Tb and $(Y,Gd)O_2S$:Tb,Tm), a terbium-activated rare earth phosphate salt fluorescent material (such as $YPO_4$:Tb, $GdPO_4$:Tb and $LaPO_4$:Tb), a terbium-activated rare earth oxyhalide fluorescent material (such as LaOBr:Tb, LaOBr:Tb,Tm, LaOCl:Tb, LaOCl:Tb,Tm, LaOBr:Tb, GdOBr:Tb and GdOCl:Tb), a thulium-activated rare earth oxyhalide fluorescent material (such as LaOBr:Tm and LaOCl:Tm), a barium sulfate fluorescent material (such as BaSO4:Pb, $BaSO_4$:$Eu^{2+}$ and (Ba, Sr)$SO_4$:$Eu^{2+}$), a divalent europium-activated alkaline earth metal phosphate salt fluorescent material (such as $(Ba_2PO_4)_2$:$Eu^{2+}$ and $(Ba_2PO_4)_2$:$Eu^{2+}$), a divalent europium-activated alkaline earth metal fluoride halide fluorescent material (such as BaFCl:$Eu^{2+}$, BaFBr:$Eu^{2+}$, BaFCl:$Eu^{2+}$,Tb, BaFBr:$Eu^{2+}$,Tb, $BaF_2$.BaCl.KCl:$Eu^{2+}$ and (Ba,Mg)$F_2$.BaCl.KCl:$Eu^{2+}$), an iodide fluorescent material (such as CsI:Na, CsI:Tl, NaI and KI:Tl), a sulfide fluorescent material (such as ZnS:Ag, (Zn,Cd)S:Ag, (Zn,Cd)S:Cu and (Zn,Cd)S:Cu,Al), a hafnium phosphate fluorescent material (such as HfP207:Cu), $YTaO_4$ and a material having an activator added thereto as an emission center. However, the fluorescent material used in the embodiment is not limited to these materials, and an arbitrary fluorescent material can be used that emits in the visible and near ultraviolet regions upon irradiation with radiation.

The fluorescent intensifying screen used in the embodiment preferably contains a fluorescent material filled in a gradient particle diameter structure. In particular, it is preferred that fluorescent material particles having a larger diameter are coated on the side of the surface protective film, and fluorescent material particles having a smaller diameter are coated on the side of the support. The fluorescent material particles having a smaller diameter preferably have a diameter of from 0.5 to 2.0 μm, and those having a larger diameter preferably have a diameter of from 10 to 30 μm.

(Single Sided Thermal Developing Photosensitive Material)

A single sided thermal developing photosensitive material in the embodiment is preferably used as an X-ray sensitive material for mammography.

It is important that the single sided thermal developing photosensitive material for the purpose is designed in such a manner that an image to be obtained has a contrast in the suitable range.

As for the preferred constitutional elements of the X-ray sensitive material for mammography, JP-A-5-45807, JP-A-10-62881, JP-A-10-510800 and JP-A-11-109564 can be referred.

(Combination with Ultraviolet Fluorescent Screen)

As a process for forming an image using the thermal developing photosensitive material in the embodiment, such a process for forming an image is preferably used that uses a fluorescent material having a major luminescent peak at 400 nm or lower in combination. More preferably, such a process for forming an image is used that uses a fluorescent material having a major peak at 380 nm or lower in combination. Either a double sided photosensitive material or a single sided photosensitive material may be used for the assembly. Examples of the screen having a major luminescent peak at 400 nm or lower include the screens disclosed in JP-A-6-11804 and WO93/01521, but the screen is not limited thereto. As the crossover cut technique (for a double sided photosensitive material) and the antihalation technique (for a single sided photosensitive material) of an ultraviolet ray, the technique disclosed in JP-A-8-76307 may be used. The dye disclosed in Japanese Patent Application No. 2000-320809 is particularly preferred as an ultraviolet absorbing dye.

3-2. Thermal Development

The thermal developing photosensitive material in the embodiment may be developed by any method, and in general, the thermal developing photosensitive material having been imagewise exposed is developed by increasing the temperature thereof. The developing temperature is preferably from 80 to 250° C., and more preferably from 100 to 140° C.

The developing time is preferably from 1 to 60 seconds, more preferably from 5 to 30 seconds, and particularly preferably from 5 to 20 seconds.

As the method for the thermal development, a method using a plate heater may be used in addition to the method using the thermal developing apparatus according to the invention. As the thermal developing method. using a plate heater, the method disclosed in JP-A-11-133572 is preferably used, which is a thermal developing apparatus for obtaining a visible image by making a thermal developing photosensitive material having a latent image formed therein in contact with heating unit in a thermal developing part, in which the heating unit contains a plate heater, plural press rollers are arranged along one surface of the plate heater to face the plate heater, and the thermal developing photosensitive material is passed between the press rollers and the plate heater to effect thermal development. It is preferred in the apparatus that the plate heater is divided into 2 to 6 stages, and the temperature at the tip end part is lowered by 1 to 10° C.

The process is also disclosed in JP-A-54-30032, whereby water and an organic solvent contained in the thermal developing photosensitive material can be relieved to the exterior, and the support of the thermal developing photosensitive material can be prevented from being deformed by heating rapidly.

3-3. System

In addition to the thermal developing apparatus according to the invention, Fuji Medical Dry Imager FM-DPL can be exemplified as a medical laser imager having an exposing part and a thermal developing part. The system of the apparatus is disclosed in *Fuii Medical Review*, No. 8, pp. 39-55, and the techniques disclosed therein can be used. The thermal developing photosensitive material in the embodiment can also be applied to a thermal developing photosensitive material for the laser imager in "AD Network" proposed as a network system conforming to the DICOM Standard by Fuji Medical Systems Inc.

4. Purposes of Embodiment

The thermal developing photosensitive material using a high silver iodide content photographic emulsion in the embodiment forms a black-and-white image with a silver image and is preferably used as a thermal developing photosensitive material for medical diagnosis, a thermal developing photosensitive material for industrial use, a thermal developing material for printing, and a thermal developing photosensitive material for COM use.

The aforementioned thermal developing photosensitive material will be described in detail with reference to the following examples, but the thermal developing photosensitive material is not limited thereto.

EXAMPLE

1. Preparation of PET Support And Undercoating 1-1. Film Formation

PET having an intrinsic viscosity IV of 0.66 (measured in phenol/tetrachloroethane (6/4 by volume) at 25° C.) was obtained by the ordinary method using terephthalic acid and ethylene glycol. PET was pelletized and then dried at 130° C. for 4 hours. PET was colored with a blue dye (1,4-bis(2,6-diethylanilinoanthraquinone)) and extruded from a T-die, followed by quenching, to obtain an unstretched film.

The unstretched film was stretched lengthwise in 3.3 times by using rolls having different peripheral speeds and then stretched crosswise in 4.5 times with a tenter. Thereafter, the film was thermally fixed at 240° C. for 20 seconds and then relaxed crosswise in 4% at the same temperature. The film was slitted at the chuck part of the tenter and subjected to knurling on both edges, followed by being wound at 4 kg/cm$^2$, to obtain a roll of a film having a thickness of 175 μm.

1-2. Surface Corona Treatment

Both surfaces of the support were treated by using a solid state corona treating machine, Model 6KVA, produced by Pillar Technologies, Inc. at room temperature and 20 m/min. It was found from the read values of electric current and voltage on the treatment that a treatment at 0.375 kV•A•min/m$^2$ was applied to the support. The treating frequency thereon was 9.6 kHz, the gap between the electrode and the dielectric roll was 1.6 mm.

1-3. Production of Undercoated Support (1) Preparation of Coating Composition For Undercoating Layer

| Formulation 1 (Undercoating on photosensitive layer side) | |
|---|---|
| Pesresin A-520 (30% by weight solution) (produced by Takamatsu Oil & Fat Co., Ltd.) | 46.8 g |

-continued

| Formulation 1 (Undercoating on photosensitive layer side) | |
|---|---|
| Vylonal MD-1200 (produced by Toyobo Co., Ltd.) | 10.4 g |
| Polyethylene glycol monononylphenyl ether (1% by weight solution, average ethylene oxide number: 8.5) | 11.0 g |
| PMMA polymer fine particles (average particle diameter: 0.4 μm, MP-1000, produced by Soken Chemical & Engineering Co., Ltd.) | 0.91 g |
| Distilled water | 931 mL |

The coating composition of the formulation 1 was coated on the biaxially stretched polyethylene terephthalate support having a thickness of 175 μm having been subjected to a corona treatment with a wire bar to a wet coated amount of 6.6 mL/m$^2$ (per one surface) and then dried at 180° C. for 5 minutes. The coating operation was effected on both surfaces of the support to produce an undercoated support.

2. Preparation of Materials For Coating (1) Silver Halide Emulsion (Preparation of Silver Halide Emulsion A)

4.3 mL of a 1% by weight potassium iodide solution was added to 1,421 mL of distilled water, and 3.5 mL of 0.5 mole/L sulfuric acid, 36.5 g of phthalated gelatin and 160 mL of 5% by weight methanol solution of 2,2'-(ethylenedithio) diethanol were added thereto to obtain a solution. The solution was maintained at a liquid temperature of 75° C. in a stainless steel reaction vessel under stirring, to which a solution A formed by adding distilled water to 22.22 g of silver nitrate to dilute to 218 mL was added at a constant flow rate over 16 minutes for the entire amount thereof, and a solution B formed by adding distilled water to 36.6 g of potassium iodide to dilute to 366 mL was added by the controlled double jet method with the pAg maintained at 10.2. Thereafter, 10 mL of a 3.5% by weight hydrogen peroxide aqueous solution was added thereto, and 10.8 mL of a 10% by weight benzimidazole aqueous solution was then added thereto. A solution C formed by adding distilled water to 51.86 g of silver nitrate to dilute to 508.2 mL was added thereto at a constant flow rate over 80 minutes for the entire amount thereof, and a solution D formed by adding distilled water to 63.9 g of potassium iodide to dilute to 639 mL was added thereto by the controlled double jet method with the pAg maintained at 10.2. Potassium hexachloroiridate(III) was added for the entire amount thereof after 10 minutes from the start of the addition of the solutions C and D to make a content thereof of $1\times10^{-4}$ mole per 1 mole of silver. After 5 seconds after completing the addition of the solution C, a potassium iron(II) hexacyanide aqueous solution was added thereto to make a content thereof of $3\times10^{-4}$ mole per 1 mole of silver. The pH of the system was adjusted to 3.8 by using sulfuric acid, and after terminating the stirring operation, sedimentation, desalting and washing steps were carried out. The pH of the system was adjusted to 5.9 by using a 1 mole/L sodium hydroxide solution to prepare a silver halide dispersion having pAg of 11.0.

The silver halide emulsion A was a pure silver iodide emulsion and was occupied by 80% or more of tabular particles having an average diameter of projected area of 0.93 μm, a variation coefficient of the average diameter of projected area of 17.7%, an average thickness of 0.057 μm, and an average aspect ratio of 16.3. The particles had a sphere equivalent diameter of 0.42 μm. As a result of analysis by X-ray powder diffraction, 90% or more of silver iodide was present in the γ phase.

(Preparation of Silver Halide Emulsion B)

1 mole of the tabular AgI particle emulsion prepared as the silver halide emulsion A was placed in a reaction vessel. The emulsion had pAg of 10.2 as measured at 38° C. A KBr solution of 0.5 mole/L and a AgNO3 solution of 0.5 mole/L were added at 10 mL/min over 20 minutes by the double jet addition method, whereby 10% by mole of silver bromide was substantially precipitated on the AgI host emulsion epitaxially. The pAg was maintained at 10.2 during the operation. The pH of the system was adjusted to 3.8 by using sulfuric acid having a concentration of 0.5 mole/L, and after terminating the stirring operation, sedimentation, desalting and washing steps were carried out. The pH of the system was adjusted to 5.9 by using a 1 mole/L sodium hydroxide solution to prepare a silver halide dispersion having pAg of 11.0.

The silver halide dispersion thus obtained was maintained at 38° C. under stirring, to which 5 mL of a 0.34% by weight 1,2-benzoylthiazolin-3-one solution was added thereto, and after 40 minutes, the temperature of the mixture was increased to 47° C. After 20 minutes from the temperature increasing operation, a methanol solution of sodium benzenethiosulfonate was added in an amount of $7.6\times10^{-5}$ mole per 1 mole of silver, and after further 5 minutes, a methanol solution of the tellurium sensitizing agent C was added in an amount of $2.9\times10^{-5}$ mole per 1 mole of silver, followed by being aged for 91 minutes. Thereafter, 1.3 mL of a 0.8% by weight methanol solution of N,N'-dihydroxy-N"-diethylmelamine was added, and after further 4 minutes, $4.8\times10^{-3}$ mole per 1 mole of silver of a methanol solution of 5-methyl-2-mercaptobenzoimidazole, $5.4\times10^{-3}$ mole per 1 mole of silver of a methanol solution of 1-phenyl-2-heptyl-5-mercapto-1,3,4-triazole, and $8.5\times10^{-3}$ mole per 1 mole of silver of an aqueous solution of 1-(3-methylureidophenyl)-5-mercaptotetrazole were added to obtain a silver halide emulsion B.

(Preparation of Silver Halide Emulsion C)

A silver halide emulsion C was prepared in the same manner as the silver halide emulsion A except that the addition amount of the 5% by weight methanol solution of 2,2'-(ethylenedithio)diethanol, the temperature for forming particles, and the addition time of the solution A. The silver halide emulsion C was a pure silver iodide emulsion and was occupied by 80% or more of tabular particles having an average diameter of projected area of 1.369 μm, a variation coefficient of the average diameter of projected area of 19.7%, an average thickness of 0.130 μm, and an average aspect ratio of 11.1. The particles had a sphere equivalent diameter of 0.71 μm. As a result of analysis by X-ray powder diffraction, 90% or more of silver iodide was present in the γ phase.

(Preparation of Silver Halide Emulsion D)

A silver halide emulsion D containing 10% by mole of epitaxially grown silver bromide was prepared in the same manner as the silver halide emulsion B except that the silver halide emulsion C was used instead of the silver halide emulsion A.

(Preparation of Mixed Emulsion For Coating Composition)

The silver halide emulsion B and the silver halide emulsion D were dissolved with each other to a silver molar ratio of 5/1, to which a 1% by weight aqueous solution of benzothiazolium iodide was added in an amount of $7\times10^{-3}$ mole per 1 mole of silver. The compounds 1, 2 and 3 each forming a one-electron oxidant through one-electron oxidation, the one-electron oxidant being capable of releasing one or more electrons, were added thereto in an amount of $2\times10^{-3}$ mole per 1 mole of silver, respectively.

The compounds 1, 2 and 3 each having an adsorbing group and a reducing group were added thereto in an amount of $8\times10^{-3}$ mole per 1 mole of silver, respectively.

Water was added in such an amount that the content of the silver halide in 1 L of the mixed emulsion for a coating composition was 15.6 g as silver.

(2) Preparation of Fatty Acid Silver Salt Dispersion (Preparation of Recrystallized Behenic Acid)

100 kg of behenic acid (Edemor C22-85R, a trade name, produced by Henkel Corp.) was mixed and dissolved in 1,200 kg of isopropyl alcohol at 50° C., and after filtering through a filter of 10 μm, the solution was cooled to 30° C. to effect recrystallization. The cooling speed for the recrystallization was controlled to 3° C. per hour. The resulting crystals were subjected to centrifugal filtration and washed by pouring 100 kg of isopropyl alcohol, followed by drying. The resulting crystals were esterified and measured for GF-FID, and thus the crystals had a behenic acid content of 96% with 2% of lignoceric acid, 2% of arachidinic acid and 0.001% of erucic acid contained.

(Preparation of Fatty Acid Silver Salt Dispersion)

88 kg of the recrystallized behenic acid, 422 L of distilled water, 108.2 L of an NaOH aqueous solution having a concentration of 5 mole/L, and 120 L of t-butyl alcohol were mixed and reacted at 75° C. for 1 hour to obtain a sodium behenate solution B. Separately, 206.2 L of an aqueous solution containing 40.4 kg of silver nitrate (pH 4.0) was prepared and maintained at 10° C. A reaction vessel containing 635 L of distilled water and 30 L of t-butyl alcohol was maintained at 30° C., to which the entire amounts of the sodium behenate solution and the silver nitrate aqueous solution were added under sufficiently stirring at constant flow rates over 93 minutes and 15 seconds, and 90 minutes, respectively. In the operation, only the silver nitrate aqueous solution was added in the initial period of 11 minutes of the addition duration of the silver nitrate aqueous solution, and thereafter, the addition of the sodium behenate solution was started. In the period of 14 minutes and 15 seconds after completing the addition of the silver nitrate aqueous solution, only the sodium behenate solution was added. The temperature in the reaction vessel was 30° C., and the liquid temperature was made constant by controlling the outer temperature. The piping of the addition system of the sodium behenate solution was kept in temperature by circulating warm water through an outer jacket of a double tube, whereby the liquid temperature at the tip end of the addition nozzle was controlled to 75° C. The piping of the addition system of the silver nitrate aqueous solution was kept in temperature by circulating cold water through an outer jacket of a double tube. The addition position of the sodium behenate solution and the addition position of the silver nitrate aqueous solution were arranged as being symmetric to each other with respect to the stirring axis as the center, and were disposed to such a height that the nozzles were not in contact with the reaction solution.

After completing the addition of the sodium behenate solution, the reaction solution was allowed to stand under stirring for 20 minutes at the same temperature, and increased in temperature to 35° C. over 30 minutes, followed by subjecting to aging for 210 minutes. Immediately after completing the aging, the solid content was filtered by centrifuging and washed with water until the conductivity of the filtrate became 30 μS/cm. Thus, a fatty acid silver salt was obtained. The resulting solid content was not dried but was stored as a wet cake.

The shape of the behenic acid silver particle obtained was evaluated by electron photomicroscopy. The result is that a is 0.4 μm, b is 0.4 μm, c is 0.4 μm in average, the average aspect ratio is 2.1, and the crystal is one having a fluctuation diameter corresponding to sphere of 11%.

19.3 kg of polyvinyl alcohol (PVA-217, a trade name) and water were added to the wet cake corresponding to a dry weight of 260 kg to make a total amount of 1,000 kg. The mixture was formed into slurry with dissolver blades and then subjected to preliminary dispersion with a pipeline mixer (Model PM-10, produced by Mizuho Industrial Co., Ltd.).

The liquid having been subjected to the preliminary dispersion was treated three times with a dispersing machine (Micro Fluidizer M-610, a trade name, produced by Microfluidex International Corp.) with a pressure adjusted to 1,150 kg/cm2 to obtain a silver behenate dispersion. The cooling operation was carried out in such a manner that corrugated tube heat exchangers were installed at an inlet and an outlet of the interaction chamber, and the temperature of the refrigerant was controlled to make a dispersing temperature of 18° C.

(3) Preparation of Reducing Agent Dispersion (Preparation of Dispersion of Reducing Agent 1)

10 kg of water was added to 10 kg of the reducing agent 1 (2,2'-methylenebis-(4-ethyl-6-tert-butylphenol)) and 16 kg of a 10% by weight aqueous solution of modified polyvinyl alcohol (Poval MP203, produced by Kuraray Co., Ltd.), followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 3 hours, to which 0.2 g of benzoisothiazoline sodium salt and water were then added to adjust the concentration of the reducing agent to 25% by weight. The resulting dispersion was subjected to a heat treatment at 60° C. for 5 hours to obtain a dispersion of the reducing agent 1. The reducing agent particles contained in the reducing agent dispersion had a median diameter of 0.40 μm and a maximum particle diameter of 1.4 μm. The reducing agent dispersion thus obtained was filtered through a polypropylene filter having a pore diameter of 3.0 μm to remove foreign matters, such as dusts, and then stored.

(Preparation of Dispersion of Reducing Agent 2)

10 kg of water was added to 10 kg of the reducing agent 2 (6,6'-di-t-butyl-4,4'-dimethyl-2,2'-butylidenediphenol) and 16 kg of a 10% by weight aqueous solution of modified polyvinyl alcohol (Poval MP203, produced by Kuraray Co., Ltd.), followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 3 hours and 30 minutes, to which 0.2 g of benzoisothiazoline sodium salt and water were then added to adjust the concentration of the reducing agent to 25% by weight. The resulting dispersion was subjected to a heat treatment at 40° C. for 1 hour and then at 80° C. for 1 hour to obtain a dispersion of the reducing agent 2. The reducing agent particles contained in the reducing agent dispersion had a median diameter of 0.50 μm and a maximum particle diameter of 1.6 μm. The reducing agent dispersion thus obtained was filtered through a polypropylene filter having a pore diameter of 3.0 μm to remove foreign matters, such as dusts, and then stored.

(4) Preparation of Dispersion of Hydrogen Bonding Compound (Preparation of Dispersion of Hydrogen Bonding Compound 1)

10 kg of water was added to 10 kg of the hydrogen bonding compound 1 (tri(4-t-butylphenyl)phosphine oxide) and 16 kg of a 10% by weight aqueous solution of modified polyvinyl alcohol (Poval MP203, produced by Kuraray Co., Ltd.), followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 4 hours, to which 0.2 g of benzoisothiazoline sodium salt and water were then added to adjust the concentration of the hydrogen bonding compound to 25% by weight. The resulting dispersion was subjected to a heat treatment at 40° C. for 1 hour and then at 80° C. for 1 hour to obtain a dispersion of the hydrogen bonding compound 1. The hydrogen bonding compound particles contained in the hydrogen bonding compound dispersion had a median diameter of 0.45 μm and a maximum particle diameter of 1.3 μm. The hydrogen bonding compound dispersion thus obtained was filtered through a polypropylene filter having a pore diameter of 3.0 μm to remove foreign matters, such as dusts, and then stored.

(5) Preparation of Dispersion of Development Accelerating Agent And Dispersion of Color Toning Agent 10 kg of water was added to 10 kg of the development accelerating agent 1 and 20 kg of a 10% by weight aqueous solution of modified polyvinyl alcohol (Poval MP203, produced by Kuraray Co., Ltd.), followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 3 hours and 30 minutes, to which 0.2 g of benzoisothiazoline sodium salt and water were then added to adjust the concentration of the development accelerating agent to 20% by weight to obtain a dispersion of the development accelerating agent 1. The development accelerating agent particles contained in the development accelerating agent dispersion had a median diameter of 0.48 μm and a maximum particle diameter of 1.4 μm. The development accelerating agent dispersion thus obtained was filtered through a polypropylene filter having a pore diameter of 3.0 μm to remove foreign matters, such as dusts, and then stored.

Solid dispersions of the development accelerating agent 2 and the color toning agent 1 were prepared by dispersing in the same manner as the development accelerating agent 1, so as to obtain dispersions having solid contents of 20% by weight and 15% by weight, respectively.

(6) Preparation of Dispersion of Polyhalogen Compound (Preparation of Dispersion of Organic Polyhalogen Compound 1)

10 kg of the organic polyhalogen compound 1 (tribromomethanesulfonylbenzene), 10 kg of a 20% by weight aqueous solution of modified polyvinyl alcohol (Poval MP203, produced by Kuraray Co., Ltd.), 0.4 kg of a 20% by weight aqueous solution of sodium triisopropylnaphthalenesulfonate and 10 kg of water were added to each other, followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 5 hours, to which 0.2 g of benzoisothiazoline sodium salt and water were then added to adjust the concentration of the organic polyhalogen compound to 30% by weight to obtain a dispersion of the organic polyhalogen compound 1. The organic polyhalogen compound particles contained in the organic polyhalogen compound dispersion had a median diameter of 0.41 μm and a maximum particle diameter of 2.0 μm. The organic polyhalogen compound dispersion thus obtained was filtered through a polypropylene filter having a pore diameter of 10.0 μm to remove foreign matters, such as dusts, and then stored.

(Preparation of Dispersion of Organic Polyhalogen Compound 2)

10 kg of the organic polyhalogen compound 2 (N-butyl-3-tribromomethanesulfonylbenzoamide), 20 kg of a 10% by weight aqueous solution of modified polyvinyl alcohol (Poval MP203, produced by Kuraray Co., Ltd.) and 0.4 kg of a 20% by weight aqueous solution of sodium triisopropylnaphthalenesulfonate were added to each other, followed by well mixing, to obtain a slurry. The slurry was transferred with a diaphragm pump to a transversal sand mill (UVM-2, produced by Aimex Co., Ltd.) having zirconia beads having an average diameter of 0.5 mm filled therein and dispersed for 5 hours, to which 0.2 g of benzoisothiazoline sodium salt and water were then added to adjust the concentration of the organic polyhalogen compound to 30% by weight. The dispersion was heated to 40° C. for 5 hours to obtain a dispersion of the organic polyhalogen compound 2. The organic polyhalogen compound particles contained in the organic polyhalogen compound dispersion had a median diameter of 0.40 μm and a maximum particle diameter of 1.3 μm. The organic polyhalogen compound dispersion thus obtained was filtered through a polypropylene filter having a pore diameter of 3.0 μm to remove foreign matters, such as dusts, and then stored.

(7) Preparation of Silver Iodide Complexing Agent 8 kg of modified polyvinyl alcohol MP203 was dissolved in 174.57 kg of water, and 3.15 kg of a 20% by weight aqueous solution of sodium triisopropylnaphthalenesulfonate and 14.28 kg of a 70% by weight aqueous solution of 6-isopropylphthalazine were added thereto to prepare a 5% by weight solution of a silver iodide complexing agent.

(8) Preparation of Mercapto Compound (Preparation of Aqueous Solution of Mercapto Compound 1)

7 g of a mercapto compound 1 (1-(3-sulfophenyl)-5-mercaptotetorazol sodium salt) was dissolved in 933 g of water to prepare a 0.7% by weight aqueous solution.

(Preparation of Aqueous Solution of Mercapto Compound 2)

20 g of a mercapto compound 2 (1-(3-methylureidophenyl)-5-mercaptotetorazol) was dissolved in 980 g of water to prepare a 2.0% by weight aqueous solution.

(9) Preparation of SBR Latex Liquid (Preparation of SBR Latex Liquid)

An SBR latex was prepared in the following manner.

287 g of distilled water, 7.73 g of a surface active agent (Paionin A-43-S, produced by Takemoto Oil & Fat Co., Ltd., solid content: 48.5%), 14.06 mL of a 1 mole/L solution of NaOH, 0.15 g of trisodium ethylene diamine tetraacetate, 255 g of styrene, 11.25 g of acrylic acid and 3.0 g of tert-dodecylmercaptan were placed in a gas monomer reaction apparatus (Model TAS-2J, produced by Taiatsu Techno Corp.). The reaction vessel was sealed, and the mixture was stirred at a stirring speed of 200 rpm. After evacuating and replacing with nitrogen gas in several times, 108.75 g of 1,3-butadiene was pressed into the vessel, and the interior temperature was increased to 60° C. A solution obtained by dissolving 1.875 g of ammonium persulfate in 50 mL of water was added thereto, and the mixture was stirred for 5 hours. The temperature was then increased to 90° C., and the mixture was stirred for 3 hours. After completing the reaction, the interior temperature was decreased to room temperature, and 1 mole/L solutions of NaOH and $NH_4OH$ were added thereto to make a ratio ($Na^+$ ion)/($NH^{4+}$ ion) of 1/5.3 (molar ratio) to adjust the pH to 8.4. Thereafter, the system was filtered through a polypropylene filter having a pore size of 1.0 μm to remove foreign matters, such as dusts, and stored as 774.7 g of an SBR latex. The measurement of halogen ions by ionic chromatography revealed that the chloride ion concentration was 3 ppm. The measurement with high-speed liquid chromatography revealed that the concentration of the chelating agent was 145 ppm.

The latex had an average particle diameter of 90 nm, a glass transition temperature Tg of 17° C., a solid content of 44% by weight, an equilibrium water content at 25° C. 60% RH of 0.6% by weight, an ionic conductivity of 4.80 mS/cm (the ionic conductivity was measured for the latex undiluted solution (44% by weight) at 25° C. with a conductivity meter, CM-30S, produced by DKK-TOA Corp.) and pH 8.4. SBR latexes having different glass transition temperatures Tg can be prepared in the same manner with the ratio of styrene and butadiene varied.

1-3-2. Preparation of Coating Compositions (1) Preparation of Coating Composition For Emulsion Layer (Photosensitive Layer)

The dispersion of the organic polyhalogen compound 1, the dispersion of the organic polyhalogen compound 2, the SBR latex (Tg: 17° C.) liquid, the dispersion of the reducing agent 1, the dispersion of the reducing agent 2, the dispersion of the hydrogen bonding compound 1, the dispersion of the development accelerating agent 1, the dispersion of the accelerating agent 2, the dispersion of the color toning agent 1, the aqueous solution of the mercapto compound 1 and the aqueous solution of the mercapto compound 2 were sequentially added to 1,000 kg of the fatty acid silver salt dispersion obtained and 276 mL of water, and immediately before coating, the mixed silver halide emulsion for the coating composition was added thereto in an amount of 0.22 mole in terms of silver per 1 mole of the fatty acid silver salt, followed by well mixing. The resulting coating composition for an emulsion layer was sent to a coating die and coated.

The viscosity measured with a B type viscometer produced by Tokyo Keiki Co., Ltd., at 40° C. (with No. 1 rotor at 60 rpm) of the coating composition for an emulsion layer was 25 mPa•s.

The viscosity measured with RFS Fluid Spectrometer, produced by Rheometrix Far East, Inc. of the coating composition was 242, 65, 48, 26 and 20 mPa•s at a shearing speed of 0.1, 1, 10, 100 and 1,000 (1/sec).

The zirconium amount in the coating composition was 0.52 mg per 1 g of silver.

(2) Preparation of Coating Composition For Intermediate Layer On Emulsion Layer Side To 1,000 g of polyvinyl alcohol (PVA-205, produced by Kuraray Co., Ltd.) and 4,200 mL of a 19% by weight latex liquid of a methyl methacrylate-styrene-butyl acrylate-hydroxyethyl acrylate-acrylic acid copolymer (copolymerization ratio: 64/9/20/5/2), 27 mL of a 5% by weight aqueous solution of Aerosol OT (produced by American Cyanamid Co., Ltd.), 135 mL of a 20% by weight aqueous solution of diammonium phthalate and water to make 10,000 g in total were added, and the pH was adjusted to 7.5 with NaOH, so as to prepare a coating composition for an intermediate layer, which was sent to a coating die at 9.1 mL/$m^2$.

The viscosity measured with a B type viscometer at 40° C. (with No. 1 rotor at 60 rpm)of the coating composition was 58 mPa•s.

(3) Preparation of Coating Composition For First Surface Protective Layer On Emulsion Layer Side 64 g of inert gelatin was dissolved in water, and 112 g of a 19% by weight latex liquid of a methyl methacrylate-styrene-butyl acrylate-hydroxyethyl acrylate-acrylic acid copolymer (copolymerization ratio: 64/9/20/5/2), 30 mL of a 15% by weight methanol solution of phthalic acid, 23 mL of a 10% by weight aqueous solution of 4-methyl phthalate, 28 mL of sulfuric acid having a concentration of 0.5 mole/L, 5 mL of a 5% by weight aqueous solution of Aerosol OT (produced by American Cyanamid Co., Ltd.), 0.5 g of phenoxyethanol and 0.1 g of benzoisothazolinone were added thereto, to which water was added to make 750 g in total, so as to prepare a coating composition. 26 mL of 4% by weight solution of chromium alum was mixed with the coating composition in a static mixer immediately before coating, and the coating composition was sent to a coating die at 18.6 mL/$m^2$.

The viscosity measured with a B type viscometer at 40° C. (with No. 1 rotor at 60 rpm) of the coating composition was 20 mPa•s.

(4) Preparation of Coating Composition For Second Surface Protective Layer On Emulsion Layer Side 80 g of inert gelatin was dissolved in water, and 102 g of a 27.5% by weight latex liquid of a methyl methacrylate-styrene-butyl acrylate-hydroxyethyl acrylate-acrylic acid copolymer (copolymerization ratio: 64/9/20/5/2), 5.4 mL of a 2% by weight solution of a fluorine surface active agent (F-1), 5.4 mL of a 2% by weight aqueous solution of a fluorine surface active agent (F-2), 23 mL of a 5% by weight aqueous solution of Aerosol OT (produced by American Cyanamid Co., Ltd.), 4 g of polymethyl methacrylate fine particles (average particle diameter: 0.7 μm, distribution of volume weighted average thereof: 30%), 21 g of polymethyl methacrylate fine particles (average particle diameter: 3.6 μm, distribution of volume weighted average thereof: 60%), 1.6 g of 4-methylphthalic acid, 4.8 g of phthalic acid, 44 mL of sulfuric acid having a concentration of 0.5 mole/L and 10 mg of benzoisothazolinone were added thereto, to which water was added to make 650 g in total, so as to prepare a coating composition. 445 mL of an aqueous solution containing 4% by weight of chromium alum and 0.67% by weight of phthalic acid was mixed with the coating composition in a static mixer immediately before coating, and the coating composition was sent to a coating die at 8.3 mL/$m^2$.

The viscosity measured with a B type viscometer at 40° C. (with No. 1 rotor at 60 rpm) of the coating composition was 19 mPa•s.

1-4. Production of Thermal Developing Photosensitive Material 1

The emulsion layer, the intermediate layer, the first protective layer, the second protective layer were coated in the order from the undercoating layer by the simultaneous multilayer coating technique in the slide bead coating system, so as to produce a sample of a thermal developing photosensitive material. Upon coating, the emulsion layer and the intermediate layer were adjusted to 31° C., the first protective layer was adjusted to 36° C., and the second protective layer was adjusted to 37° C. The coated silver amount of the image forming layer was 0.821 g/$m^2$ per one surface in total of the fatty acid silver salt and the silver halide. The layers were coated on both surfaces of the support.

The coated amounts (g/$m^2$) of the compounds in the emulsion layer per one surface were as follows.

| | |
|---|---|
| Silver behenate | 2.80 |
| Polyhalogen compound 1 | 0.028 |
| Polyhalogen compound 2 | 0.094 |
| Silver iodide complexing agent | 0.46 |
| SBR latex | 5.20 |
| Reducing agent 1 | 0.33 |
| Reducing agent 2 | 0.13 |
| Hydrogen bonding agent 1 | 0.15 |
| Development accelerating agent 1 | 0.005 |
| Development accelerating agent 2 | 0.035 |
| Color toning agent 1 | 0.002 |
| Mercapto compound 1 | 0.001 |
| Mercapto compound 2 | 0.003 |
| Silver halide (in terms of Ag) | 0.146 |

The coating and drying conditions were as follows.

The support was destaticized with an ion flux before coating, and the coating was carried out at a speed of 160 m/min. The coating and drying conditions were adjusted within the following range for the respective samples, whereby such conditions were obtained that provided the most stable surface conditions were obtained.

The distance between the tip end of the coating die and the support was from 0.10 to 0.30 mm.

The pressure in the low-pressure chamber was lower than the atmospheric pressure by from 196 to 882 Pa.

The coating composition was cooled in the subsequent chilling zone with an air stream having a dry-bulb temperature of from 10 to 20° C.

The coated support was conveyed by a non-contact conveying system and dried with a dry air stream having a dry-bulb temperature of from 23 to 45° C. and a wet-bulb temperature of from 15 to 21 in a spiral non-contact dryer.

After drying, the coated layers were conditioned in humidity of from 40 to 60% RH at 25° C.

Subsequently, the layer surface was heated to a temperature of from 70 to 90° C. and then cooled to 25° C.

The mattc degree in terms of Beck smoothness of the thermal developing photosensitive material thus produced was 550 second on the photosensitive layer surface and 130 seconds on the back surface. The surface pH on the photosensitive layer surface was 6.0.

The chemical structures of the compounds used in the example are shown below.

Tellurium Sensitizing Agent C

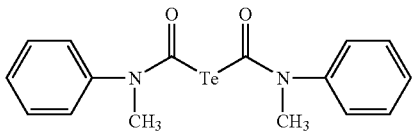

Compound Forming One-electron Oxidant Formed Through One-electron Oxidation, the One-electron Oxidant Capable of Releasing One Or More Electrons 1

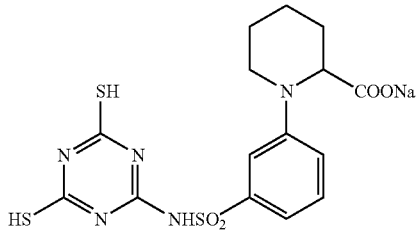

Compound Forming One-electron Oxidant Formed Through One-electron Oxidation, the One-electron Oxidant Capable of Releasing One Or More Electrons 2

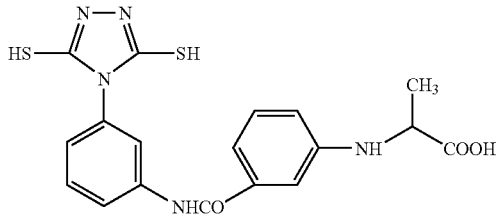

Compound Forming One-electron Oxidant Formed Through One-electron Oxidation, the Onc-electron Oxidant Capable of Releasing One Or More Electrons 3

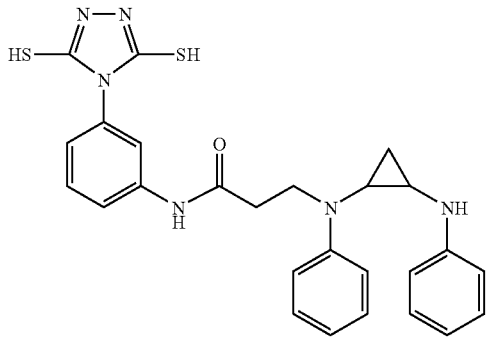

Compound Having Adsorbing Group And Reducing Group 1

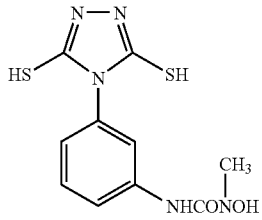

Compound Having Adsorbing Group And Reducing Group 2

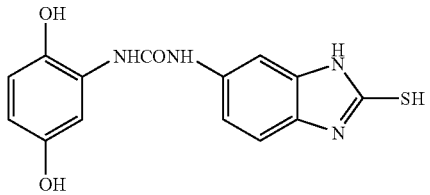

Compound Having Adsorbing Group And Reducing Group 3

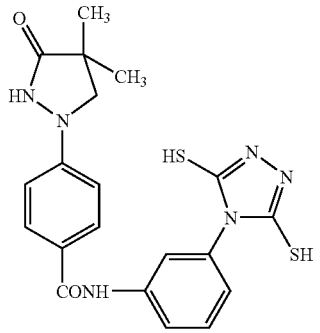

Reducing Agent 1

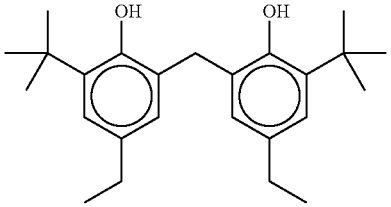

Reducing Agent 2

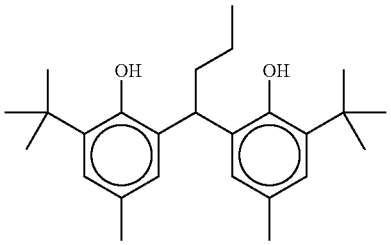

Hydrogen Bonding Compound 1

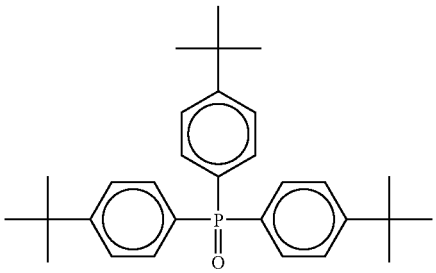

Polyhalogen Compound 1

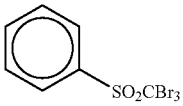

-continued

Polyhalogen Compound 2

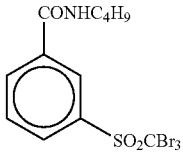

Mercapto Compound 1

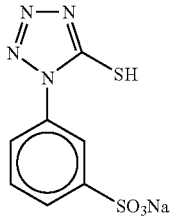

Mercapto Compound 2

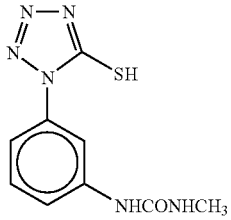

Silver Iodide Complexing Agent

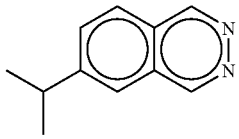

Development Accelerating Agent 1

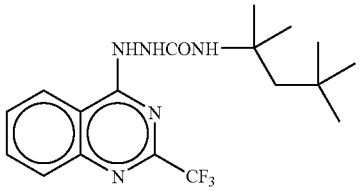

Development Accelerating Agent 2

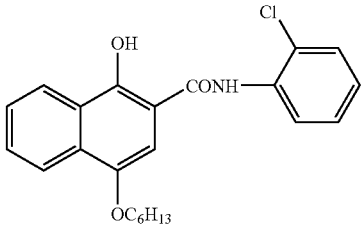

Color Toning Agent 1

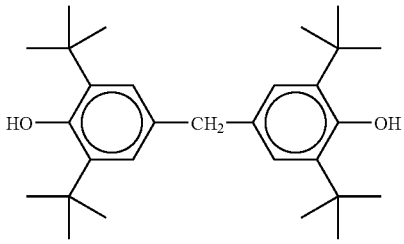

F-1

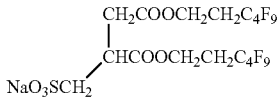

-continued

F-2

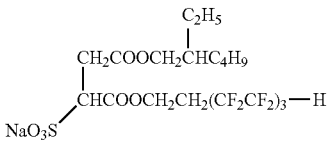

(Evaluation of Photographic Characteristics)

The sample thus produced was cut into a 356×432 mm size and packed with the following packing material under an environment of 25° C. and 50%. After storing 2 weeks at ordinary temperature, the sample was subjected to the following evaluations.

(Packing Material)

A laminated film of PET (10 μm), PE (12 μm), aluminum foil (9 μm), nylon (15 μm) and polyethylene containing 3% of carbon (50 μm) had an oxygen permeability of 0.02 mL/atm•$m^2$•day at 25° C. and a moisture permeability of 0.10 g/atm•$m^2$•day at 25° C.

The double sided photosensitive material thus prepared was evaluated in the following manner.

The sample was held between a pair of X-ray regular screens, HI-SCREEN B3, produced by Fuji Photo Film Co., Ltd., (using $CaWO_4$ as a fluorescent material with a luminescence peak wavelength of 425 nm) to fabricate an image forming assembly. The assembly was exposed to an X-ray for 0.05 second to effect X-ray sensitometry. The X-ray apparatus used was DRX-3742HD, a trade name, produced by Toshiba Corp., with a tungsten target. A three-phase voltage of 80 kVp was applied with a pulse generator, and an X-ray passing through a filter with water of 7 cm in thickness, which had an absorbance substantially equivalent to human body, was used as exposure irradiation. The X-ray exposure amount was changed by changing the distance from the irradiation source to effect stepwise exposure with a width of logE=0.15. After the exposure, the sample was developed under the thermal developing conditions with the thermal developing apparatus according to the invention. The image thus obtained was evaluated with a densitometer.

A regular photosensitive material for a wet developing system, RX-U, produced by Fuji Photo Film Co., Ltd., was exposed in the same conditions and processed with a processing solution, CE-D1, produced by Fuji Photo Film Co., Ltd., for 45 seconds by using an automatic developing machine, CEPROS-M2, produced by Fuji Photo Film Co., Ltd.

As a result of comparison between an image obtained with the thermal developing photosensitive material in the embodiment and an image obtained by the wet developing system, it was found that equivalent good results were obtained in both the cases.

What is claimed is:

1. A thermal developing apparatus for developing a latent image recorded on a photosensitive thermal developing recording material, comprising:

a conveying unit for conveying the material along a conveying path;

a heating unit for heating the material while conveying the material by the conveying unit, the heating unit being provided at the conveying path; and a manual feeding tray for manually feeding an exposed material into the thermal developing apparatus, wherein the heating unit heats both sides of the material.

2. The thermal developing apparatus according to claim 1, wherein the heating unit comprises a plurality of press rollers comprising heaters.

3. The thermal developing apparatus according to claim 2, wherein each of the plurality of press rollers comprises a heater.

4. The thermal developing apparatus according to claim 1, wherein the heating unit comprises a plate heater.

5. The thermal developing apparatus according to claim 1, wherein a plurality of press rollers heat a first side of the photosensitive thermal developing recording material and a plate heater heats a second side of the photosensitive thermal developing recording material.

* * * * *

UNITED STATES PATENT AND TRADEMARK OFFICE

CERTIFICATE OF CORRECTION

PATENT NO. : 7,405,744 B2
APPLICATION NO. : 11/070220
DATED : July 29, 2008
INVENTOR(S) : Tatsuyuki Denawa It is certified that error appears in the above-identified patent and that said Letters Patent is hereby corrected as shown below:

Title Page, Item (73)-Assignee
Delete "FUJFILM" and insert -- FUJIFILM --

Signed and Sealed this

Twenty-fifth Day of November, 2008

JON W. DUDAS
*Director of the United States Patent and Trademark Office*